US011666902B2

(12) United States Patent
Lee et al.

(10) Patent No.: US 11,666,902 B2
(45) Date of Patent: Jun. 6, 2023

(54) MODULAR FLUIDIC CHIP AND FLUIDIC FLOW SYSTEM COMPRISING SAME

(71) Applicant: KOREA ADVANCED INSTITUTE OF SCIENCE AND TECHNOLOGY, Daejeon (KR)

(72) Inventors: Seok Jae Lee, Daejeon (KR); Moon Keun Lee, Daejeon (KR); Nam Ho Bae, Daejeon (KR); Tae Jae Lee, Chungcheongbuk-do (KR); Kyoung Gyun Lee, Daejeon (KR); Yoo Min Park, Seoul (KR)

(73) Assignee: KOREA ADVANCED INSTITUTE OF SCIENCE AND TECHNOLOGY, Daejeon (KR)

( * ) Notice: Subject to any disclaimer, the term of this patent is extended or adjusted under 35 U.S.C. 154(b) by 323 days.

(21) Appl. No.: 16/978,438

(22) PCT Filed: Jul. 25, 2019

(86) PCT No.: PCT/KR2019/009270
§ 371 (c)(1),
(2) Date: Sep. 4, 2020

(87) PCT Pub. No.: WO2020/027499
PCT Pub. Date: Feb. 6, 2020

(65) Prior Publication Data

US 2021/0046472 A1 Feb. 18, 2021

(30) Foreign Application Priority Data

Jul. 28, 2018 (KR) ..... 10-2018-0088227
Jul. 23, 2019 (KR) ..... 10-2019-0088822

(51) Int. Cl.
*B01L 3/00* (2006.01)

(52) U.S. Cl.
CPC ..... *B01L 3/5027* (2013.01); *B01L 3/502715* (2013.01); *B01L 2200/027* (2013.01);
(Continued)

(58) Field of Classification Search
CPC ..... B01L 3/502715; B01L 2200/028; B01L 3/5027
See application file for complete search history.

(56) References Cited

U.S. PATENT DOCUMENTS 5,580,523 A 12/1996 Bard
10,603,660 B2 * 3/2020 Alles ..... B01L 3/5025
(Continued)

FOREIGN PATENT DOCUMENTS

CN 101267885 A 9/2008
CN 102056838 A 5/2011
(Continued)

OTHER PUBLICATIONS

Andrea Alles and Keith Stuart, Modular Reactor [Patent Application] Paper according to the Article 203 of Patent Act (Translated), 2017, KIPO (Year: 2017).*
(Continued)

*Primary Examiner* — Jennifer Wecker
*Assistant Examiner* — Mickey Huang
(74) *Attorney, Agent, or Firm* — AEON Law, PLLC; Adam L. K. Philipp; David V. H. Cohen

(57) ABSTRACT

A modular fluidic chip includes a body configured to have at least one flow channel formed in an inside thereof and be connected to another modular fluidic chip to allow the at least one flow channel to communicate with a flow channel provided in the other modular fluidic chip. A fluidic chip capable of performing one function is formed in the form of a module, whereby a fluidic flow system of various structures can be implemented without restriction in shape or size
(Continued)

by connecting a plurality of fluidic chips capable of performing different functions as necessary. Through this, various and accurate experimental data can be obtained, and when a specific portion is deformed or damaged, only the fluidic chip corresponding thereto can be replaced, thereby reducing manufacture and maintenance costs.

19 Claims, 53 Drawing Sheets

(52) U.S. Cl.
CPC . *B01L 2200/028* (2013.01); *B01L 2300/0861* (2013.01); *B01L 2300/0883* (2013.01); *B01L 2300/161* (2013.01)

(56) References Cited

U.S. PATENT DOCUMENTS

| | | | |
|---|---|---|---|
| 2003/0136451 | A1 | 7/2003 | Beebe et al. |
| 2004/0228771 | A1 | 11/2004 | Zhou et al. |
| 2005/0255003 | A1 | 11/2005 | Summersgill et al. |
| 2006/0263914 | A1 | 11/2006 | Sando et al. |
| 2009/0132204 | A1 | 5/2009 | Bodlaender et al. |
| 2009/0156966 | A1 | 6/2009 | Kontschieder et al. |
| 2009/0257920 | A1 | 10/2009 | Facer et al. |
| 2010/0258211 | A1 | 10/2010 | Burns et al. |
| 2012/0093692 | A1 | 4/2012 | Blomberg et al. |
| 2015/0352550 | A1 | 12/2015 | Bhargava et al. |
| 2018/0078936 | A1* | 3/2018 | Owens ..... B01L 3/502715 |

FOREIGN PATENT DOCUMENTS

| | | | |
|---|---|---|---|
| CN | 105636697 | A | 6/2016 |
| CN | 107541452 | A | 1/2018 |
| EP | 3190172 | A2 | 7/2017 |
| JP | 2012529650 | A | 11/2012 |
| KR | 1020050057222 | A | 6/2005 |
| KR | 101150355 | B1 | 6/2012 |
| KR | 1020140015941 | A | 2/2014 |
| KR | 1020150008234 | A | 1/2015 |
| KR | 1020150138997 | A | 12/2015 |
| KR | 20177009062 | A * | 5/2017 |
| KR | 1020170049564 | A | 5/2017 |
| WO | 0062918 | A2 | 10/2000 |
| WO | 2015090339 | A1 | 6/2015 |
| WO | 2015138696 | A1 | 9/2015 |
| WO | 2015191723 | A1 | 12/2015 |
| WO | 2017201438 | A1 | 11/2017 |

OTHER PUBLICATIONS

Office Action received for Korean Patent Application No. 10-2022-0013722 dated Jun. 23, 2022, 13 pages (6 pages of Official language and 7 pages of English translation).
Extended European Search Report; EP Patent Application No. 19844384.8; dated Nov. 26, 2021; 14 pages.
First Office Action; Chinese Patent Application No. 201980050280.8; dated Nov. 12, 2021; 20 pages (10 pages of Official Copy and 10 pages of English translation).
Grant of Patent; Korean Patent Application No. 10-2019-0088822; dated Dec. 13, 2021; 7 pages (5 pages of Official copy and 2 pages of English translation).
Notification of Reason for Refusal; Korean Patent Application No. 10-2021-0110987; dated Nov. 29, 2021; 10 pages (5 pages of Official copy and 5 pages of English translation).
Partial European Supplementary Search Report; EP Patent Application No. 19844384.8; dated Oct. 8, 2021; 13 pages.
Office Action dated Dec. 27, 2020 in KR Application No. 10-2019-0088805.
International search report PCT/KR2019/009270.
International search report PCTKR2019009272.
Extended European Search Report; EP Patent Application No. 19843210.6; dated Dec. 20, 2021; 9 pages.
Office Action for Chinese Patent Application No. 201980048036.8, dated Apr. 1, 2022, 19 pages (10 pages of Official copy and 9 pages of English Translation).

* cited by examiner (a)

(b)

(a)

(b)

(a)

(b)

(a)

(b)

(a)

(b)

(a)

(b)

(a)

(b)

MODULAR FLUIDIC CHIP AND FLUIDIC FLOW SYSTEM COMPRISING SAME

TECHNICAL FIELD

The present disclosure relates to a modular fluidic chip and a fluidic flow system comprising the same, and more particularly, a modular fluidic chip capable of implementing a fluidic flow system of various structures by connecting a plurality of fluidic chips that can perform different functions, and a fluidic flow system comprising the same.

BACKGROUND ART

Lab-on-a-chip (LOC) technology has received considerable attention to overcome disadvantages of existing diagnostic techniques. The Lab-on-a-chip technology (LOC) is a representative example of the convergence technology of NT, IT and BT and refers to a technology to perform all sample pretreatment and analysis steps, such as sample dilution, mixture, reaction, separation, and quantification, on a single chip, by using techniques, for example, MEMS and NEMS.

Microfluidic devices to which such lab-on-a-chip technology (LOC) is applied analyze and diagnose a flow of a fluid sample flowing through a reaction channel or a reaction between a reagent and the fluid sample supplied to the reaction channel. In addition, such microfluidic devices are manufactured in a form in which a number of units required for analysis are provided on a small chip of a size of several $cm^2$, which is formed of glass, silicon or plastic, in such a manner that various steps of processing and manipulation can be performed on a single chip.

Specifically, the microfluidic device is configured to include a chamber capable of trapping a small amount of fluid, a reaction channel through which the fluid can flow, a valve capable of controlling a flow of fluid, and various functional units capable of performing a preset function by receiving the fluid.

However, since conventional microfluidic devices are manufactured to have functions associated with a plurality of microfluidic devices according to a purpose of an experiment, the entirety of the devices should be newly manufactured, even if a change or a problem occurs in one function. In addition, there is a limitation that management is not easy.

Also, once the microfluidic device is manufactured, it is difficult to change a design of the manufactured device, and the manufactured device is not compatible with other microfluidic devices, so that other experiments other than set experiments cannot be performed.

In addition, conventional microfluidic devices are limited in size and specifications that can be manufactured, so that a structural expansion thereof is infeasible. Accordingly, since it is necessary to predict the entire experiment result after performing only a portion of experiments, there is a limitation in obtaining accurate experimental data.

DISCLOSURE

Technical Problem

The present disclosure is conceived to solve the above problems, and an object of the present disclosure is to provide a modular fluidic chip capable of implementing a fluidic flow system of various structures without restriction in shape or size by connecting a plurality of fluidic chips that may perform different functions as needed, whereby various and accurate experimental data can be obtained, and when a specific portion is deformed or damaged, only the fluidic chip corresponding thereto can be replaced, and a fluidic flow system comprising the modular fluidic chip.

The technical problem to be achieved by the present disclosure is not limited to the problems mentioned above, and other problems not mentioned can be clearly understood by those skilled in the art from the following description.

Technical Solution

A modular fluid chip according to a first embodiment of the present disclosure to solve the above problems includes a body configured to have at least one flow channel formed in an inside thereof and be connected to another modular fluidic chip to allow the at least one flow channel to communicate with a flow channel provided in the other modular fluidic chip.

The body may include a core member in which the at least one flow channel is formed; and at least one connection member provided in the core member so as to be coupled with the other modular fluidic chip.

The connection member may be configured to be provided integrally with the core member or coupled to and separable from the core member.

The connection member may be configured to open the flow channel provided at an inside thereof when coupled to the other modular fluidic chip and close the flow channel when separated from the other modular fluidic chip.

The connection member may be formed of an elastic material, and may be configured to open the flow channel by being compressed in an axial direction and at the same time, expanded in a direction perpendicular to the axial direction when the connection member is subjected to pressure in the axial direction through the other modular fluidic chip coupled to one side thereof, and configured to close the flow channel by being restored by an elastic force when the pressure is released.

On an inner surface of the connection member, opening and closing portions that contact or are separated from each other according to deformation of the connection member to thereby close and open the flow channel may be provided.

In addition, a modular fluidic chip according to a second embodiment of the present disclosure includes a body having at least one flow channel formed in an inside thereof, wherein the at least one flow channel includes a first flow channel and a second flow channel that have different heights.

The first flow channel may be formed at a position relatively lower than that of the second flow channel, and the first flow channel and the second flow channel may be configured to guide fluid flowing therein in a horizontal direction.

The at least one flow channel may further include a third flow channel configured to guide a flow of fluid in a vertical direction; a chamber configured to store and stabilize the fluid introduced from one side thereof, therein, and discharge the fluid to the other side thereof; and a fourth flow channel formed at a position relatively lower than that of the first flow channel or the chamber, and configured to guide the fluid flowing therein in the horizontal direction.

The at least one flow channel may be configured to allow the fluid discharged from the chamber to pass through at least one of the first flow channel, the second flow channel, the third flow channel, and the fourth flow channel.

The body may be provided with an air flow hole allowing the at least one flow channel and an external space to communicate with each other.

The modular fluidic chip may further include an opening and closing member configured to be attached to the body and open and close the air flow hole.

The opening and closing member may be formed of a hydrophobic material capable of removing bubbles from a hydrophilic fluid flowing through the at least one flow channel, or may be formed of a fibrous structure coated with a hydrophobic material on a surface thereof.

The opening and closing member formed of the hydrophobic material may be formed of one or more hydrophobic materials selected from a group consisting of polytetrafluro ethylene (PTFE), polyethylene terephtalate (PET), and polyvinyl chloride.

The opening and closing member may be formed of a hydrophilic material capable of removing bubbles from a hydrophobic fluid flowing through the at least one flow channel, or may be formed of a fibrous structure coated with a hydrophilic material on a surface thereof.

The opening and closing member may include a hydrophobic material and a hydrophilic material.

The body may be formed integrally through 3D printing processing or may be formed in a form of a plurality of modules that are combined with and separated from each other through injection molding processing.

In addition, a modular fluidic chip according to a third embodiment of the present disclosure includes a body having at least one flow channel formed in an inside thereof, wherein the body includes a core member including a plurality of first guide flow channels for guiding a flow of fluid in a vertical direction; and a film member configured to be attached to an outer surface of the core member and allow the plurality of first guide flow channels to communicate with each other.

The film member may include a first film layer attached to the outer surface of the core member and having at least one second guide flow channel formed in an inside thereof, the at least one second guide flow channel being connected to the plurality of first guide flow channels to guide the flow of the fluid in a horizontal direction; and a second film layer attached to an outer surface of the first film layer.

The core member may be formed integrally through 3D printing processing or may be formed in a form of a plurality of modules that are combined with and separated from each other through injection molding processing.

In addition, a fluidic flow system according to an embodiment of the present disclosure includes a first modular fluidic chip capable of implementing a first function; and at least one second modular fluidic chip capable of implementing a second function different from the first function and capable of being connected to the first modular fluidic chip in at least one of a horizontal direction and a vertical direction.

Advantageous Effects

According to an embodiment of the present disclosure, a fluidic chip capable of performing one function is formed in the form of a module, whereby a fluidic flow system of various structures can be implemented without restriction in shape or size by connecting a plurality of fluidic chips capable of performing different functions as necessary. Through this, various and accurate experimental data can be obtained, and when a specific portion is deformed or damaged, only the fluidic chip corresponding thereto can be replaced, thereby reducing manufacture and maintenance costs.

In addition, a housing which is connectable to another modular fluidic chip, and a body which has a channel formed therein and is selectively replaced in the housing are each formed in a module shape. Accordingly, it is feasible to easily change a position of a selected section and a shape of the channel in one fluidic flow system, as needed. Through this, it is feasible to promptly change experimental conditions, thereby allowing for a variety of experiments during a preset period of time, as compared to conventional fluidic flow system, and when a part is defective or damaged, only the housing or the body corresponding to the part can be promptly replaced.

In addition, when the modular fluidic chip and the other modular fluidic chip are connected, holes of the respective fluidic chips are in an aligned state and communicate with each other, and at connection portions of the modular fluidic chip and other modular fluidic chip, fluid connectors that are in close contact with each other and form an interface are provided. Thus, leakage of fluid at the connection portions during the flow of fluid is prevented, and a change in fluid pressure is minimized, and furthermore, a composition of the fluid or a shape of microdroplets can be maintained.

DETAILED DESCRIPTION OF EMBODIMENTS

Figure 1:
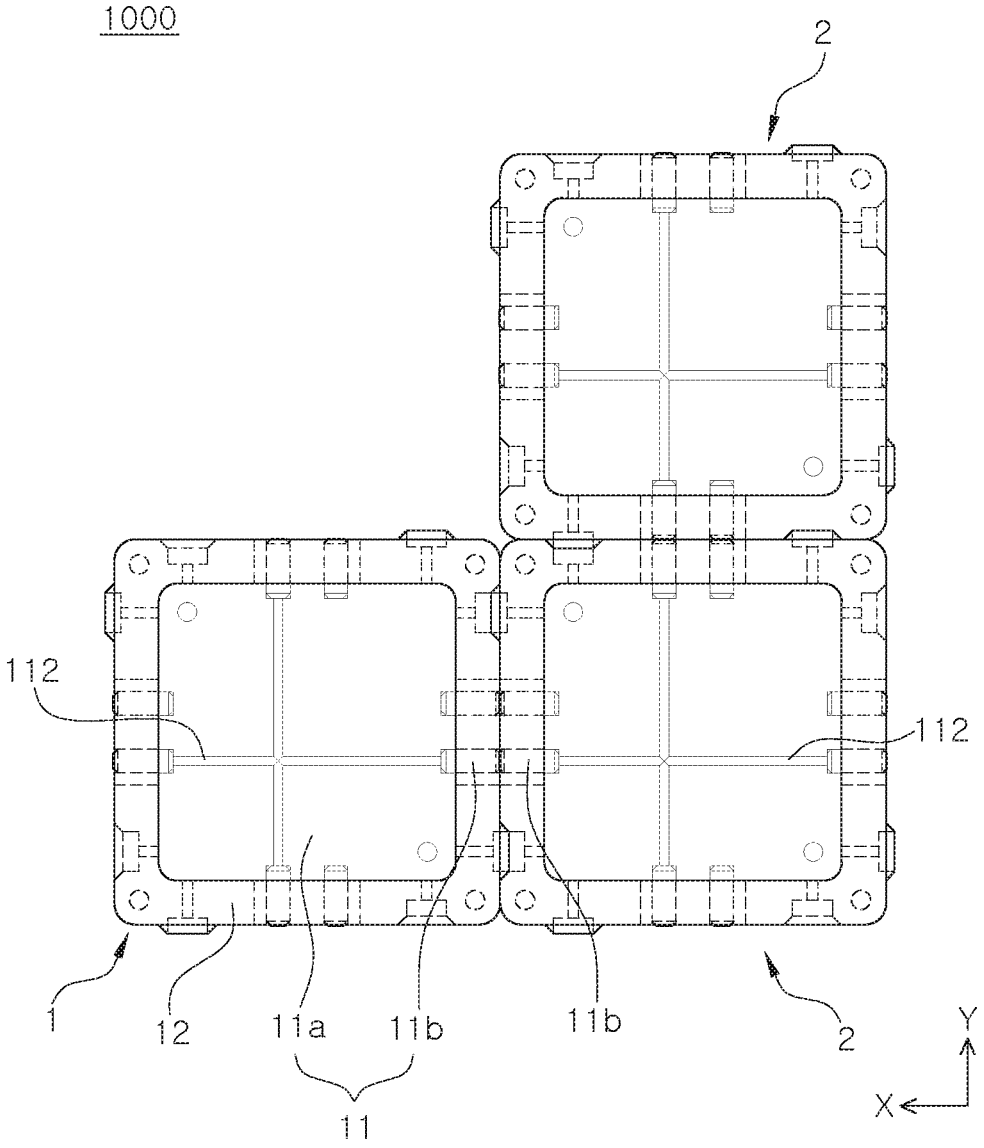
FIG. 1 is a perspective view of a fluidic flow system in which modular fluidic chips are connected in horizontal directions according to an embodiment of the present disclosure.

Hereinafter, various embodiments will be described in more detail with reference to the accompanying drawings. The embodiments may be variously modified. Specific embodiments may be depicted in the drawings and concretely explained in the detailed description. However, specific embodiments disclosed in the accompanying drawings are only intended to facilitate understanding of various embodiments. Therefore, it is not intended to limit the technical idea to the specific embodiments disclosed in the accompanying drawings, and it should be understood to include all equivalents or substitutes included in the spirit and scope of the invention.

Terms such as first or second may be used to describe various components, but the components should not be limited by the terms. The terms are only for the purpose of distinguishing one component from another component.

In this specification, it should be understood that term "include" or "have" indicates that a feature, a number, a step, an operation, a component, a part, or the combination thereof described in the specification is present, but does not exclude a possibility of presence or addition of one or more other features, numbers, steps, operations, components, parts or combinations thereof, in advance. When a component is said to be "connected" or "accessed" to another component, it may be directly connected to or accessed to that other component, but it is to be understood that other components may exist in between. On the other hand, when a component is said to be "directly connected" or "directly accessed" to another component, it should be understood that there is no other component in between.

Meanwhile, "a module" or "a unit, part or portion" for a component used in the specification performs at least one function or operation. And, the "module" or "unit, part or portion" may perform a function or operation by hardware, software, or a combination of hardware and software. In addition, a plurality of "modules" or a plurality of "units, parts or portions" except for "modules" or "units, parts or portions" that should be performed in a specific hardware or is performed by at least one processor may be integrated into at least one module. Singular expressions used herein include plural expressions unless they have definitely opposite meanings in the context.

In addition, in the description of the present disclosure, when it is determined that specific description about the related known technique may unnecessarily obscure the gist of the present disclosure, a detailed description thereof is abbreviated or omitted.

Figure 11:
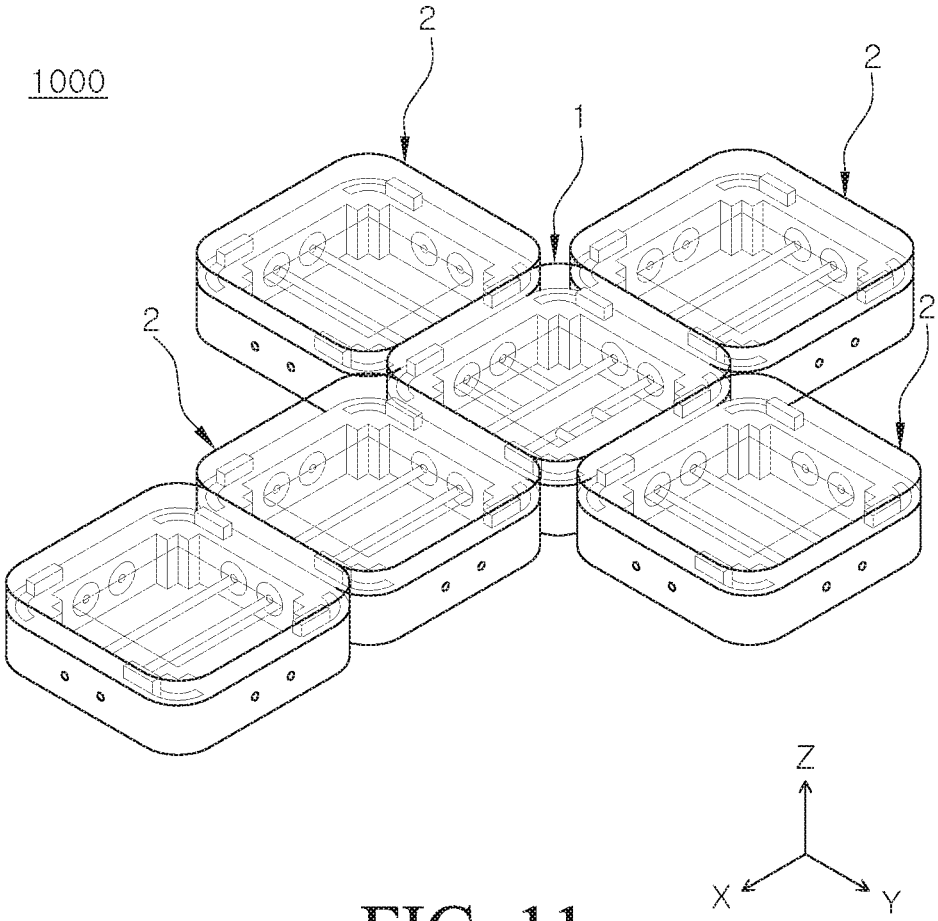
FIG. 11 is a perspective view of the fluidic flow system in which the modular fluidic chips are connected in horizontal directions according to an embodiment of the present disclosure.

Referring to FIGS. 1 and 11, a modular fluidic chip (hereinafter, referred to as 'modular fluidic chip 1') according to an embodiment of the present disclosure is formed in the form of a module capable of performing one function, and is connected to other modular fluidic chips 2 to implement a fluidic flow system 1000 of various structures.

The fluidic flow system 1000 implemented through the modular fluidic chip 1 may perform, from fluid such as liquid samples including body fluid, blood, saliva, and a skin cell, analysis/detection processes such as sample collection, sample shredding, extraction of substances such as genes or proteins from collected samples, filtering, mixing, storage, valve, amplification using a polymerase chain reaction including RT-PCR and the like, an antigen-antibody reaction, affinity chromatography and electrical sensing, electrochemical sensing, capacitor type electrical sensing, and optical sensing with or without a fluorescent material. However, the fluidic flow system 1000 implemented through the modular fluidic chip 1 is not necessarily limited to having functions described above, and may perform various functions for fluid analysis and diagnosis. For example, in the embodiment, the modular fluidic chips 1 and 2 are illustrated to perform a function for movement of fluid, but the fluidic flow system 1000 may be configured to allow a series of processings, for example, processes in which after fluid is introduced therein and cells in the fluid are shredded and filtered, a gene is amplified and then, a fluorescent substance is attached to the amplified gene to be observed.

In addition, the fluidic flow system 1000 implemented through the modular fluidic chip 1 can implement a factory-on-a-chip technology through connection with another fluidic flow system 1000. Through this, fluid analysis and diagnosis on different fluids may be simultaneously performed in the respective fluidic flow systems 1000, and all experiments (for example, chemical reactions and material synthesis or the like) associated with fluid that may be performed using the fluidic flow systems 1000 may be performed simultaneously through a plurality of the fluidic flow systems 1000.

In addition, the modular fluidic chip 1 may be connected to the other modular fluidic chips 2 in horizontal directions (an X-axis direction and a Y-axis direction) to implement one fluidic flow system 1000.

More specifically, the modular fluidic chip 1 may be connected to the other modular fluidic chips 2 in the X-axis direction and Y-axis direction that indicate the horizontal directions in the drawings to thereby implement one fluidic flow system 1000 including a plurality of fluid flow and analysis sections. Accordingly, fluid can move freely in the X-axis direction and Y-axis direction. For example, the number of the other modular fluidic chips 2 that may be connected in the X-axis direction and Y-axis direction around the modular fluidic chip 1 may be 1 to 10,000.

The modular fluidic chip 1 according to various embodiments of the present disclosure will be described in more detail.

Figure 2:
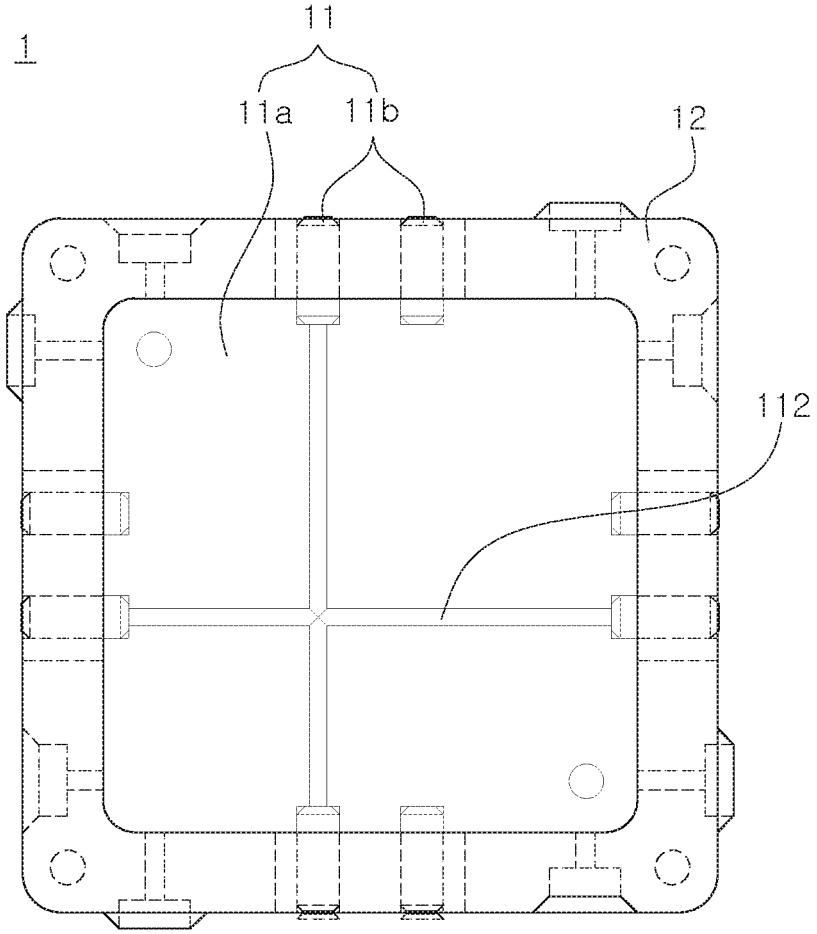
FIG. 2 is a plan view of the modular fluidic chip according to an embodiment of the present disclosure.

Referring to FIGS. 1 and 2, the modular fluidic chip 1 according to a first embodiment of the present disclosure includes a body 11.

The body 11 is formed in the form of a module capable of performing one function and is received in a housing 12 to be described later that is configured to surround the body 11. The body 11 may be selectively replaced in the housing 12 as necessary.

In addition, a flow channel 112 is formed in the body 11 to guide a flow of fluid.

The flow channel 112 may guide the flow of fluid in at least one direction of the X-axis direction and the Y-axis direction. However, the flow channel 12 is not limited thereto, and may be configured to guide the flow of fluid in various directions and perform one preset function on the fluid flowing. For example, the flow channel 112 may perform various functions such as fluid mixture or distribution, as well as guiding the flow of fluid.

In addition, the flow channel 112 may be formed in a shape corresponding to a flow channel 11*ba* (refer to FIG. 3) provided in a connection member 11*b* to be described later. Accordingly, the flow channel 112 may prevent a phenomenon in which a fluid flow is unstable or fluid pressure increases between a core member 11*a* to be described later and the connection member 11*b* during the flow of fluid. For example, the flow channel 112 may have a circular, or polygonal or oval shape in a cross-section thereof. However, the shape of the flow channel 112 is not limited thereto, and may be formed in various manners within a limit in which a width w is equal to or greater than 10 nm and is equal to or less than 1 Cm.

Here, the fact that the flow channel 112 and the flow channel 11*ba* provided in the connection member 11*b* have a shape and size corresponding each other and form fluid paths that are linear with respect to each other may allow for a predictable flow velocity when the fluid moves from one module to another module. In some conventional microfluidic flow devices, fluid transfers through a tube. In the case of a device using a tube, a difference in widths of channels occurs at portions where the tube and the device are connected to each other, or a space may be created in the channel, causing a vortex in fluid. This vortex not only causes a rapid change in flow velocity, but also may deform a droplet shape. Otherwise, it may give a physical impact to substances in the fluid or interrupt movement of the substances. Therefore, the fact that the flow channel 112 of the core member 11*a* and the flow channel 11*ba* of the connection member 11*b* have the same width and are arranged in a straight line may allow for a stable flow velocity of the fluid and a stable movement of the substances, in addition to a function of simply ensuring connection between modules.

Here, the flow channel 112 may be formed in various shapes such as a quantitative chamber, a gene extraction chamber, a waste chamber, a mixing chamber, a buffer chamber, a valve and the like to perform various functions.

Figure 14:
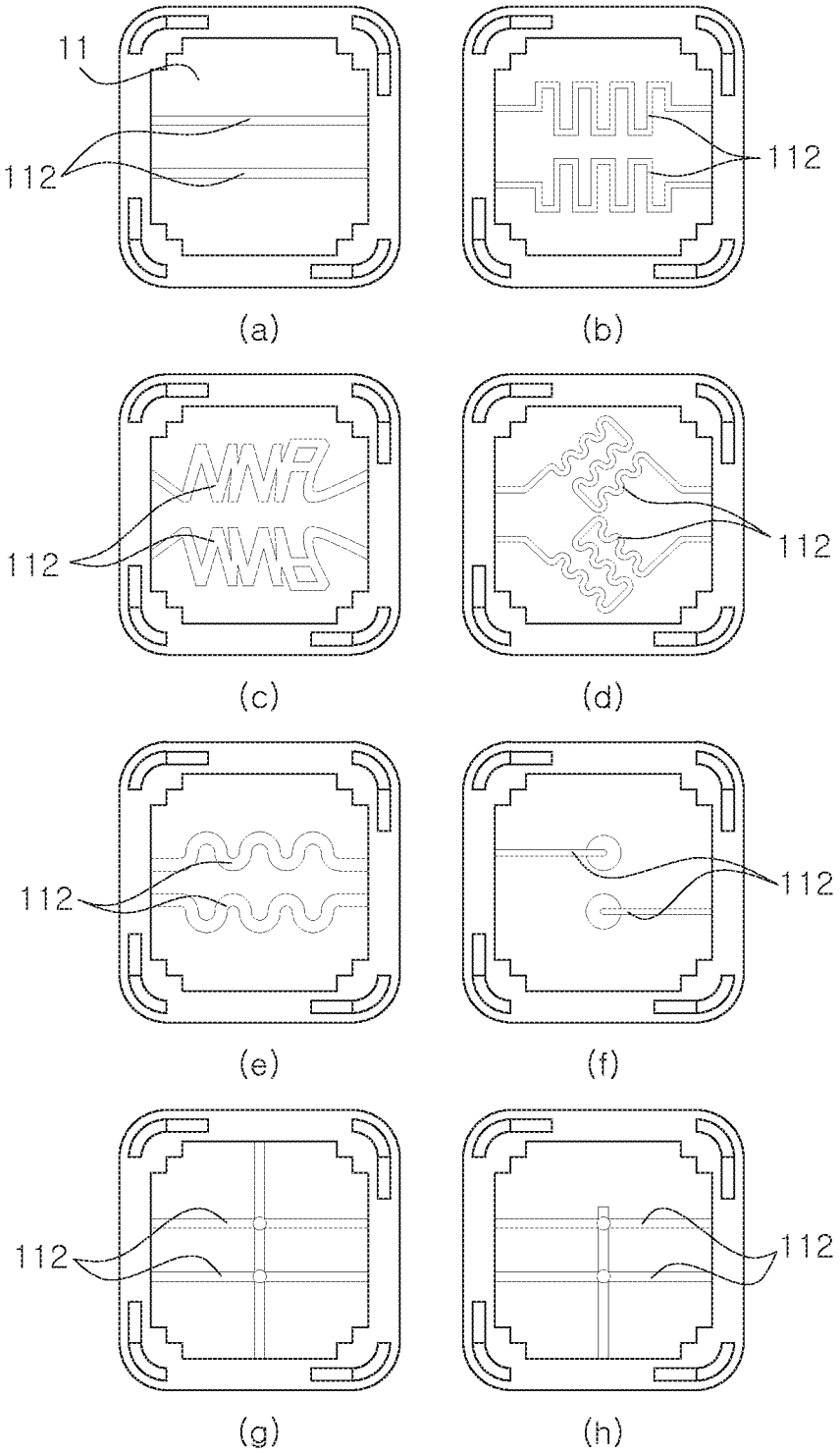
FIGS. 14 to 16 are views schematically illustrating various embodiments of channels formed in the body of the modular fluidic chip according to an embodiment of the present disclosure.
Figure 15:
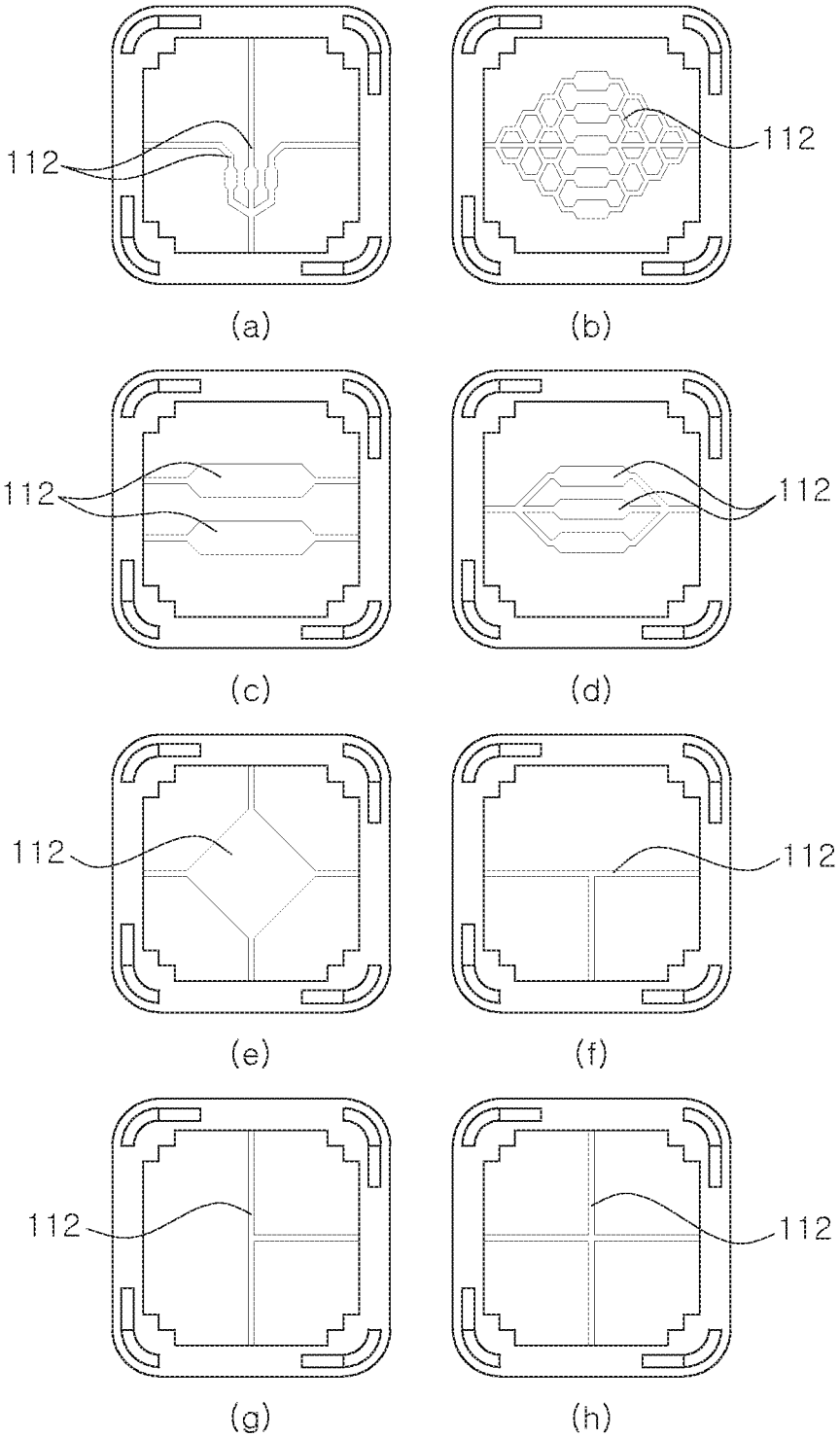
Figure 16:
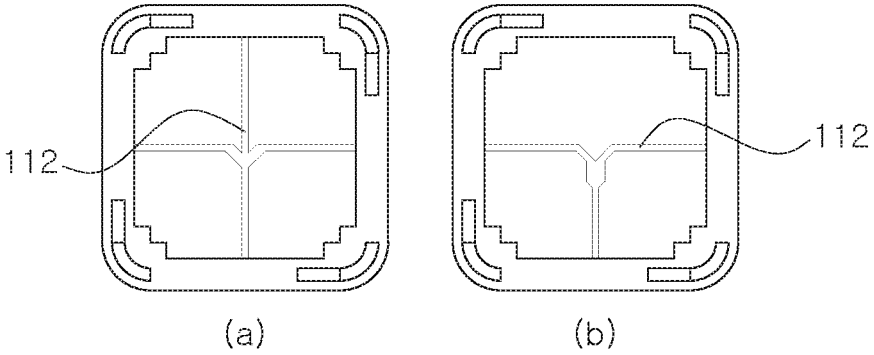

For example, referring to FIGS. 14 to 16, in an inside of the body 11, at least one flow channel among straight flow channels 112 (FIG. 14(*a*) and FIG. 14(*b*)), streamline flow channels 112 (FIG. 14(*c*), FIG. 14(*d*) and FIG. 14(*e*)), flow channels 112 having at least one well (FIG. 14(*f*), FIG. 14(*g*) and FIG. 14(*h*)), flow channels 112 having a valve (FIG. 15(*a*), FIG. 15(*b*), FIG. 15(*c*), FIG. 15(*d*) and FIG. 15(*e*)), flow channels 112 having at least one branch (FIG. 15(*f*) and FIG. 15(*g*)), cross-shaped flow channels 112 (FIG. 15(*h*) and FIG. 16(*a*)), a Y-shaped flow channel 112 (FIG. 16(*b*)), a fluid channel having a sensor (not shown), a fluid channel having an electrical output unit (not shown), and a fluid channel having an optical output unit (not shown) may be formed. However, the flow channel 112 is not necessarily limited thereto, and may be changed into various structures and shapes to thereby be applied. In addition, the flow channel 112 may be formed through a combination of the flow channels described above.

In addition, a coating layer may be further formed on the flow channel 112.

More specifically, a coating layer of a hydrophobic or hydrophilic material may be further formed on the flow channel 112. Here, a type of the coating layer described above may be selectively applied to the flow channel 112 according to a type of fluid, whereby fluid flow performance may be improved. However, the coating layer is not necessarily formed only on the flow channel 112 and may be further formed on various functional units such as a quantitative chamber, a gene extraction chamber, a waste chamber, a mixing chamber, a buffer chamber, a valve, and the like, if necessary.

Meanwhile, referring to FIG. 1, the other modular fluidic chip 2 connected to the modular fluidic chip 1 may include the body 11 capable of performing a function different from one function of the body 11 of the modular fluidic chip 1.

That is, different types of flow channels 112 may be formed in the body 11 of the modular fluidic chip 1 and the body 11 of the other modular fluidic chip 2.

Accordingly, a plurality of the modular fluidic chips 1 and 2 that are connected to each other to implement the fluidic flow system 1000 may perform different functions on fluid flowing therein. Here, each of the plurality of modular fluidic chips 1 and 2 connected to each other may be formed to perform only one function. For example, when one fluidic chip 1 has a Y-shaped flow channel 112 and performs a function for mixing, the other fluidic chip 2 connected thereto may include a type of the flow channel 112 different from that of the Y-shaped flow channel 112 described above and perform a function different from that of the fluidic chip 1.

Also, the body 11 is connected to the other modular fluidic chip 2 and allows at least one flow channel 112 thereof to be in communication with the flow channel 112 provided in the other modular fluidic chip 2.

Referring to FIGS. 1 and 2, the body 11 may include the core member 11*a* and at least one connection member 11*b* provided in the core member 11*a*.

The at least one flow channel 112 described above is formed in the core member 11*a*, and the core member 11*a* may be connected to the other modular fluidic chip 2 through the connection member 11*b* described above. Here, the core member 11*a* may be provided with a coupling groove which communicates with the flow channel 112 and into which a portion of the connection member 11*b* is inserted. Accordingly, the connection member 11*b* may communicate with the flow channel 112 provided in the core member 11*a* through the coupling groove. In addition, when the core member 11*a* is connected to the other modular fluidic chip 2 through the connection member 11*b*, the flow channel 112 provided in the core member 11*a* and the flow channel 11*ba* provided in the connection member 11*b* may be aligned with and communicate with the flow channel 112 provided in the other modular fluidic chip 2.

Also, the core member 11*a* may be formed in a shape corresponding to an inner surface of the housing 12 having a receiving space formed therein, and may be formed to have the same height as the housing 12. Preferably, when the core member 11*a* is coupled to the housing 12, it may be formed in a polyhedral structure so that it may be accurately disposed at a set position.

Further, the core member 11*a* may be manufactured using techniques such as MEMS, 3D printing, injection molding, CNC machining, imprinting, and polymer casting. Here, the core member 11*a* may be formed to have transparency as a whole or a part in such a manner that a flow of fluid flowing in an interior from an exterior of the core member 11*a* can be visually confirmed. For example, the core member 11*a* may be formed of at least one of an amorphous material such as glass, wood, a polymer resin, a metal, and an elastomer, or may be formed through a combination thereof.

The connection member 11*b* may be provided in the core member 11*a* and may be formed in a structure capable of being coupled with the other modular fluidic chip 2.

The connection member 11*b* is connected to the connection member 11*b* provided in the other modular fluidic chip 2, so that the at least one flow channel 112 provided in the modular fluidic chip 1 may communicate with the flow channel 112 provided in the other modular fluidic chip 2.

The connection member 11*b* is formed in a tube shape having the flow channel 11*ba* therein, and may be detachably installed on an outer surface of the core member 11*a* to be described later. Here, the coupling groove which communicates with the flow channel 112 provided in the core member 11*a* and into which a portion of the connection member 11*b* is inserted may be formed in the outer surface of the core member 11*a*. Accordingly, when the connection member 11*b* is inserted into the coupling groove, the flow channel 11*ba* provided in the connection member 11*b* may be aligned with the flow channel 112 provided in the core member 11*a* to communicate therewith. For example, the coupling groove may be formed in a shape corresponding to an outer surface of the connection member 11*b*.

In addition, the connection member 11*b* may be received in and supported by the housing 12 to be described later. Here, the housing 12 may have a receiving groove corresponding to the outer surface of the connection member 11*b* and supporting the outer surface of the connection member 11*b*.

In addition, the connection member 11*b* may be configured to form interfaces at contact portions when contacting the core member 11*a* and another connection member 11*b*.

More specifically, the connection member 11*b* may be formed of an elastic material capable of elastic deformation and form an interface at contact portions when contacting the core member 11*a* and the other connection member 11*b*. Here, an adhesive layer may be provided on one surface and the other surface of the connection member 11*b*.

Therefore, one side of the connection member 11*b* is in close contact with the core member 11*a* to form an interface, and the other side of the connection member 11*b* is in close contact with the connection member 11*b* provided in the other modular fluidic chip 2 to form an interface, thereby completely blocking leakage of fluid.

For example, the connection member 11*b* may be formed of an elastomer material. More specifically, the connection member 11*b* may be formed of at least one of a polymer resin, an amorphous material, and a metal, and may include at least one of chlorinated polyethylene, ethylene propylene dimethyl, silicone rubber, acrylic resin, amide resin, epoxy resin, phenol resin, polyester resin, polyethylene resin, ethylene-propylene rubber, polyvinyl butyral resin, polyurethane resin, and nitrile-butadiene rubber. However, the connection member 11*b* is not limited thereto, and may be changed into various shapes or various materials to thereby be applied within conditions capable of performing the same function.

In addition, the connection member 11*b* may be provided integrally with the core member 11*a*, or may be coupled to and separable from the core member 11*a*.

That is, the connection member 11*b* may be integrally provided on the outer surface of the core member 11*a* through double injection molding, or may be manufactured separately from the core member 11*a* and coupled to the core member 11*a*. Here, when the connection member 11*b* is integrally provided with the core member 11*a*, the connection member 11*b* may form an interface only on one side thereof.

In addition, the connection member 11*b* may directly connect the modular fluidic chip 1 and the other modular fluidic chip 2.

More specifically, the connection member 11*b* coupled to the core member 11*a* of the modular fluidic chip 1 does not pass through the connection member 11*b* provided in the other modular fluidic chip 2 and may be directly coupled to the core member 11*a* of the other modular fluidic chip 2.

Therefore, one side of the connection member 11*b* is in close contact with the core member 11*a* of the modular fluidic chip 1 to form an interface, and the other side of the connection member 11*b* is in close contact with the core member 11*a* of the other modular fluidic chip 2 to form an interface, thereby minimizing leakage points of fluid.

In addition, the connection member 11*b* may be configured to limit movement in the X-axis direction and Y-axis direction when received in the housing 12.

More specifically, the connection member 11*b* may include a flange portion (not shown) that protrudes radially from an outer surface thereof and is supported on an inner surface of the housing 12. Here, the housing 12 may be provided with a flange receiving groove (not shown) that receives and supports the flange portion to thereby limit movement of the connection member 11*b*.

Accordingly, even when the modular fluidic chip 1 is separated from the other modular fluidic chip 2, the flange portion may be supported on the inner surface of the housing 12 to thereby fix the connection member 11*b* in a determined position.

In addition, the connection member 11*b* may be formed in a structure capable of minimizing deformation in an axial direction when coupled with the connection member 11*b* provided in the other modular fluidic chip 2.

More specifically, the connection member 11*b* may include a plurality of bodies formed of different materials.

For example, the plurality of bodies having different materials may include a first body (not shown) having a hollow tube shape so as to communicate with the flow channel 112 provided in the core member 11*a* and a second body (not shown) installed on an outer surface of the first body and formed of a material having a higher hardness than the first body.

Therefore, even when the modular fluidic chip 1 and the other modular fluidic chip 2 are coupled to each other to thereby apply a load to the connection member 11*b* in the axial direction, deformation of the first body may be minimized through the second body. Through this, deformation of the flow channel provided in the connection member 11*b* may be minimized, so that fluid stably passes through the flow channel.

In addition, inclined surfaces may be formed at both ends of the connection members 11*b*.

Accordingly, when the connection member 11*b* is inserted into the coupling groove of the core member 11*a*, it is feasible to prevent an edge of the end of the connection member 11*b*, which is provided with the inclined surface, from contacting an inner surface of the core member 11*a*. Accordingly, insertion of the connection member 11*b* may be easily performed.

In addition, as a predetermined clearance space is formed in the coupling groove of the core member 11*a* through the above-described inclined surface, even when a load is applied to the connection member 11*b* from the other modular fluidic chip 2, the connection member 11*b* is compressed in a state in which it is received in the coupling groove so as to fill the clearance space, so that the modular fluidic chip 1 and the other modular fluidic chip 2 can be completely in close contact with each other.

In addition, the connection member 11*b* may automatically open and close the flow channel 11*ba* provided in an inside thereof according to whether the modular fluidic chip 1 and the other modular fluidic chip 2 are coupled to each other or not.

Figure 3:
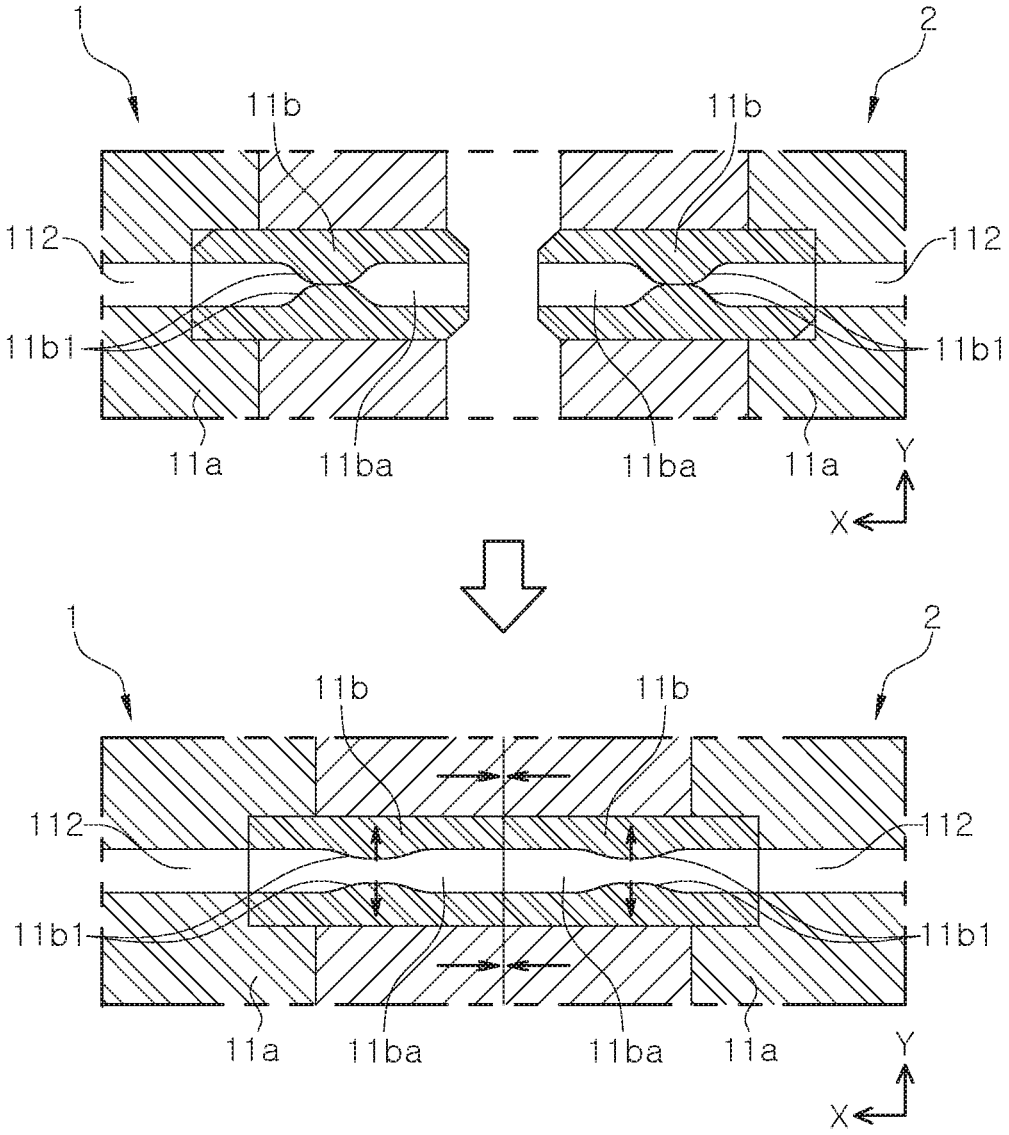
FIG. 3 is a view schematically illustrating a process of opening and closing connection members of the modular fluidic chips according to an embodiment of the present disclosure.

Referring to FIGS. 1 and 3, when the connection member 11*b* is coupled with the connection member 11*b* of the other modular fluidic chip 2, the flow channel 11*ba* provided in the inside may be opened, and on the contrary, when the connection member 11*b* is separated from the connection member 11*b* of the other modular fluidic chip 2, the flow channel 11*ba* may be closed.

That is, the connection member 11*b* is formed of an elastic material. Thus, when the connection member 11*b* is subjected to pressure in the axial direction (X-axis direction) through the other modular fluidic chip 2 coupled to one side thereof, the connection member 11*b* is compressed in the axial direction and at the same time, is expanded in a direction (Y-axis direction) perpendicular to the axial direction to thereby open the flow channel 11*ba* provided in the inside thereof. On the contrary, when the pressure applied from the other modular fluidic chip 2 is released, the connection member 11*b* is restored by elastic force to thereby close the flow channel 11*ba* provided in the inside thereof.

Here, opening and closing portions 11*b*1 for opening and closing the flow channel 11*ba* may be provided on the inside of the connection member 11*b*.

The opening and closing portions 11*b*1 may protrude from an inner surface of the connection member 11*b* by a predetermined length and may be in contact with or spaced apart from each other according to deformation of the connection member 11*b*.

Meanwhile, although not shown in the drawings, an opening and closing portion (not shown) capable of opening and closing any one of the at least one flow channel 112 provided in the core member 11*a* and the flow channel 11*ba* provided in the connection member 11*b* may be further included.

For example, the opening and closing portion may have a known valve structure and is installed in at least one of the core member 11*a*, the connection member 11*b*, and the housing 12 to be described later to thereby selectively open and close the above-described flow channels 112 and 11*ba*. Thus, a fluid flow may be controlled.

That is, the modular fluidic chip 1 may be configured to open and close the flow channel 112 or 11*ba* by including a separate opening and closing portion, as well as opening and closing the flow channel 11*ba* through the connection member 11*b* formed of an elastic body.

In addition, the modular fluidic chip 1 according to the first embodiment of the present disclosure may further include the housing 12.

Referring to FIGS. 1 and 2, the housing 12 is formed in a frame structure having a receiving space formed therein, and is configured to receive the body 11 therein. In addition, when the housing 12 is connected to the other modular fluidic chip 2, the housing 12 is configured to communicate the body 11 received therein with the body 11 provided in the other modular fluidic chip 2.

In addition, the housing 12 may be composed of a plurality of parts that may be divided and assembled.

For example, the housing 12 may be composed of a lower part configured to support a lower surface of the body 11 and an upper part configured to be coupled to the lower part and support an outer surface of the body 11 exposed to the outside of the lower part. Here, a seating groove in which the core member 11*a* can be seated may be formed in the lower part, and a through hole that exposes an upper surface of the core member 11*a* to an external space may be formed in the upper part.

In addition, the plurality of parts constituting the housing 12 may be coupled to each other using magnetism.

For example, magnetic bodies capable of being coupled to each other may be provided on an upper surface of the lower part and a lower surface of the upper part corresponding thereto. However, the plurality of parts are not necessarily combined using magnetism, and may be combined with each other through various combining methods.

In addition, the modular fluidic chip 1 according to the first embodiment of the present disclosure may further include a coupling portion.

Although not specifically shown in the drawings, referring to FIGS. 1 and 2, the coupling portion is provided in the housing 12 and may be formed in a structure capable of connecting the modular fluidic chip 1 to the other modular fluidic chips 2 in various directions and at various angles.

For example, the coupling portion may include at least one protrusion protruding from the outer surface of the housing 12 and at least one receiving groove provided in the outer surface of the housing 12. The protrusion and the receiving groove are formed in a shape in which they correspond to each other, and may be alternately arranged along a circumference of the housing 12. In addition, an inclined surface for guiding the protrusion and the receiving groove provided in the other modular fluidic chip to a predetermined position may be formed on the protrusion and the receiving groove. Accordingly, when the modular fluidic chip 1 is combined with the other modular fluidic chip 2, the modular fluidic chip 1 and the other modular fluidic chip 2 may be automatically aligned with each other.

In addition, the coupling portion may connect the modular fluidic chip 1 to the other modular fluidic chip 2 by using magnetism.

For example, the coupling portion may further include a plurality of magnetic members (not shown) installed in the housing 12. The plurality of magnetic members may be formed of a magnetic material having an S-pole on one side thereof and an N-pole on the other side thereof, and may be installed at any one of an inside and an outside of the housing 12. Accordingly, the modular fluidic chip 1 and the other modular fluidic chip 2 may be kept in close contact with each other through the above-described magnetic members provided inside.

In addition, the coupling portion may further include a blocking member (not shown) disposed on one side of the magnetic member to block magnetism of the magnetic member.

For example, the blocking member 124 may be formed of a conductive material or a magnetic material, and may affect the magnetism of the magnetic member acting toward the flow channel 112 to thereby reduce the magnetism or block the magnetism. Accordingly, it is feasible to prevent the occurrence of abnormality in the flow of fluid or the occurrence of abnormality in a function of the modular fluidic chip 1, due to the magnetism.

In addition, the coupling portion may further include tightening portions (not shown) that are installed in the housing 12 of the modular fluidic chip 1 and the housing 12 of the other modular fluidic chip 2, respectively, and are coupled to each other through a separate tool to thereby allow the modular fluidic chip 1 and the other modular fluidic chip 2 to be in close contact with each other.

For example, the tightening portion may include a rod-shaped shaft portion which is installed in the modular fluidic chip 1, and a cam portion which is installed in the other modular fluidic chip 2 to receive an end of the shaft portion therein and presses the end of the shaft portion received therein while rotating in a circumferential direction when an external force is applied by a tool to thereby linearly move the shaft portion.

Hereinafter, the modular fluidic chip 1 according to a second embodiment of the present disclosure will be described.

For reference, for respective components for describing the modular fluidic chip 1 according to the second embodiment of the present disclosure, the same reference numerals as those used in describing the modular fluidic chip 1 according to the first embodiment of the present disclosure will be used for convenience of description. The same or redundant descriptions will be omitted.

Figure 4:
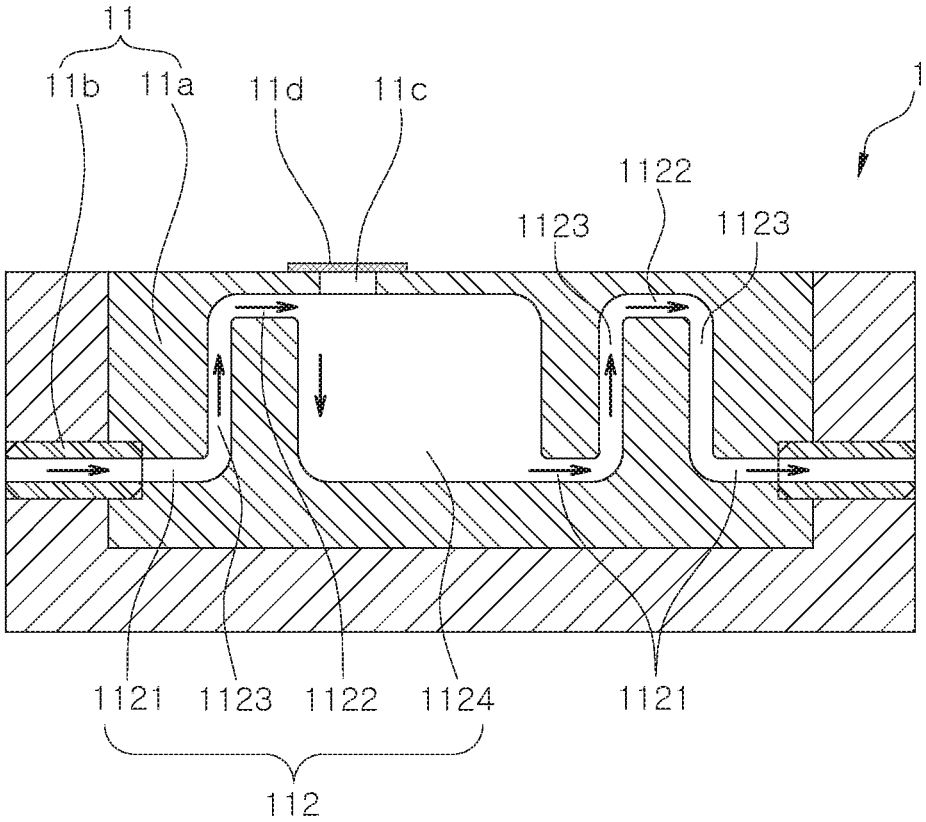
FIGS. 4 to 8 are views schematically illustrating a flow channel of the modular fluidic chip according to an embodiment of the present disclosure.

Referring to FIGS. 1 and 4, the modular fluidic chip 1 according to the second embodiment of the present disclosure includes the body 11.

The body 11 is formed in the form of a module capable of performing one function and is received in a housing 12 to be described later that is configured to surround the body 11. The body 11 may be selectively replaced in the housing 12 as necessary.

In addition, at least one flow channel 112 is formed in the body 11 to guide a flow of fluid.

The at least one flow channel 112 may be configured to perform one preset function on the flowing fluid, as well as guiding the flow of fluid in various directions.

Figure 5:
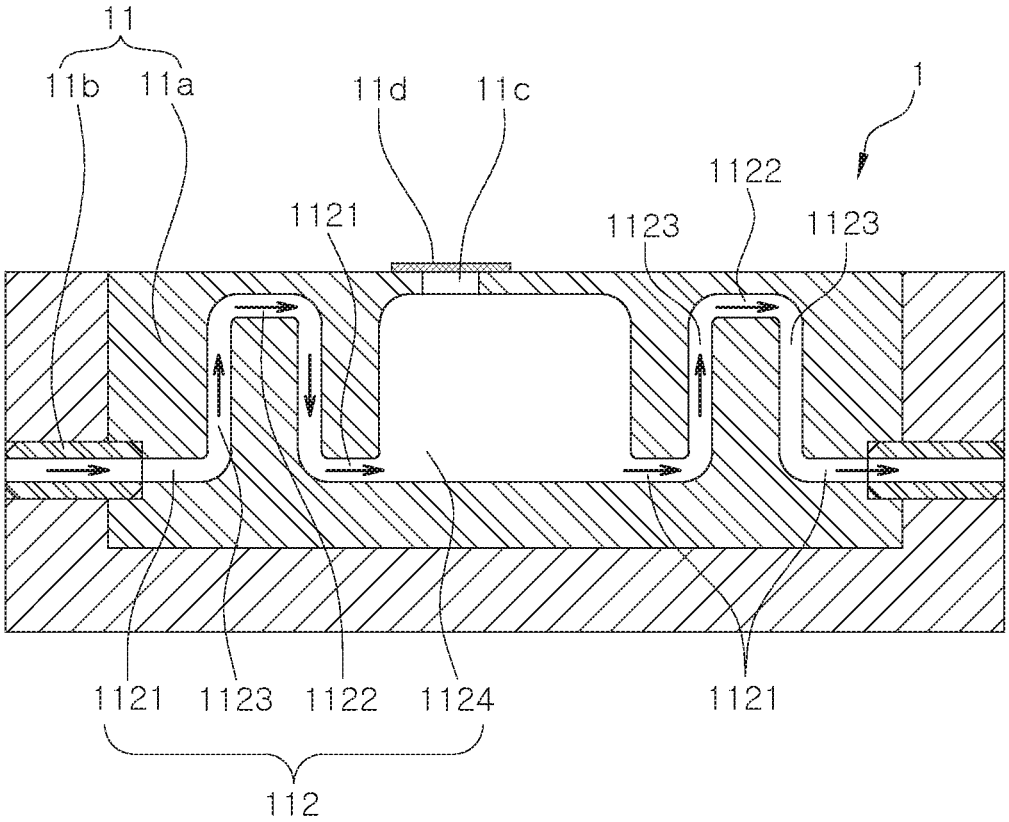

Referring to FIGS. 4 and 5, the at least one flow channel 112 includes a first flow channel 1121 and a second flow channel 1122 that have different heights.

The first flow channel 1121 may be formed at a position relatively lower than that of the second flow channel 1122. In addition, the first flow channel 1121 and the second flow channel 1122 disposed at different heights may guide fluid flowing in a horizontal direction.

Also, the at least one flow channel 112 may further include a third flow channel 1123, a chamber 1124, and a fourth flow channel 1125.

Figure 6:
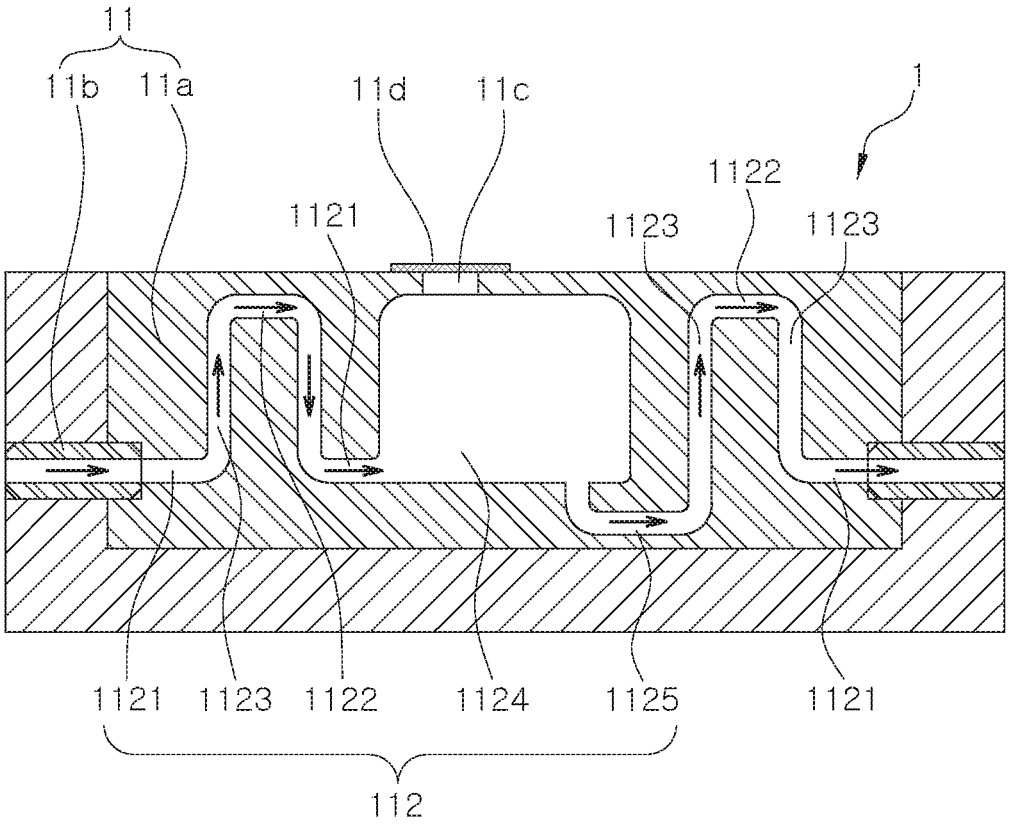

Referring to FIGS. 4 and 6, the third flow channel 1123 may guide the flow of fluid in a vertical direction by connecting the first flow channel 1121 and the second flow channel 1122 that are disposed at different heights to each other.

The chamber 1124 is formed in any one section inside the body 11 and is connected to at least one of the first flow channel 1121, the second flow channel 1122, the third flow channel 1123, and the fourth flow channel 1124 to be described later. The chamber 1124 stores and stabilizes the fluid transmitted from one side thereof, therein and then, may discharge the fluid to the outside thereof.

The fourth flow channel 1125 is formed at a position relatively lower than that of the chamber 1124 or the first flow channel 1121 and is connected to at least one of the first flow channel 1121, the second flow channel 1122, the third flow channel 1123, and the chamber 1124. The fourth flow channel 1125 may guide the fluid transferred through the connected flow channel in a horizontal direction.

In addition, the at least one flow channel 112 may form various fluid movement paths in the rear of the chamber 1124.

More specifically, in the rear of the chamber 1124, various fluid movement paths along which fluid discharged from the chamber 1124 passes through at least any one of the first flow channel 1121, the second flow channel 1122, the third flow channel 1123, and the fourth flow channel 1125 may be formed.

Figure 7:
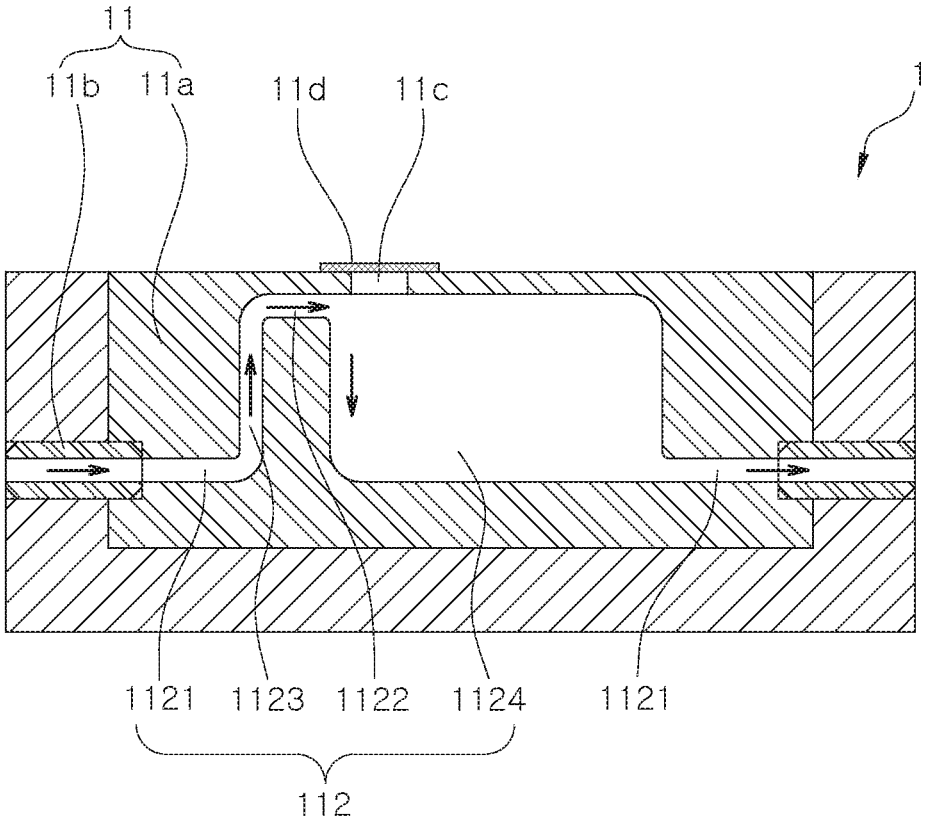
Figure 8:
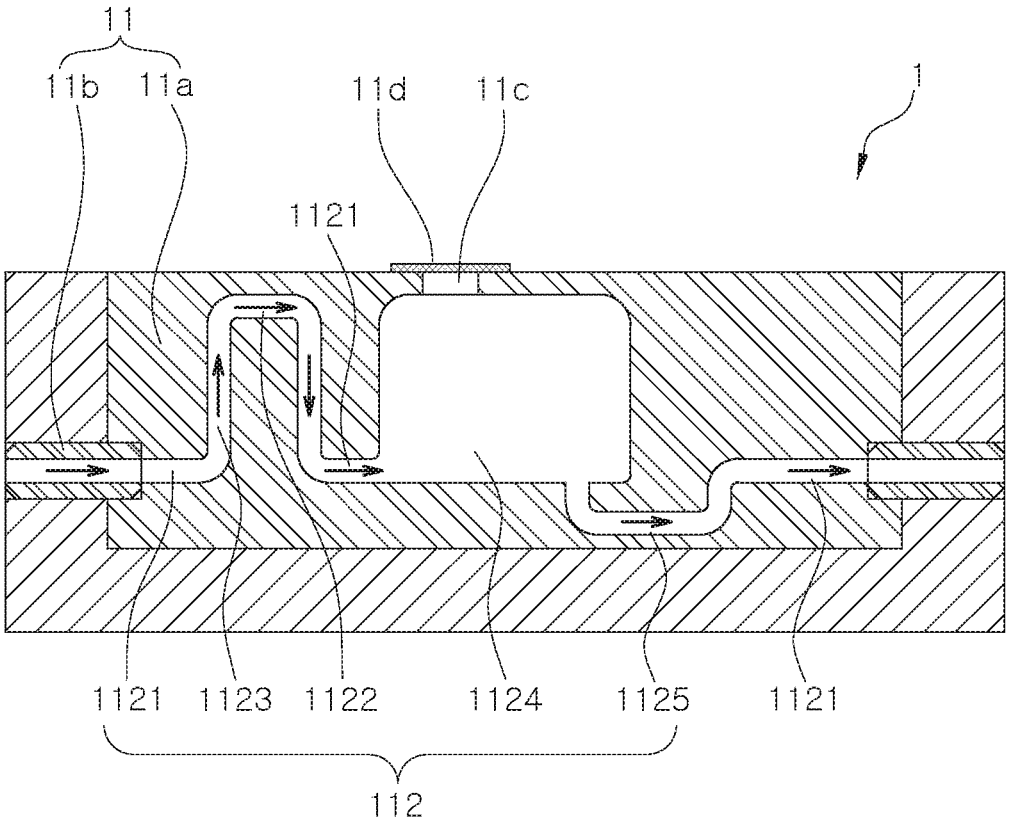

For example, in the rear of the chamber 1124, a first fluid movement path along which the fluid discharged from the chamber 1124 can sequentially pass through the first flow channel 1121, the second flow channel 1122, and the first flow channel 1121 may be formed, as shown in FIGS. 4 and 5. Alternatively, a second fluid movement path along which the fluid discharged from the chamber 1124 passes through only the first flow channel 1121 may be formed, as shown in FIG. 7. Further, in the rear of the chamber 1124, a third fluid movement path along which the fluid discharged from the chamber 1124 can sequentially pass through the fourth flow channel 1125, the second flow channel 1122, and the first flow channel 1121 may be formed, as shown in FIG. 6. Alternatively, a fourth fluid movement path along which the fluid discharged from the chamber 1124 can sequentially pass through the fourth flow channel 1125 and the first flow channel 1121 may be formed, as shown in FIG. 8. However, the fluid movement paths are not necessarily limited thereto, and may be changed into various structures to thereby be applied.

Meanwhile, the body 11 may be provided with an air flow hole 11*c* so as to remove air remaining in the flow channel when the fluid passes through the flow channel.

Referring to FIGS. 4 to 8, the air flow hole 11*c* allows the at least one flow channel 112 and an external space to be in communication with each other. Through this, the air flow hole 11*c* discharges the air remaining in the flow channel to the external space when the fluid passes through the flow channel, thereby enabling the flow of the flow channel.

In this case, the body 11 may include an opening and closing member 11*d* for opening and closing the air flow hole 11*c*.

Referring to FIGS. 4 to 8, the opening and closing member 11*d* may be configured to be attached to the body 11 and open and close the air flow hole 11*c*.

Here, the opening and closing member 11*d* may be configured to remove bubbles from the fluid flowing through the at least one flow channel 112.

Specifically, the opening and closing member 11*d* may be formed of a hydrophobic material through which a hydrophilic fluid cannot pass and only gas passes, or may be formed in the form of a fibrous structure coated with a hydrophobic material on a surface thereof. Here, the fibrous structure may be formed of a nonwoven fabric, glass fiber, or sponge.

For example, the opening and closing member 11*d* formed of a hydrophobic material may be formed of one or more hydrophobic materials selected from a group consisting of polytetrafluro ethylene (PTFE), polyethylene terephtalate (PET), and polyvinyl chloride.

In addition, the opening and closing member 11*d* may be formed of a hydrophilic material through which a hydrophobic fluid cannot pass and only gas passes, or may be formed in the form of a fibrous structure coated with a hydrophilic material on a surface thereof.

Also, the opening and closing member 11*d* may include both a hydrophobic material and a hydrophilic material so as to remove bubbles from a mixed fluid in which a hydrophilic fluid and a hydrophobic fluid are mixed.

For example, the opening and closing member 11*d* may be formed in a stacked form in which a hydrophobic material is provided on one surface thereof and a hydrophilic material is provided on the other surface thereof. However, the opening and closing member 11*d* is not limited thereto, and may be changed into various forms to thereby be applied within conditions capable of performing the same function.

Referring to FIGS. 1 and 4, the body 11 may include the core member 11*a* and the at least one connection member 11*b* provided on the core member 11*a*.

The at least one flow channel 112 described above may be formed in an inside of the core member 11*a*, and the core member 11*a* may be connected to the other modular fluidic chip 2 through the connection member 11*b* described above.

In addition, the core member 11*a* may be integrally formed through 3D printing processing, or may be formed in the form of a plurality of modules that may be combined with and separated from each other through injection molding processing. However, the core member 11*a* is not necessarily limited thereto, and may be manufactured using various techniques such as MEMS, CNC machining, imprinting, polymer casting, and the like.

In addition, the core member 11*a* may be formed to have transparency as a whole or a part in such a manner that a flow of fluid flowing in an interior from an exterior of the core member 11*a* can be visually confirmed.

The connection member 11*b* is provided in the core member 11*a* and is connected to the connection member 11*b* provided in the other modular fluidic chip 2, so that the at least one flow channel 112 may communicate with the flow channel 112 provided in the other modular fluidic chip 2.

The connection member 11*b* may be formed in a tube shape having the flow channel 11*ba* therein and may be provided integrally with the core member 11*a* or may be separable from an outer surface of the core member 11*a*.

In addition, the connection member 11*b* may be configured to form an interface at contact portions when contacting the core member 11*a* and another connection member 11*b*.

More specifically, the connection member 11*b* may be formed of an elastic material capable of elastic deformation and may form interfaces at contact portions when contacting the core member 11*a* and the other connection member 11*b*. Here, an adhesive layer may be provided on one surface and the other surface of the connection member 11*b*.

In addition, the modular fluidic chip 1 according to the second embodiment of the present disclosure may further include the housing 12.

Referring to FIGS. 1 and 4, the housing 12 is formed in a frame structure having a receiving space formed therein, and is configured to receive the body 11 therein. In addition, when the housing 12 is connected to the other modular fluidic chip 2, the housing 12 is configured to allow the body 11 received therein to communicate with the body 11 provided in the other modular fluidic chip 2.

In addition, the modular fluidic chip 1 according to the second embodiment of the present disclosure may further include a coupling portion.

Although not specifically shown in the drawings, referring to FIGS. 1 and 2, the coupling portion is provided in the housing 12 and may be formed in a structure capable of connecting the modular fluidic chip 1 to the other modular fluidic chips 2 in various directions and at various angles.

Hereinafter, the modular fluidic chip 1 according to a third embodiment of the present disclosure will be described.

For reference, for respective components for describing the modular fluidic chip 1 according to the third embodiment of the present disclosure, the same reference numerals as those used in describing the modular fluidic chip 1 according to the first and second embodiments of the present disclosure will be used for convenience of description. The same or redundant descriptions will be omitted.

Figure 9:
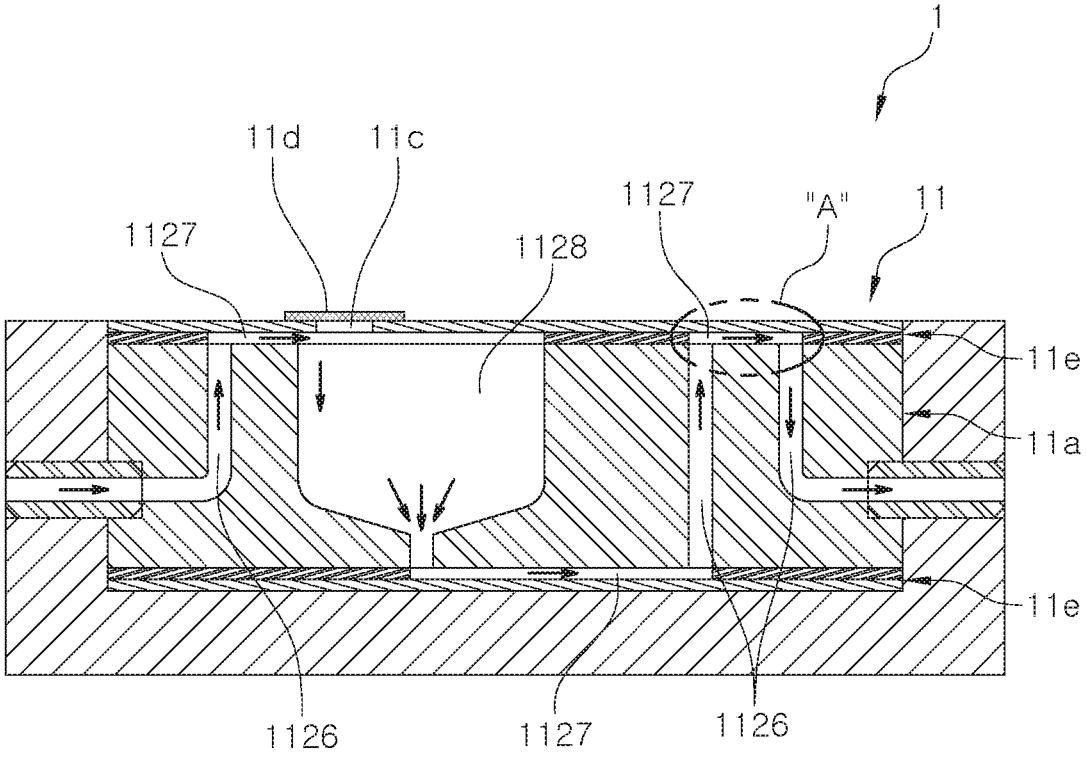
FIGS. 9 and 10 are views each schematically illustrating a modified embodiment of a body of the modular fluidic chip according to an embodiment of the present disclosure.

Referring to FIG. 9, the modular fluidic chip 1 according to the third embodiment of the present disclosure includes the body 11 having the at least one flow channel 112 formed in the inside thereof.

The body 11 includes the core member 11*a* and a film member 11*e*.

The core member 11*a* may be integrally formed through 3D printing processing, or may be formed in the form of a plurality of modules that may be combined with and separated from each other through injection molding processing.

In addition, the core member 11*a* may be formed to have transparency as a whole or a part in such a manner that a flow of fluid flowing in an interior from an exterior of the core member 11*a* can be visually confirmed. For example, the core member 11*a* may be formed of at least one of an amorphous material such as glass, wood, a polymer resin, a metal, and an elastomer, or may be formed through a combination thereof.

In addition, the core member 11*a* has the at least one flow channel 112 formed therein.

More specifically, the core member 11*a* includes a plurality of first guide flow channels 1126 that guide a flow of fluid in a vertical direction and at least one chamber 1128 where the fluid is stored.

Further, referring to FIGS. 1 and 3, the core member 11*a* may be connected to the other modular fluidic chip 2 through the connection member 11*b* provided on an outer surface thereof.

The connection member 11*b* is connected to the connection member 11*b* provided in the other modular fluidic chip 2, so that the at least one flow channel 112 provided in the modular fluidic chip 1 may communicate with the flow channel 112 provided in the other modular fluidic chip 2.

In addition, the connection member 11*b* may be configured to form interfaces at contact portions when contacting the core member 11*a* and the other connection member 11*b*.

More specifically, the connection member 11*b* may be formed of an elastic material capable of elastic deformation and may form interfaces at contact portions when contacting the core member 11*a* and the other connection member 11*b*. Here, an adhesive layer may be provided on one side and the other side of the connection member 11*b*.

In addition, the connection member 11*b* may be provided integrally with the core member 11*a*, or may be coupled to and separable from the core member 11*a*.

Referring to FIG. 9, the film member 11*e* may be attached to the outer surface of the core member 11*a* to form a flow channel.

More specifically, the film member 11*e* is attached to the outer surface of the core member 11*a* to allow the plurality of first guide flow channels 1126 to communicate with each other.

Figure 10:
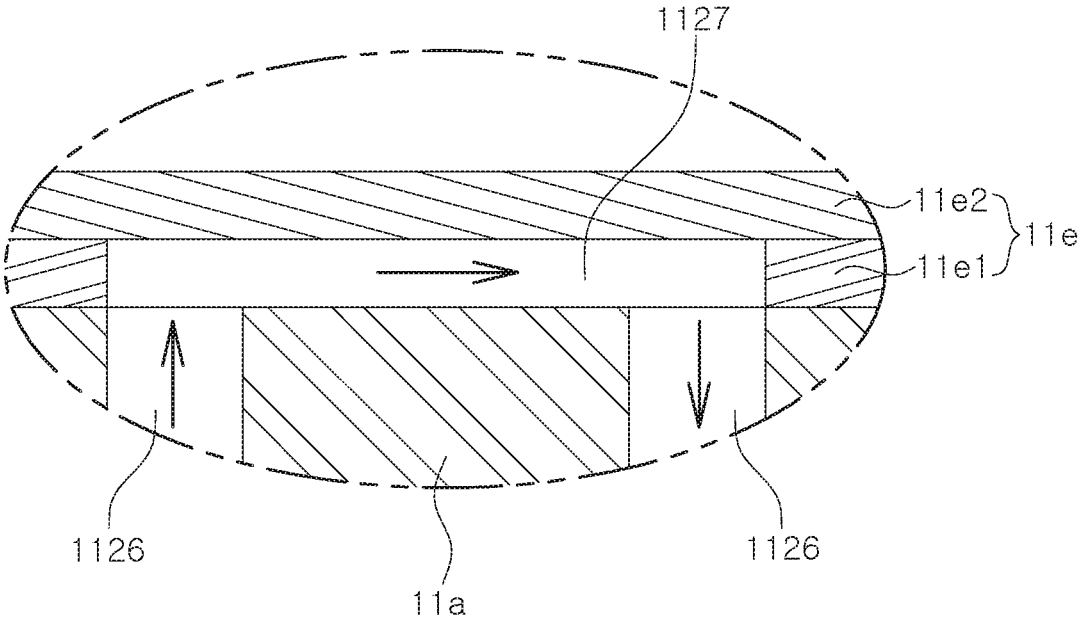

Referring to FIGS. 9 and 10, the film member 11*e* may include a first film layer 11*e*1 and a second film layer 11*e*2.

The first film layer 11*e*1 may be attached to the outer surfaces (upper and lower surfaces) of the core member 11*a*. In addition, at least one second guide flow channel 1127 may be formed in an inside of the first film layer 11*e*1, and the at least one second guide flow channel 112 is connected to the plurality of first guide flow channels 1126 provided in the core member 11*a* to guide the flow of fluid in a horizontal direction.

The second film layer 11*e*2 is attached to an outer surface of the first film layer 11*e*1 to block the second guide flow channel 1127 from being exposed to an external space. Here, the air flow hole 11*c* may be provided in the second film layer 11*e*2 so as to remove air remaining in the flow channel when the fluid passes through the flow channel.

For example, the first film layer 11*e*1 may be applied as a tape having an adhesive layer provided on upper and lower surfaces thereof, and the second film layer 11*e*2 may be applied as a transparent film so that the flow channel 112 of the core member 11*a* can be confirmed. However, the first film layer 11*e*1 and the second film layer 11*e*2 are not necessarily limited thereto, and may be changed into various materials to thereby be applied.

The air flow hole 11*c* allows the at least one flow channel 112 and an external space to communicates with each other. Through this, when the fluid passes through the flow channel, air remaining in the flow channel may be discharged to the external space, thereby enabling a flow of the flow channel.

In this case, the body 11 may include the opening and closing member 11*d* for opening and closing the air flow hole 11*c*.

The opening and closing member 11*d* may be configured to be attached to the body 11 and open and close the air flow hole 11*c*.

More specifically, the opening and closing member 11*d* may be formed of a hydrophobic material through which liquid cannot pass and only gas can pass in such a manner that only bubbles can be removed from the fluid flowing through the at least one flow channel 112.

In addition, the modular fluidic chip 1 according to the third embodiment of the present disclosure may further include the housing 12.

Referring to FIGS. 1 and 9, the housing 12 is formed in a frame structure having a receiving space formed therein, and is configured to receive the body 11 therein. In addition, when the housing 12 is connected to the other modular fluidic chip 2, the housing 12 is configured to allow the body 11 received therein to communicate with the body 11 provided in the other modular fluidic chip 2.

In addition, the modular fluidic chip 1 according to the second embodiment of the present disclosure may further include a coupling portion.

Although not specifically shown in the drawings, the coupling portion is provided in the housing 12 and may be formed in a structure capable of connecting the modular fluidic chip 1 to the other modular fluidic chips 2 in various directions and at various angles.

Hereinafter, the modular fluidic chip 1 according to a fourth embodiment of the present disclosure will be described.

For reference, for respective components for describing the modular fluidic chip 1 according to the fourth embodiment of the present disclosure, the same reference numerals as those used in describing the modular fluidic chip 1 according to the first embodiment of the present disclosure will be used for convenience of description. The same or redundant descriptions will be omitted.

Figure 12:
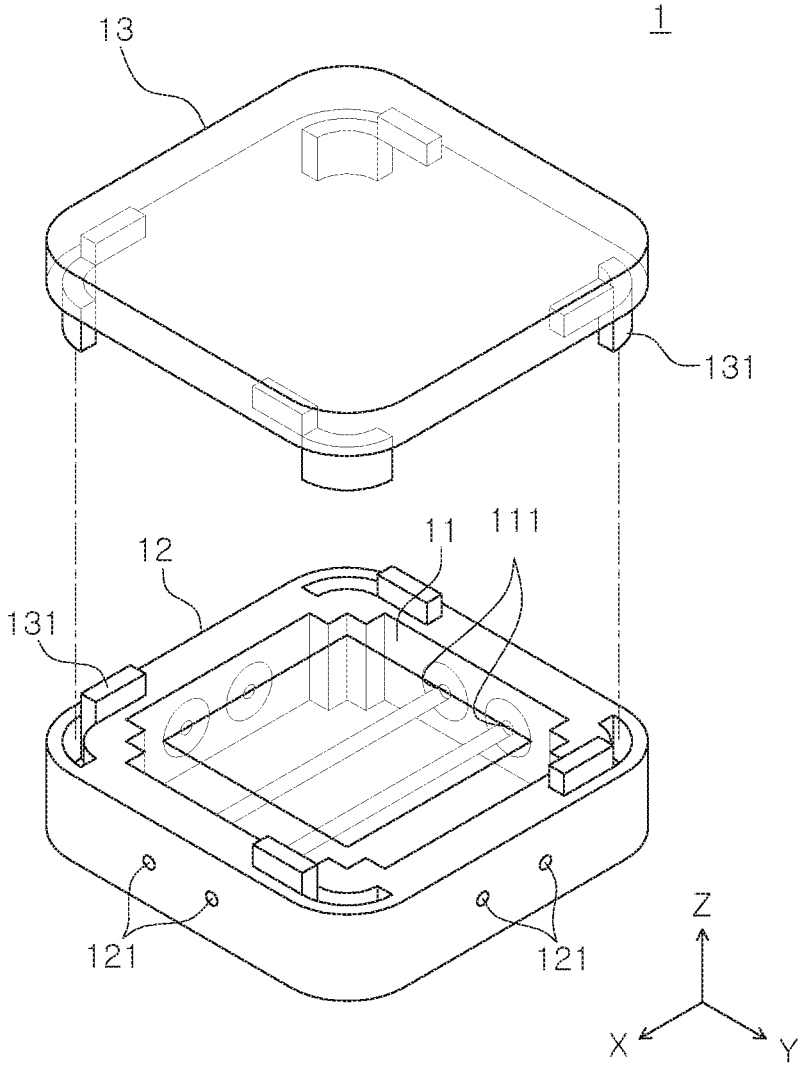
FIG. 12 is a perspective view illustrating a state in which a cover of the modular fluidic chip according to an embodiment of the present disclosure is separated.
Figure 13:
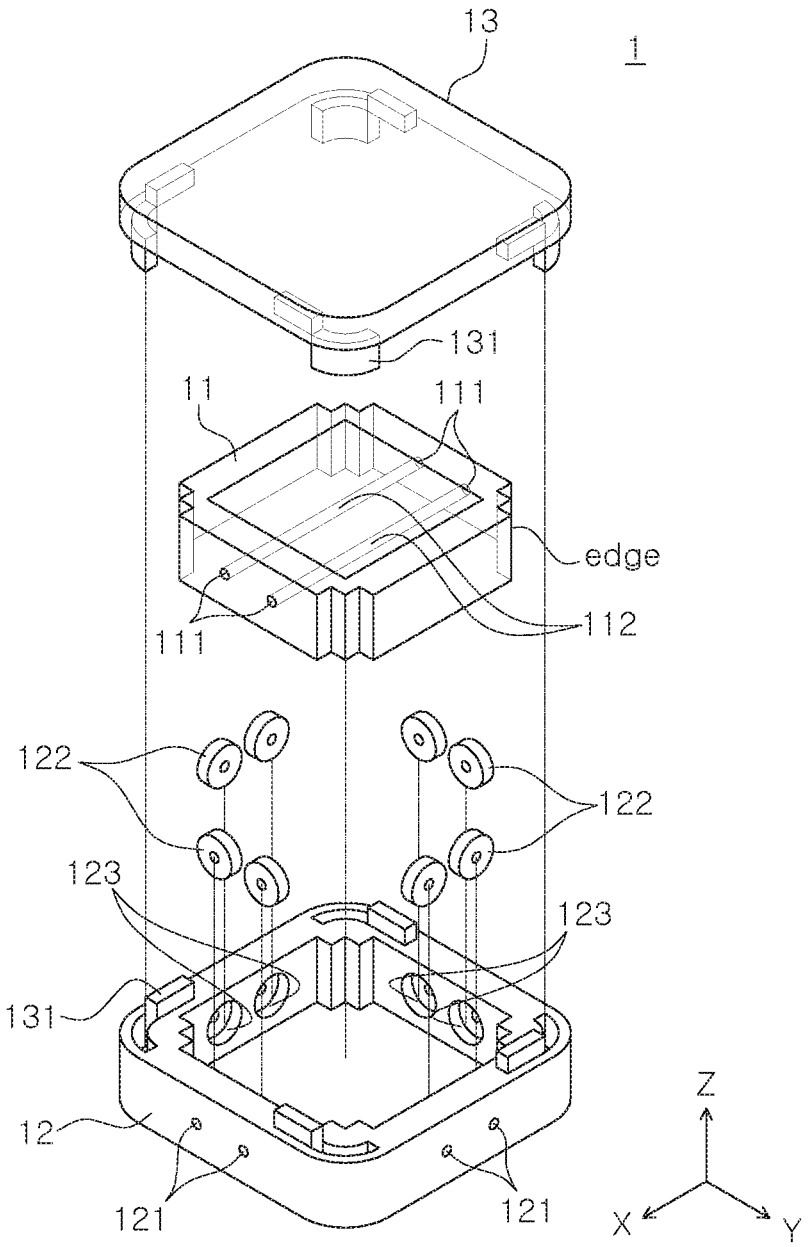
FIG. 13 is an exploded perspective view of FIG. 12.

Referring to FIGS. 12 and 13, the modular fluidic chip 1 according to the fourth embodiment of the present disclosure includes the body 11.

The body 11 is formed in the form of a module capable of performing one function and is received in the housing 12, and the body 11 may be selectively replaced in the housing 12 if necessary. In addition, the body 11 may be formed in a shape corresponding to an inner surface of the housing 12 in which a receiving space is formed, and may be formed to have the same height as the housing 12 based on a Z-axis direction in the drawings. The body 11 may be manufactured using techniques, for example, MEMS, 3D printing, injection molding, CNC machining, imprinting, polymer casting and the like.

In addition, when the body 11 is coupled to the housing 12, it may be accurately fixed to a set position and may be formed in a polyhedral structure in such a manner that it is in surface-contact with the inner surface of the housing 12.

In addition, the body 11 may be formed to have transparency as a whole or a part to have transparency in such a manner that a flow of fluid flowing in an interior from an exterior of the body 11 can be visually confirmed. For example, the body 11 may be formed of at least one of an amorphous material such as glass, wood, a polymer resin, a metal, and an elastomer, or may be formed through a combination thereof.

In addition, a portion of the body 11 may be formed of an elastomer material.

For example, a portion of the body 11 where fluid flows or contact with other components is made may be formed of an elastomer material. When the body 11 is partially formed of an elastomeric material, the body 11 may be manufactured through double injection molding or the like.

Figure 17:
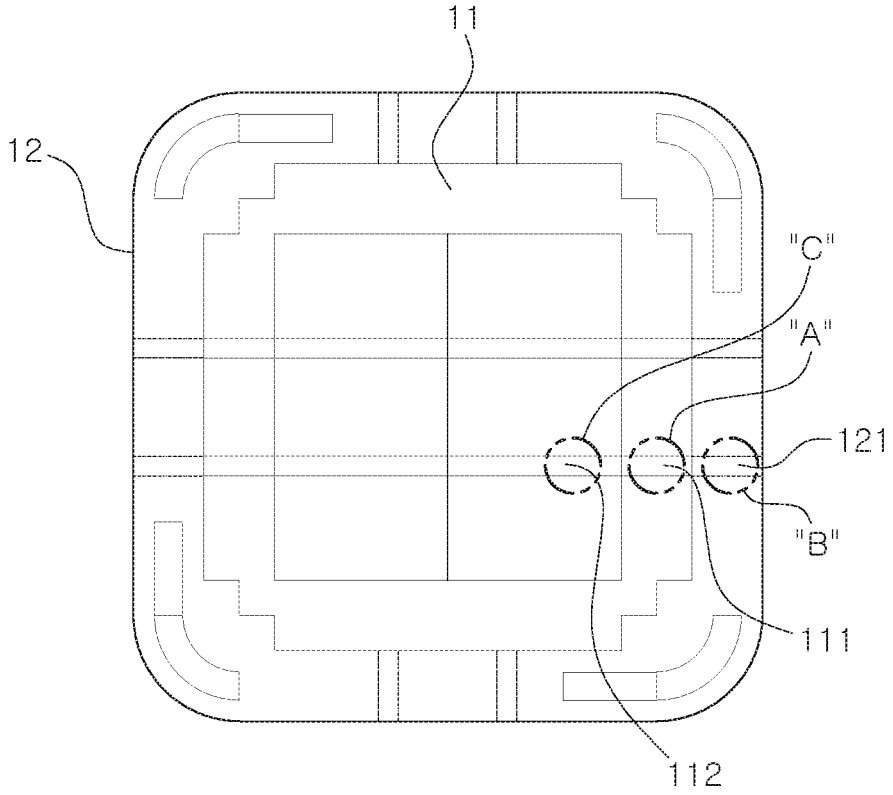
FIG. 17 is a plan view of the modular fluidic chip according to an embodiment of the present disclosure.

Referring to FIGS. 13 and 17, a first hole 111 is formed in the body 11 to guide a flow of fluid.

The first hole 111 communicates with a second hole 121 of the housing 12 to be described later and the fluid channel 112 to be described later that is formed in the inside of the body 11, to thereby guide the flow of fluid in at least one direction of the X-axis direction and the Y-axis direction. For example, the first hole 111 is formed in a predetermined section from the outer surface of the body 11 toward the inside of the body 11, but may be formed in a section having a size smaller than that of a section in which the fluid channel 112 is formed.

Figure 18:
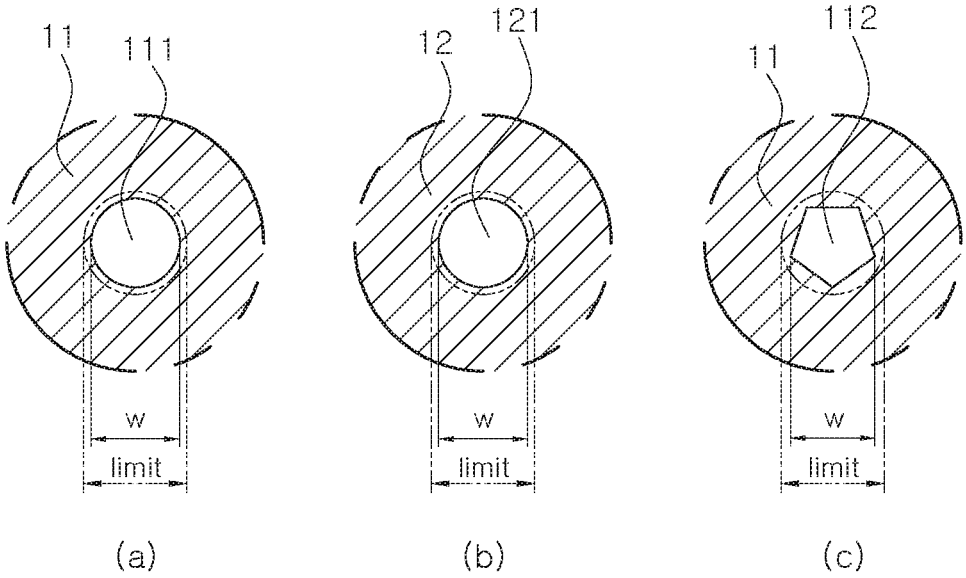
FIG. 18 is a view illustrating cross-sections of portions "A", "B" and "C" of FIG. 17.

In addition, the first hole 111 may be formed in a shape corresponding to the second hole 121 provided in the housing 12 and the fluid channel 112 provided in the body 11. Accordingly, the first hole 111 may prevent a phenomenon in which a fluid flow is unstable or fluid pressure increases between the housing 12 and the body 11 during the flow of fluid. For example, the first hole 111 may have a circular shape in a cross-section as shown in FIG. 18(*a*), or may have a polygonal or elliptical shape in the cross-section although not shown in the drawings. However, the shape of the first hole 111 is not limited thereto, and may be formed in various manners within a limit in which a width w is equal to or greater than 10 nm and is equal to or less than 1 Cm.

Here, the fact that the first hole 111 and the second hole 121 have a shape and size corresponding each other and form fluid paths that are linear with respect to each other may allow for a predictable flow velocity when the fluid moves from one module to another module. In some conventional microfluidic flow devices, fluid transfers through a tube. In the case of a device using a tube, a difference in widths of channels occurs at portions where the tube and the device are connected to each other, or a space may be created in the channel, causing a vortex in fluid. This vortex not only causes a rapid change in flow velocity, but also may deform a droplet shape. Otherwise, it may give a physical impact to substances in the fluid or interrupt movement of the substances. Therefore, the fact that the first hole 111 of the body 11 and the second hole 121 of the housing 12 have the same width and are arranged in a straight line may allow for a stable flow velocity of the fluid and stable movement of the substances, in addition to a function of simply ensuring connection between the modules. In addition, the housing 12 and the second hole 121 of the housing 12 can ensure stability of the fluid described above no matter what function or shape the module has in the module system of the present application.

In addition, the fluid channel 112 may be formed in the body 11.

Referring to FIGS. 13 and 17, the fluid channel 112 may communicate with at least one first hole 111 to thereby allow the flow of fluid. For example, referring to FIG. 18(*c*), the fluid channel 112 may have a polygonal shape in a cross-section, or may have a circular or elliptical shape in the cross-section although not shown in the drawings. However, the shape of the fluid channel 112 is not limited thereto, and may be formed in various manners within a limit in which a width w is equal to or greater than 10 nm and is equal to or less than 1 Cm.

In addition, the fluid channel 112 may be configured to perform one preset function on the flowing fluid, as well as guiding the flow of fluid in various directions.

For example, referring to FIGS. 14 to 16, in the inside of the body 11, at least one fluid channel among straight fluid channels 112 (FIG. 14(*a*) and FIG. 14(*b*)), streamline fluid channels 112 (FIG. 14(*c*), FIG. 14(*d*) and FIG. 14(*e*)), fluid channels 112 having at least one well (FIG. 14(*f*), FIG. 14(*g*) and FIG. 14(*h*)), fluid channels 112 having a valve (FIG. 15(*a*), FIG. 15(*b*), FIG. 15(*c*), FIG. 15(*d*) and FIG. 15(*e*)), fluid channels 112 having at least one branch (FIG. 15(*f*) and FIG. 15(*g*)), cross-shaped fluid channels 112 (FIG. 15(*h*) and FIG. 16(*a*)), a Y-shaped fluid channel 112 (FIG. 16(*b*)), a fluid channel having a sensor (not shown), a fluid channel having an electrical output unit (not shown), and a fluid channel having an optical output unit (not shown) may be formed. However, the flow channel 112 is not necessarily limited thereto, and may be changed into various structures and shapes to thereby be applied. In addition, the fluid channel 112 may be made through a combination of the channels described above.

Meanwhile, the other modular fluidic chip 2 connected to the modular fluidic chip 1 may include the body 11 capable of performing a function different from the function of the body 11 of the modular fluidic chip 1.

That is, different types of fluid channels 112 may be formed in the body 11 of the modular fluidic chip 1 and the body 11 of the other modular fluidic chip 2.

Accordingly, the plurality of the modular fluidic chips 1 and 2 that are connected to each other to implement the fluidic flow system 1000 may perform different functions on fluid flowing therein. Here, each of the plurality of modular fluidic chips 1 and 2 connected to each other may be formed to perform only one function. For example, when one fluidic chip 1 has a Y-shaped fluid channel 112 and performs a function for mixing, the other fluidic chip 2 connected thereto may include a type of the fluid channel 112 different from that of the Y-shaped fluid channel 112 described above and perform a function different from that of the fluidic chip 1.

In addition, the modular fluidic chip 1 according to the fourth embodiment of the present disclosure includes the housing 12.

Referring to FIGS. 13 and 17, the housing 12 is formed in a frame structure having a receiving space formed therein, and is configured to receive the body 11 therein. In addition, the second hole 121 is formed in the housing 12, and the second hole 121 corresponds to the at least one first hole 111 provided in the body 11 and allows the flow of fluid, when the body 11 is received in the receiving space.

The second hole 121 is formed in at least one position along the circumference of the housing 12 and communicates with the first hole 111 of the body 11 to thereby guide the flow of fluid in at least one direction of the X-axis direction and the Y-axis direction.

In addition, the second hole 121 is formed in a shape corresponding to the first hole 111 provided in the body 11 and may prevent a phenomenon in which a fluid flow is unstable or fluid pressure increases between the housing 12 and the body 11 during the flow of fluid. For example, the second hole 121 may have a circular shape in a cross-section as shown in FIG. 18(*b*), or may have a polygonal or elliptical shape in the cross-section although not shown in the drawings. However, the shape of the second hole 121 is not limited thereto, and may be formed in various manners within a limit in which a width w is equal to or greater than 10 nm and is equal to or less than 1 Cm.

In addition, the housing 12 may be formed of at least one of a ceramic, a metal, and a polymer. Here, the ceramic means a material composed of an oxide, a carbide, a nitride made by combining a metal element such as silicon, aluminum, titanium, zirconium or the like, with oxygen, carbon, nitrogen. The housing 12 may be formed of one of the above ceramic materials or may be formed of a ceramic mixture in which at least one or more of the above ceramic materials are mixed. And, the metal means a material composed of an element which is named as a metal in the chemical periodic table, such as Au, Mg, Ti, Cr, Mn, Fe, Co, Ni, Cu, Zn, Ga, Al, Zr, Nb, Mo, Ru, Ag, Sn or the like. The housing 12 may be formed of any one of the above metal materials, or may be formed of a metallic mixture in which at least one or more of the above metal materials are mixed. And, the polymer refers to a material composed of COC, PMMA, PDMS, PC, TIPP, CPP, TPO, PET, PP, PS, PEEK, Teflon, PI, PU or the like. The housing 12 may be formed of any one of the above polymer materials, or may be formed of a polymer mixture in which at least one or more of the above polymer materials are mixed. In addition, the housing 12 may be formed of a mixture of the ceramic, metal, and polymer described above. However, the housing 12 is not necessarily limited thereto, and may be formed of a variety of materials.

In addition, the housing 12 may be formed of a material similar to that of the body 11 described above, or may be formed of a material different from that of the body 11.

More specifically, the housing 12 formed of at least one of a ceramic, a metal, and a polymer, and the body 11 formed of at least one of a polymer resin, an amorphous material, a metal, and an elastomer may be formed of materials similar to each other or may be formed of materials different from each other.

Through this, the housing 12 and the body 11 can maximize adhesion of a surface-contact portion thereof to prevent mutual separation, as well as prevent fluid leakage in a connection portion thereof.

Here, the housing 12 formed separately from the body 11 is for the purpose of ensuring a stable flow of fluid when the modular fluidic chips 1 are connected as described above, but is also for the purpose of providing convenience in modularizing the modular fluidic chips 1. That is, since a position of the second hole 121 of the housing 12 is standardized, when designing and manufacturing the body 11, as long as the body 11 is manufactured to have a standardized entrance or exit or the first hole 111, fluid connection or interfacing between modules can be ensured. In addition, when only the body 11 is newly manufactured and coupled to the housing 12, a module having a new function may be assembled.

In addition, the housing 12 includes a fluid connection part 17.

The fluid connection part 17 is configured to connect the modular fluidic chip 1 with the other modular fluidic chip 2.

Figure 33:
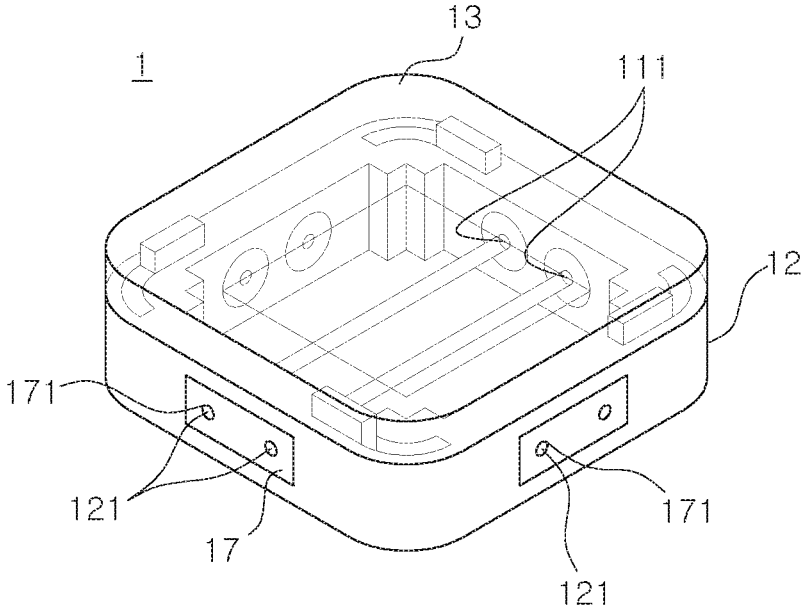
FIG. 33 is a perspective view illustrating a state in which a fluid connector is applied to the modular fluidic chip according to an embodiment of the present disclosure.
Figure 34:
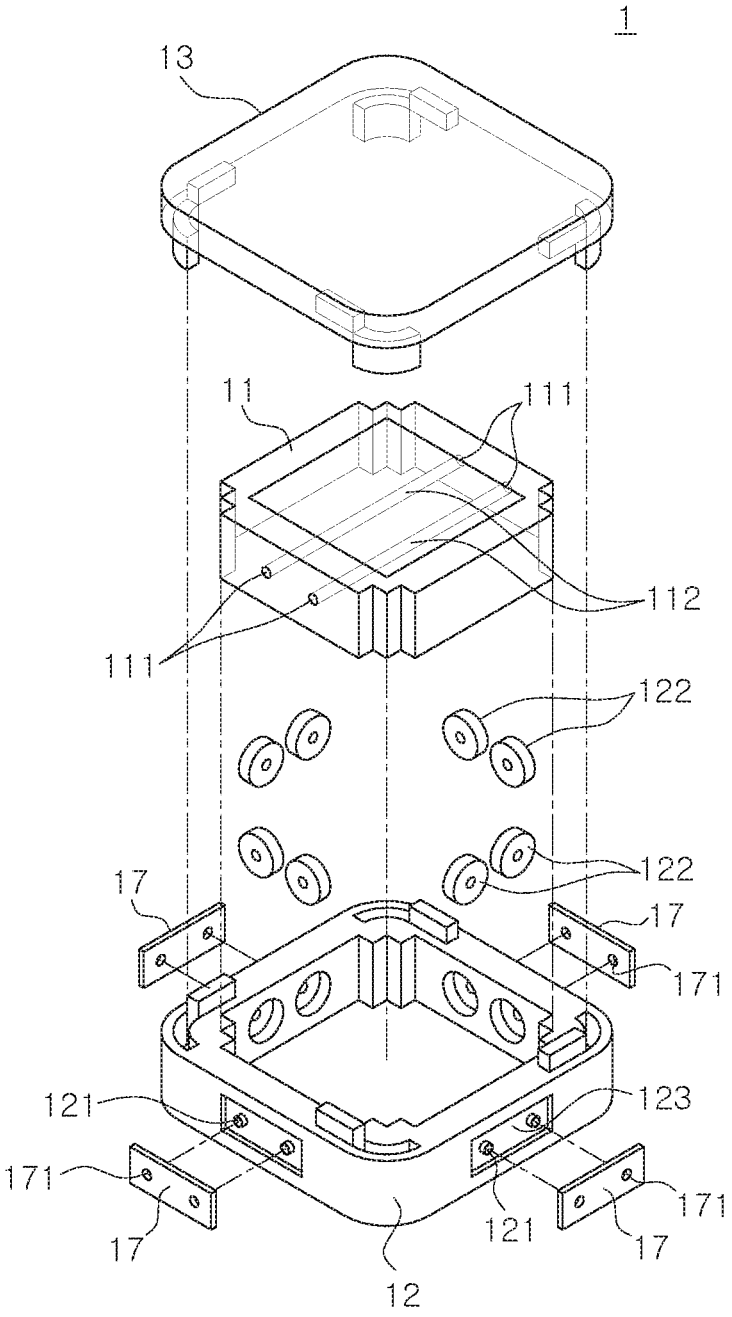
FIG. 34 is an exploded perspective view of FIG. 33.

Referring to FIGS. 33 and 34, the fluid connection part 17 may be formed in the form of a sheet or pad, and may be detachably installed on an outer surface of the housing 12. Here, a seating groove 123 corresponding to the fluid connection part 17 so that the fluid connection part 17 can be seated therein may be formed in the outer surface of the housing 12. In addition, a third hole 171 which is aligned to correspond to the first hole 111 and the second hole 121 may be formed in the fluid connection part 17.

Figure 35:
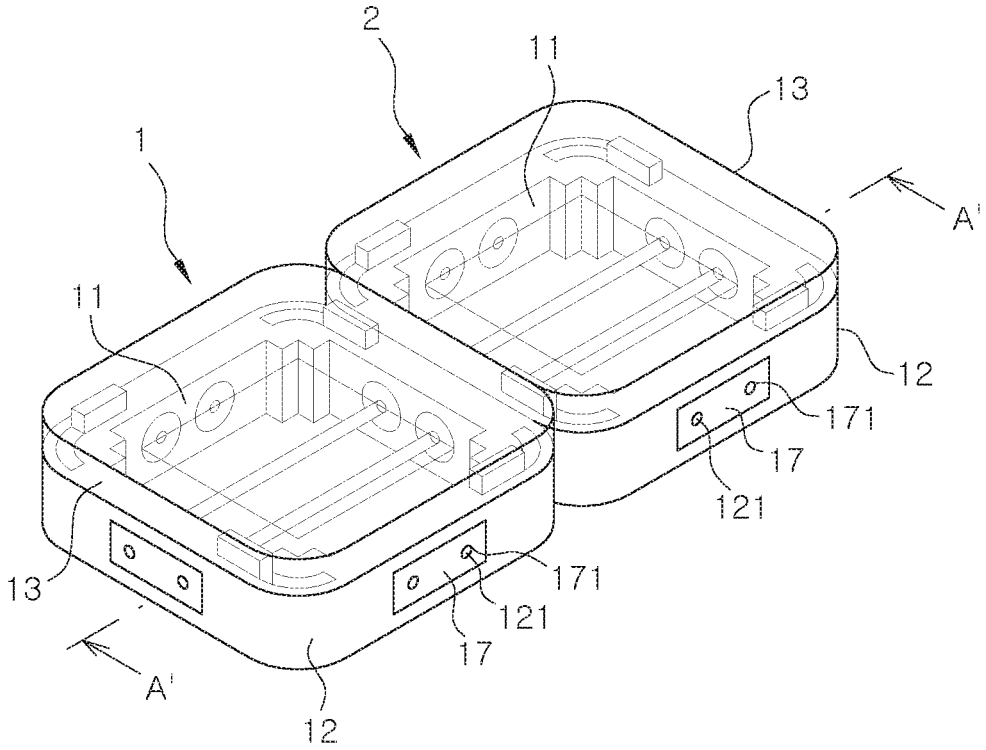
FIG. 35 is a perspective view illustrating a state in which the modular fluidic chip is connected to the other modular fluidic chip according to an embodiment of the present disclosure.
Figure 36:
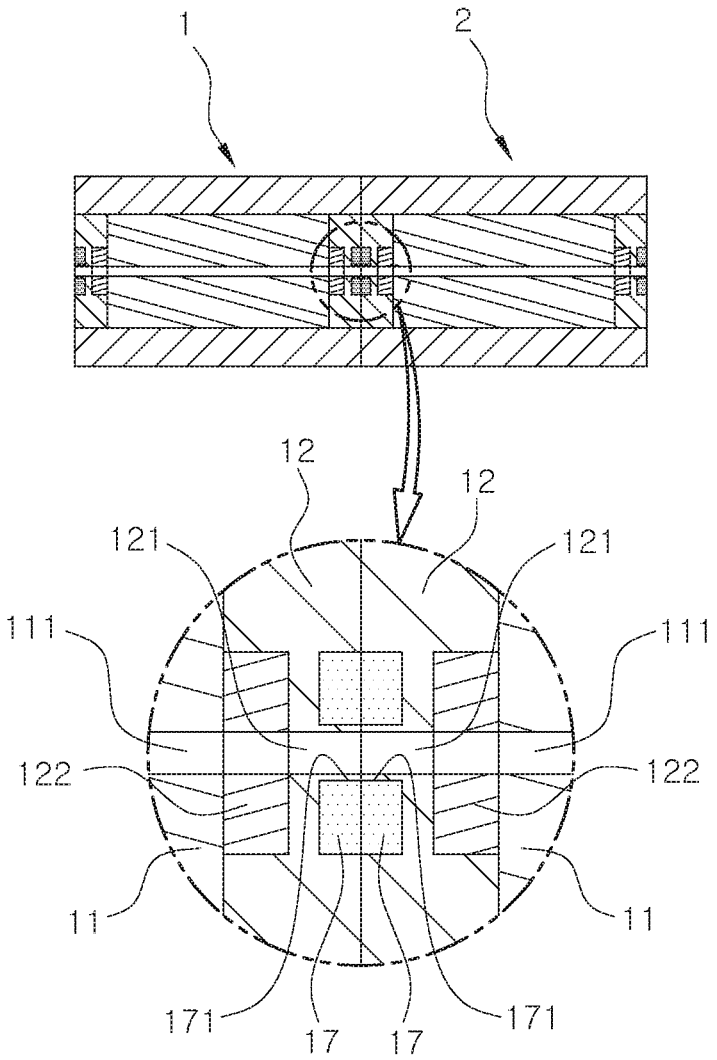
FIG. 36 is a cross-sectional view taken along line A'-A' of FIG. 35.

In addition, referring to FIGS. 35 and 36, the fluid connection part 17 may be configured to form an interface when contacting another fluid connection part 17.

More specifically, the fluid connection part 17 may be formed of an elastically deformable elastomer material and form an interface at a contact portion when contacting another fluid connection part 17. Here, an adhesive layer may be provided on one surface of the fluid connection part 17, and the adhesive layer can be adhered to one surface of another fluid connection part 17 when the fluid connection part 17 contacts the other fluid connection part 17.

However, the fluid connection part 17 is not limited thereto, and may be changed into various shapes or various materials to thereby be applied within conditions capable of performing the same function. For example, when the housing 12 is manufactured, the fluid connection part 17 may be integrally provided on the outer surface of the housing 12 through double injection molding, and may be formed in a circular or polygonal ring shape with a hole formed in a center thereof, or may be formed in a plate-like stopper shape. In addition, the fluid connection part 17 may be formed of at least one of a polymer resin, an amorphous material, and a metal, and may include at least one of chlorinated polyethylene, ethylene propylene dimethyl, silicone rubber, acrylic resin, amide resin, epoxy resin, phenol resin, polyester-based resin, polyethylene-based resin, ethylene-propylene rubber, polyvinyl butyral resin, polyurethane resin, and nitrile-butadiene-based rubber.

Therefore, when the modular fluidic chip 1 and the other modular fluidic chip 2 are connected in the horizontal or vertical direction, the fluid connection part 17 provided in the modular fluidic chip 1 is in close contact with the fluid connection part 17 provided in the other modular fluidic chip 2 and forms an interface. Through this, a connection portion between the modular fluidic chip 1 and the other modular fluidic chip 2 may be completely airtight to thereby block leakage of fluid. Here, a coupling unit 122 to be described later that has magnetism so as to maximize adhesion of the fluid connection unit 17 may be disposed on an inner surface of each housing 12 provided in the modular fluidic chip 1 and the other modular fluidic chip 2.

In addition, the fluid connection part 17 may be disposed on at least one of an outside and an inside of the housing 12.

Figure 37:
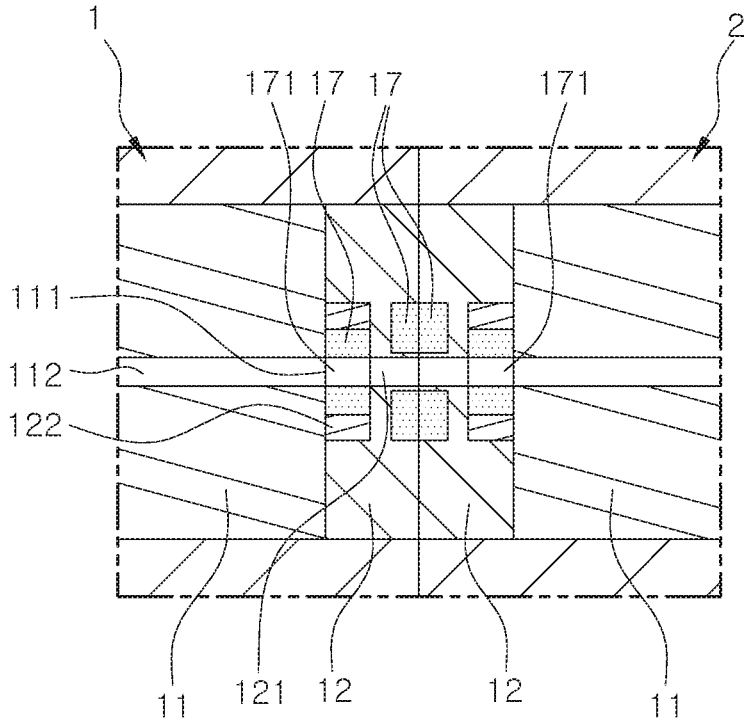
FIGS. 37 to 42 are views illustrating states in which various embodiments of the fluid connector are applied to the modular fluidic chips according to an embodiment of the present disclosure.

Referring to FIG. 37, the fluid connection part 17 disposed on the outside of the housing 12 may be in close contact with the other fluid connection part 17 and form an interface, and the fluid connection part 17 disposed on the inside of the housing 12 may be in close contact with the body 11 and form an interface. Here, the coupling unit 122 having magnetism may be provided around the fluid connection part 17 disposed on the inside of the housing 12. Accordingly, it is feasible to improve airtight performance between the modular fluidic chip 1 and the other modular fluidic chip 2 by maximizing adhesion of the fluid connection unit 17 disposed on the outside of the housing 12.

In addition, the fluid connection part 17 may be formed in a structure capable of being coupled to the housing 12.

Figure 38:
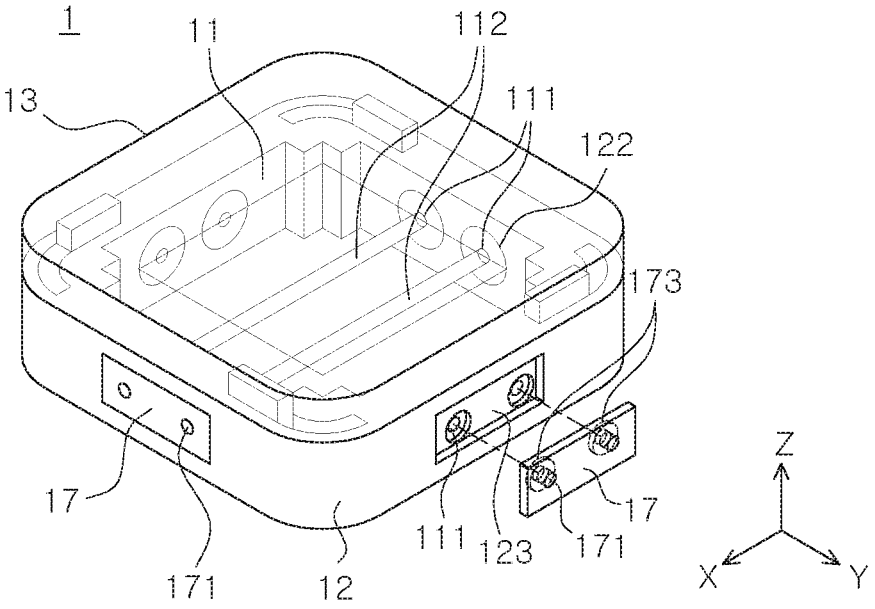
Figure 39:
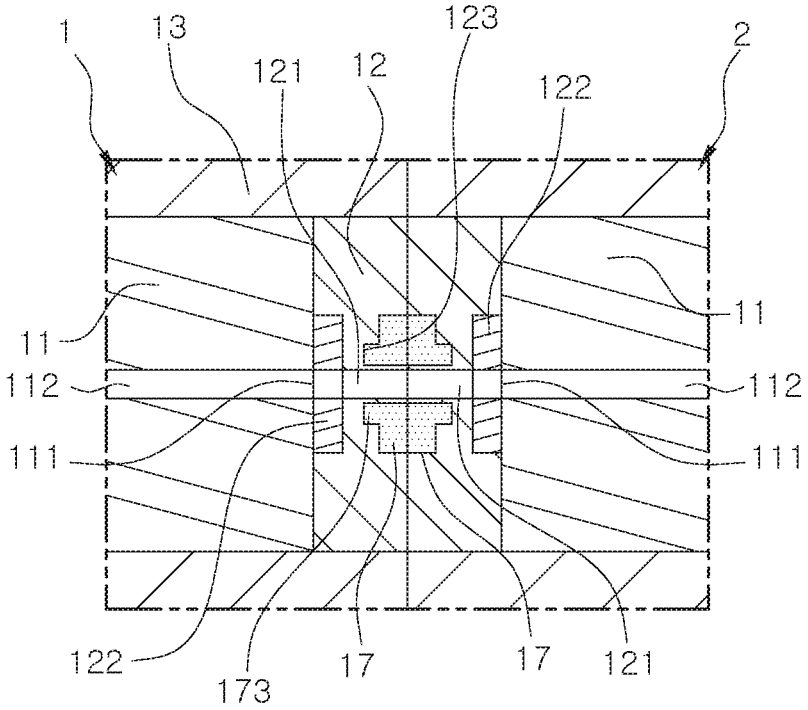

Referring to FIGS. 38 and 39, a convex portion 173 having a protrusion shape may be formed on the fluid connection part 17, and the convex portion 173 protrudes from an outer surface of the fluid connection part 17 by a predetermined length and is inserted into the seating groove 123 formed in the housing 12. Accordingly, the fluid connection part 17 is more stably coupled to the housing 12 to limit the movement thereof and further, even when the modular fluidic chip 1 is coupled to the other modular fluidic chip 2, it is feasible to prevent the fluid connection part 17 from being separated from the housing 12.

Meanwhile, although not shown in the drawings, a concave portion having a groove shape may be formed in the fluid connection part 17, and the concave portion may be recessed from the outer surface of the fluid connection part 17 to a predetermined depth and may be coupled to the protrusion formed in the housing 12.

However, a coupling structure provided in the fluid connection part 17 is not necessarily limited thereto, and may be changed into various shapes to thereby be applied.

In addition, the fluid connection part 17 may be formed in a structure capable of directly communicating with the body 11 to thereby be connected to the other modular fluidic chip 2.

Figure 40:
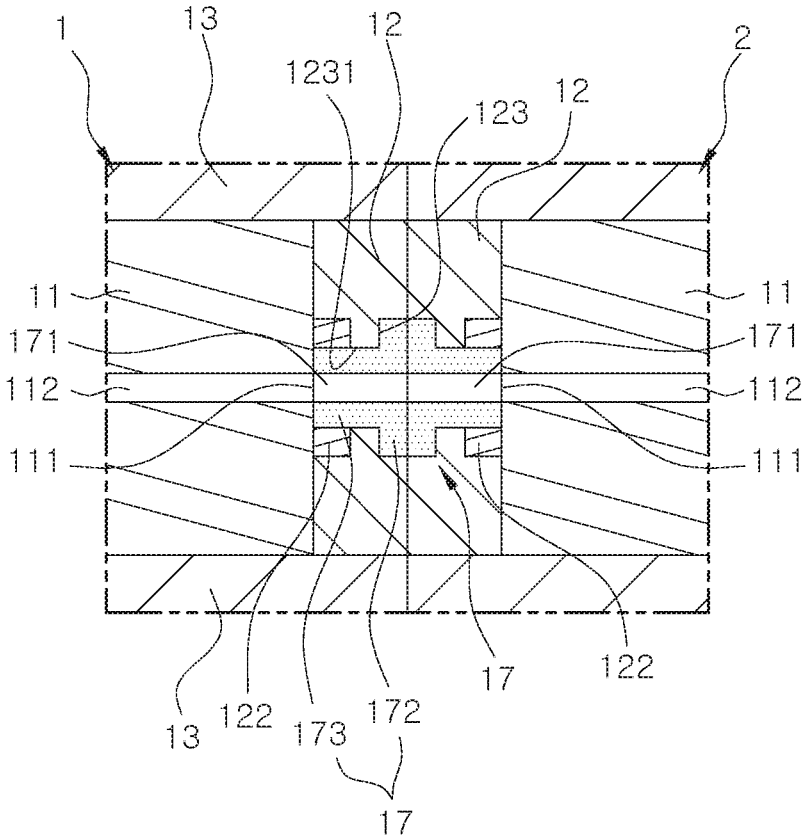

Referring to FIG. 40, the fluid connection part 17 is received in the housing 12, but may pass through the housing 12 to thereby be in close contact with the outer surface of the body 11. Accordingly, the third hole 171 provided in the fluid connection part 17 directly communicates with the first hole 111 provided in the body 11 and allows the flow of fluid.

That is, the fluid connection part 17 installed by passing through the housing 12 is in close contact with the fluid connection part 17 of the other modular fluidic chip 2 at one side thereof to form an interface, and is in close contact with the outer surface of the body 11 at the other side thereof to form an interface, so that points at which fluid may leak may be minimized. Through this, a stable fluid flow may be allowed.

For example, the fluid connection part 17 may include a seating portion 172 which is seated in the seating groove 123 formed in the outer surface of the housing 12 and which is connected to the other modular fluidic chip 2, and the convex portion 173 which protrudes from one surface of the seating portion 172 by a predetermined length to pass through the housing 12 and which is in close contact with the outer surface of the body 11 to form an interface. Here, a concave portion 1231 may be provided in the inner surface of the housing 12, and the concave portion 1231 is formed in a shape corresponding to an outer surface of the convex portion 173 and supports the convex portion 173. Further, the coupling unit 122 to be described later that has magnetism may be further disposed around the convex portion 173 so as to maximize adhesion of the seating portion 172.

In addition, the fluid connection part 17 may be formed in a structure in which it is divided into plural numbers, while directly communicating with the body 11.

Figure 41:
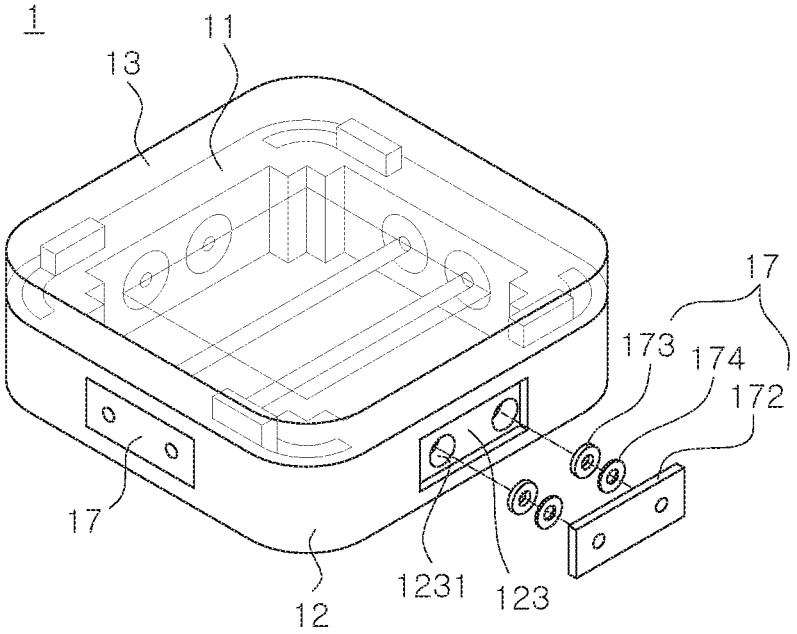
Figure 42:
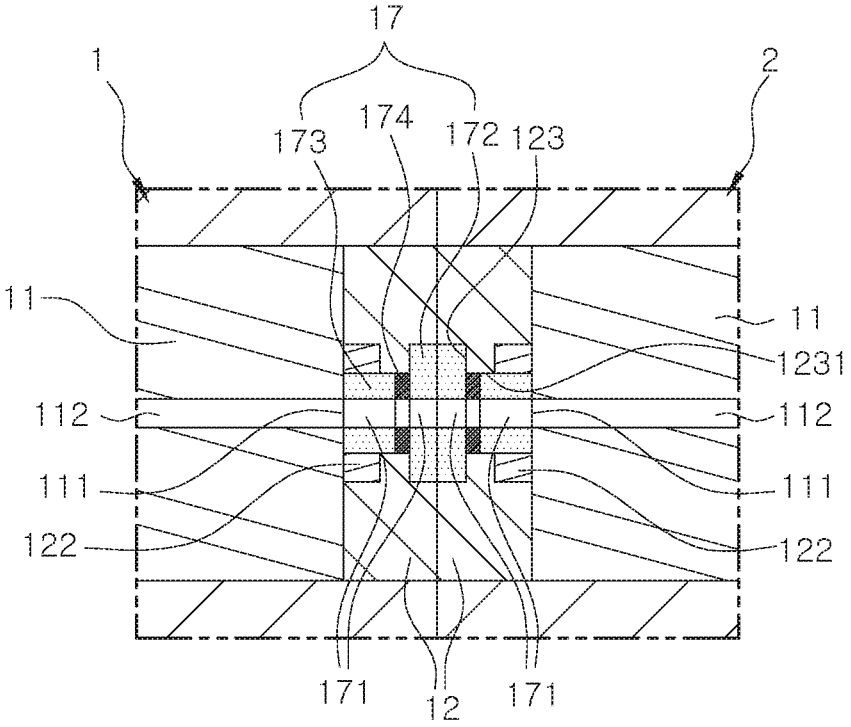

Referring to FIGS. 41 and 42, the fluid connection part 17 may include the seating portion 172, the convex portion 173, and an O-ring 174.

The seating portion 172 may be seated in the seating groove 123 formed in the outer surface of the housing 12 and may be in close contact with the other modular fluidic chip 2 to form an interface.

The convex portion 173 may be separated from the seating portion 172 and received in the concave portion 1231 provided inside the housing 12, and may be in close contact with the outer surface of the body 11 and form an interface.

The O-ring 174 is disposed between the seating portion 172 and the convex portion 173 to connect the seating portion 172 and the convex portion 173 to each other and uniformly distributes a load which acts on the fluid connector 17 in the axial direction when connecting the modular fluidic chip 1 and other modular fluidic chip 2, thereby preventing deformation of the seating portion 172 or the convex portion 173. For example, the O-ring 174 is formed of an elastic body, plastic or metallic material, and another hole communicating with the third hole 171 formed in the seating portion 172 and the convex portion 173 may be formed inside the O-ring 174.

However, the fluid connector 17 is not necessarily limited thereto, and may be changed into various forms to thereby be applied.

In addition, the modular fluidic chip 1 according to the fourth embodiment of the present disclosure may further include the coupling unit 122.

Referring to FIGS. 11 and 13, the coupling unit 122 may be configured to couple the modular fluidic chip 1 to other modular fluidic chips 2 in horizontal directions (the X-axis direction and Y-axis direction).

More specifically, the coupling unit 122 is received in the housing 12 or provided integrally with the housing 12 to thereby connect the modular fluidic chip 1 to the other modular fluidic chips 2 in the horizontal directions (the X-axis direction and Y-axis direction) and at the same time, may automatically align and fix the modular fluidic chip 1 to the other modular fluidic chips 2.

Thus, the plurality of modular fluidic chips 1 and 2 connected to each other in the horizontal directions may implement one fluidic flow system 1000 including a plurality of fluid flow sections and fluid analysis sections.

Here, the coupling unit 122 may include a material having magnetism.

Referring to FIGS. 11 and 13, the coupling unit 122 is formed of a magnetic body having an S-pole on one side thereof and an N-pole on the other side thereof, and may be installed on the inside of the housing 12. Through this, the modular fluidic chip 1 connected to the other modular fluidic chip 2 can maintain a state in which it is in surface-contact with the other modular fluidic chip 2.

Figure 19:
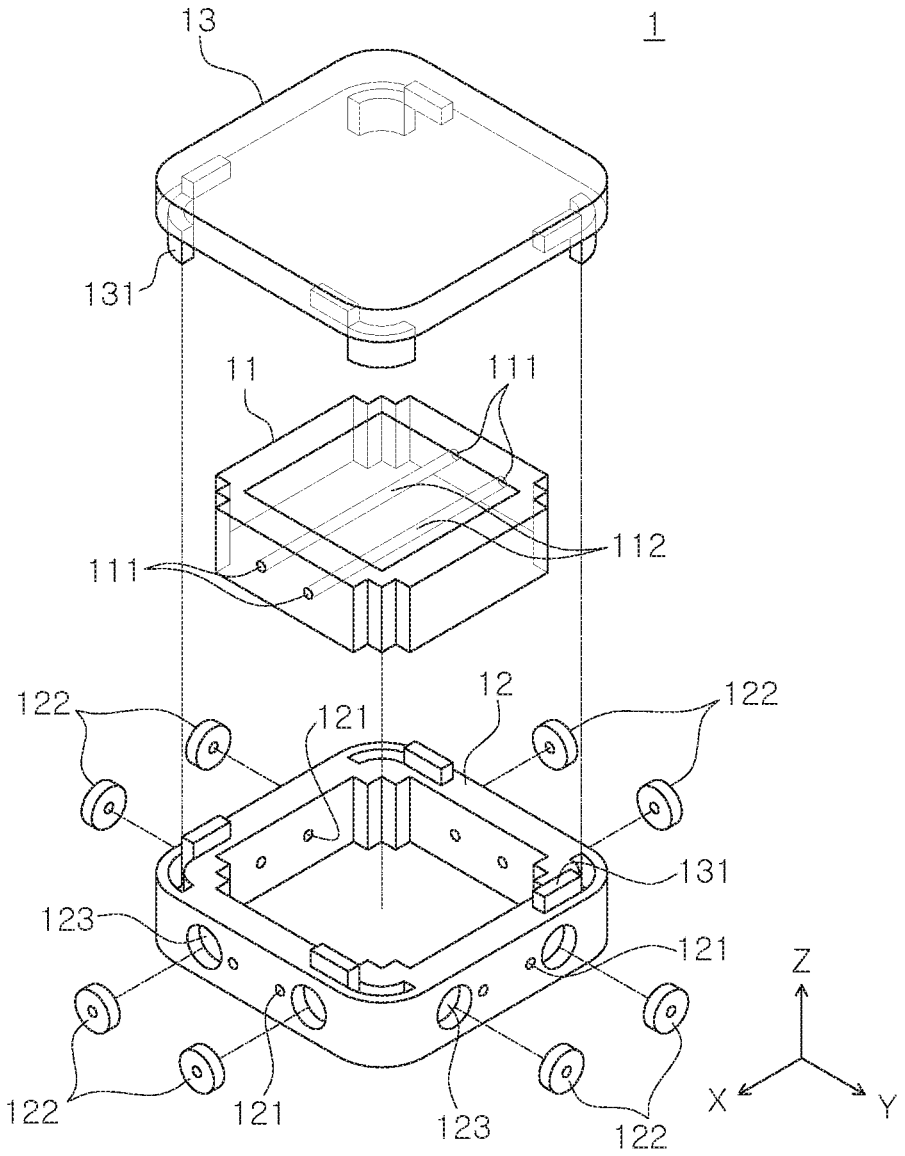
FIGS. 19 to 20 are exploded perspective views each illustrating a modified embodiment of a coupling unit having magnetism in the modular fluidic chip according to an embodiment of the present disclosure.
Figure 20:
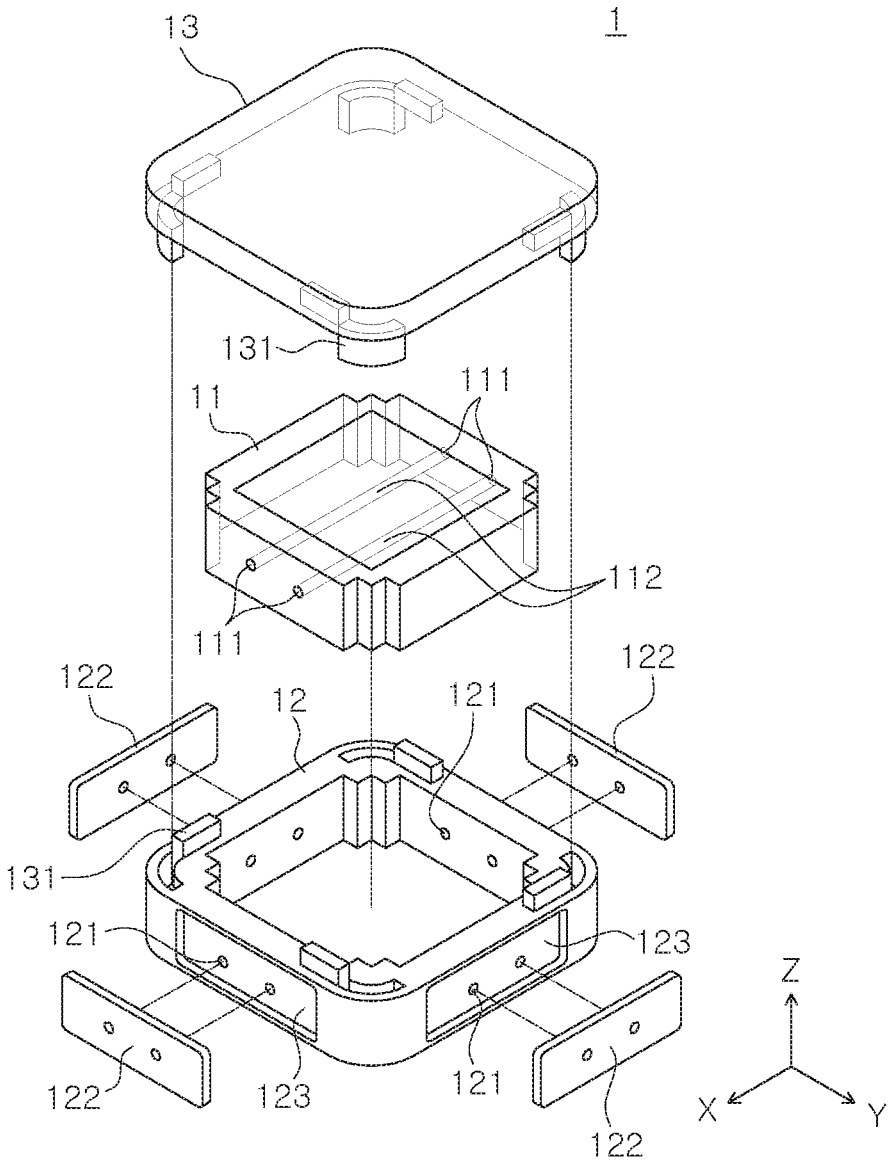

Further, referring to FIGS. 19 and 20, the coupling unit 122 may be installed on the outside of the housing 12. In this case, the seating groove 123 in which the coupling unit 122 can be seated may be formed in the outer surface of the housing 12. Accordingly, the coupling unit 122 installed on the outside of the housing 12 can further maximize binding force between the modular fluidic chip 1 and the other modular fluidic chip 2.

However, the coupling unit 122 is not limited thereto, and may be changed into various structures. For example, the coupling unit 122 may be provided on both the inside and the outside of the housing 12 and may be formed in a form capable of changing a direction of polarity as necessary. In addition, the coupling unit 122 may include not only a magnetic body such as a permanent magnet but may also include at least one of various magnetic materials capable of implementing the same function as the magnetic body.

In addition, referring to FIGS. 13 and 19, when the coupling unit 122 installed on the housing 12 is connected to the other modular fluidic chip 2, the coupling unit 122 may be disposed in a position where it has the same central axis as the second hole 121 of the modular fluidic chip 1 in such a manner that the second hole of the other modular fluidic chip 2 and the second hole 121 of the modular fluidic chip 1 may be arranged with and communicate with each other. Here, the housing 12 may be provided with the seating groove 123 in which the coupling unit 122 may be seated. In addition, the coupling unit 122 received in the seating groove 123 may be exposed to the outside of the housing 12 and may be formed in a shape corresponding to the seating groove 123 so as not to interfere with other components.

In addition, the coupling unit 122 provided in the modular fluidic chip 1 may be formed in a structure capable of being directly connected to the coupling unit 122 provided in the other modular fluidic chip 2.

Figure 26:
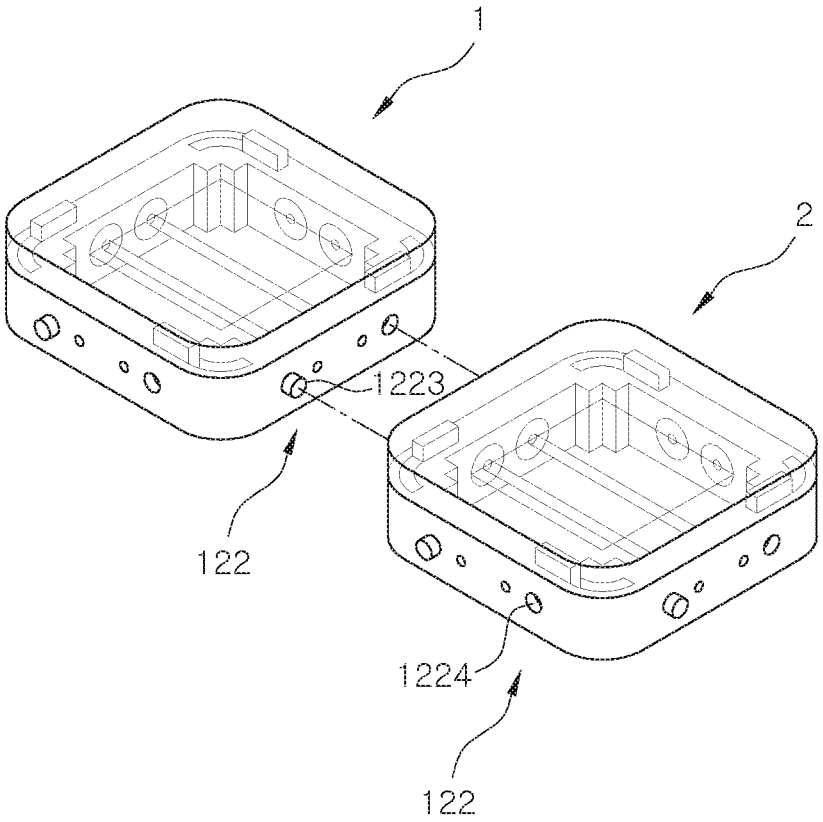
FIGS. 26 to 30 are views each schematically illustrating a state in which a coupling structure capable of being physically coupled to the modular fluidic chips according to an embodiment of the present disclosure is applied.

Referring to FIG. 26, the coupling unit 122 provided in the modular fluidic chip 1 and the coupling unit 122 of the other modular fluidic chip 2 corresponding thereto may include a convex portion 1223 or a concave portion 1224 corresponding to each other. For example, the convex portion 1223 and the concave portion 1224 may be formed in a convexo-concave shape in which they correspond to each other. In addition, the convex portion 1223 and the concave portion 1224 may be formed in a cylindrical or polygonal column shape to prevent separation or movement of each modular fluidic chip when they are coupled to each other.

Referring to FIGS. 27 to 30, the coupling unit 122 provided in the modular fluidic chip 1 may include a fastening portion 1225 which can be connected to the other modular fluidic chip 2.

Figure 27:
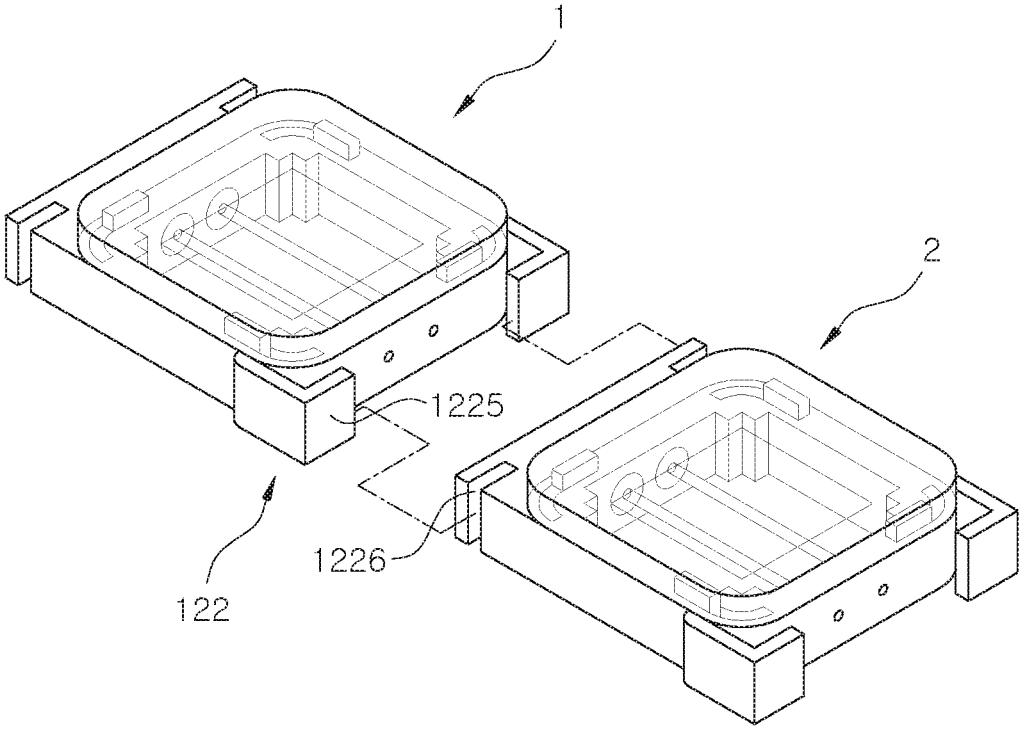

Referring to FIG. 27, the coupling unit 122 provided in the modular fluidic chip 1 may include the fastening portion 1225 having a hook shape at an end thereof to thereby be coupled with the other modular fluidic chip 2. In this case, a fastening groove 1226 corresponding to the fastening portion 1225 provided in the modular fluidic chip 1 may be formed in the other modular fluidic chip 2.

Figure 28:
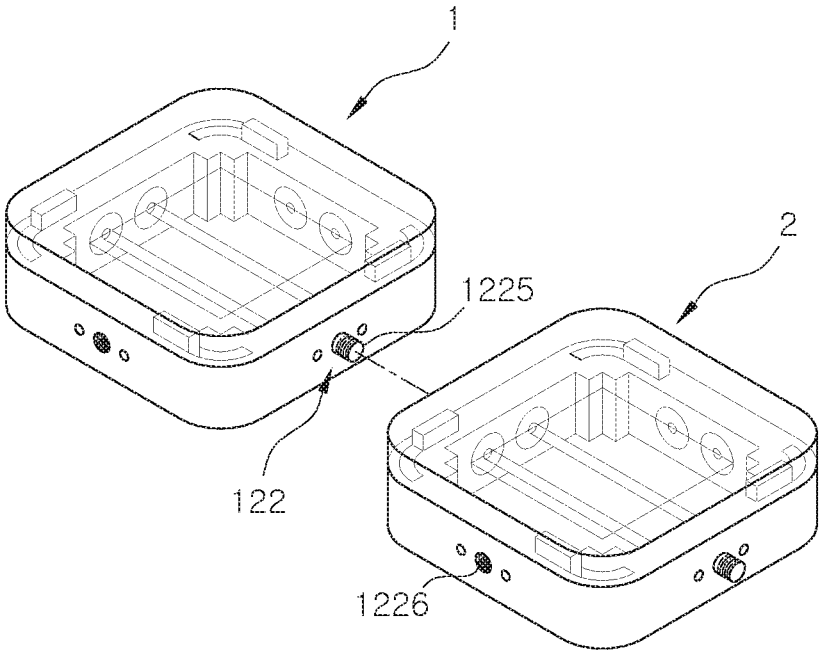

Referring to FIG. 28, the coupling unit 122 provided in the modular fluidic chip 1 may include the fastening portion 1225 having a bolt shape with a thread on an outer circumferential surface thereof to thereby be coupled with the other modular fluidic chip 2. In this case, the fastening groove 1226 corresponding to the fastening portion 1225 provided in the modular fluidic chip 1 may be formed in the other modular fluidic chip 2.

Figure 29:
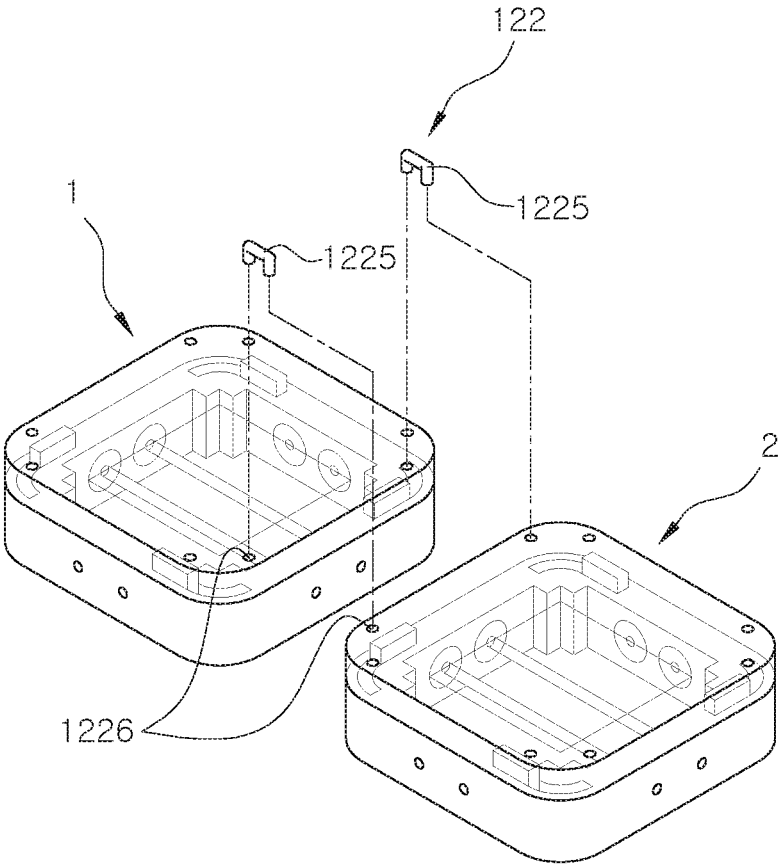

Referring to FIG. 29, the coupling unit 122 provided in the modular fluidic chip 1 may include the fastening portion 1225 having a '∩' shape in the form of a pin to thereby be coupled with the other modular fluidic chip 2. In this case, the fastening groove 1226 in which the fastening portion 1225 in the form of a pin can be inserted may be formed in the modular fluidic chip 2 that is different from the modular fluidic chip 1.

Figure 30:
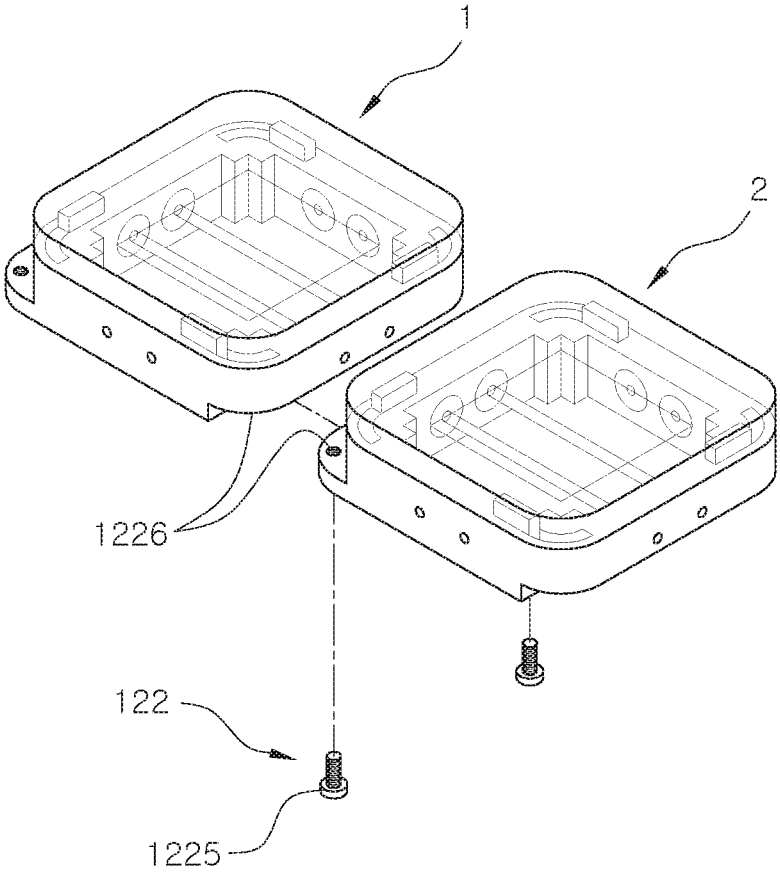

Referring to FIG. 30, the coupling unit 122 provided in the modular fluidic chip 1 may be coupled to the other modular fluidic chip 2 through the bolt-shaped fastening portion 1225. In this case, the fastening groove 1226 in which the bolt-shaped fastening portion 1225 can be fastened may be formed in the modular fluidic chip 2 that is different from the modular fluidic chip 1.

In addition, the modular fluidic chip 1 according to the fourth embodiment of the present disclosure may further include a cover 13.

Referring to FIGS. 12 and 13, the cover 13 may be configured to be coupled to at least one of upper and lower portions of the housing 12 in the vertical direction (the Z-axis direction) and protect the body 11.

The cover 13 may be formed in a shape corresponding to the housing 12, and may be formed of a transparent material so that the body 11 can be seen from the outside when the cover 13 is coupled to the housing 12. Further, an optical or electrical cable (not shown) may be mounted on the inside of the cover 13 as necessary.

In addition, the cover 13 and the housing 12 may further include a fastening means 131 for mutual connection.

More specifically, the cover 13 and the housing 12 may each be provided with a coupling portion protruding outwardly from one surface thereof and an insertion groove in which the coupling portion provided at a relative position can be inserted. For example, the coupling portion formed on the cover 13 and the coupling portion formed on the housing 12 may be formed in the same shape or different shapes. However, the fastening means 131 provided on the cover 13 and the housing 12 are not limited thereto, and may be applied in various structures in which they are mutually fastened with each other.

Meanwhile, the modular fluidic chip 1 may be connected to other modular fluidic chips 2 in a vertical direction to implement one fluidic flow system 1000.

Figure 21A:
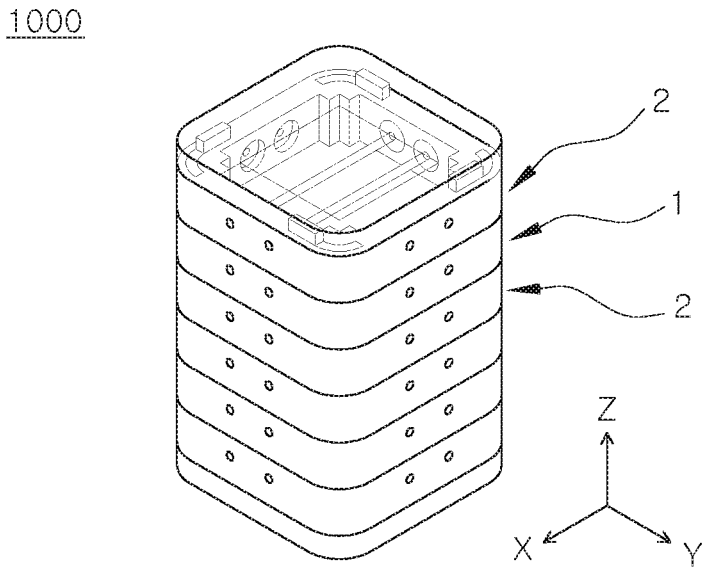
FIGS. 21A and 21B are perspective views each illustrating the fluidic flow system in which the modular fluidic chips are connected in a vertical direction according to an embodiment of the present disclosure.
Figure 21A:
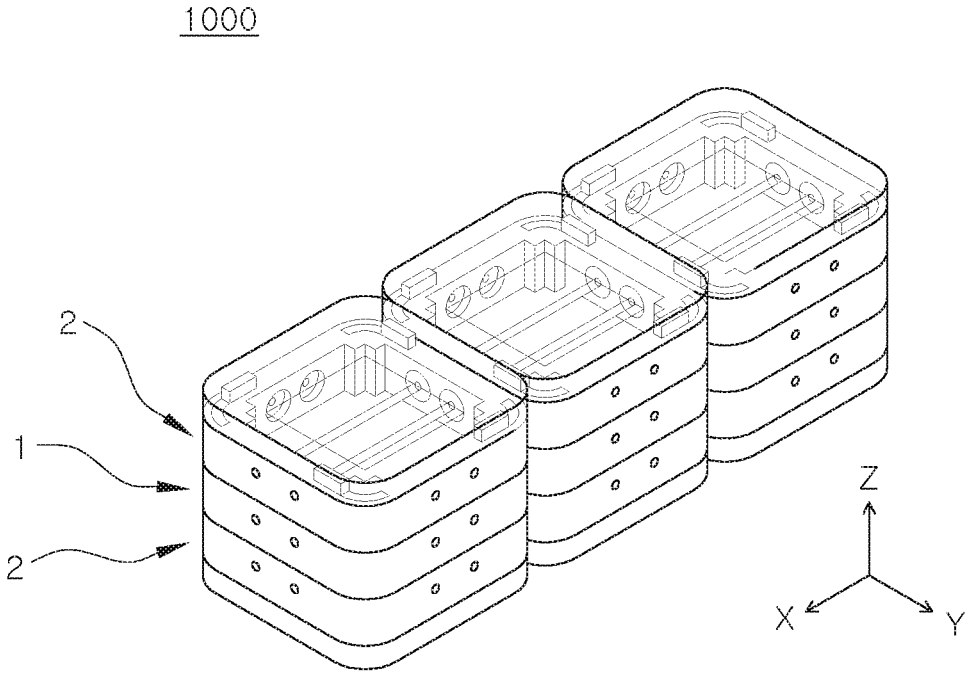

Referring to (a) of FIG. 21A, the modular fluidic chip 1 may be connected to the other modular fluidic chips in the vertical direction (the Z-axis direction) to implement one fluidic flow system 1000 including a plurality of fluid flow sections and fluid analysis sections. And, referring to (b) of FIG. 21A, the modular fluidic chip 1 may be connected to the other modular fluidic chips 2 in the horizontal direction (the X-axis direction) and vertical direction (the Z-axis direction) to implement another type of fluidic flow system 1000. Here, the second hole 121 provided in the housing 12 of the modular fluidic chip 1 may communicate with the second hole 121 provided in the housing 12 of the other modular fluidic chip 2. Further, in (b) of FIG. 21A, the modular fluidic chip 1 is shown to be connected to the other modular fluidic chips 2 only in the X-axis direction. However, the modular fluidic chip 1 may be connected to the other modular fluidic chips 2 not only in the X-axis direction but also be connected to the other modular fluidic chips 2 in the Y-axis direction or the X-axis direction.

That is, the modular fluidic chip 1 is configured to be connected to other modular fluidic chips 2 in the horizontal and vertical directions, thereby generating fluid flow paths in various directions. For example, the number of a plurality of modular fluidic chips 2 that are connected to each other to form the fluidic flow system 1000 may be 1 to 10,000 in at least one direction of the horizontal direction and the vertical direction.

Meanwhile, referring to FIG. 21A, the modular fluidic chip 1 connected to other modular fluidic chips 2 in the vertical direction (the Z-axis direction) may be coupled to the other modular fluidic chips 2 in a state in which the cover 13 is not coupled.

At this time, the second hole 121 provided in the housing 12 may be formed in a structure capable of guiding a flow of fluid to the second holes 121 provided in the other modular fluidic chips 2 disposed on upper and lower sides of the modular fluidic chip 1.

Figure 22A:
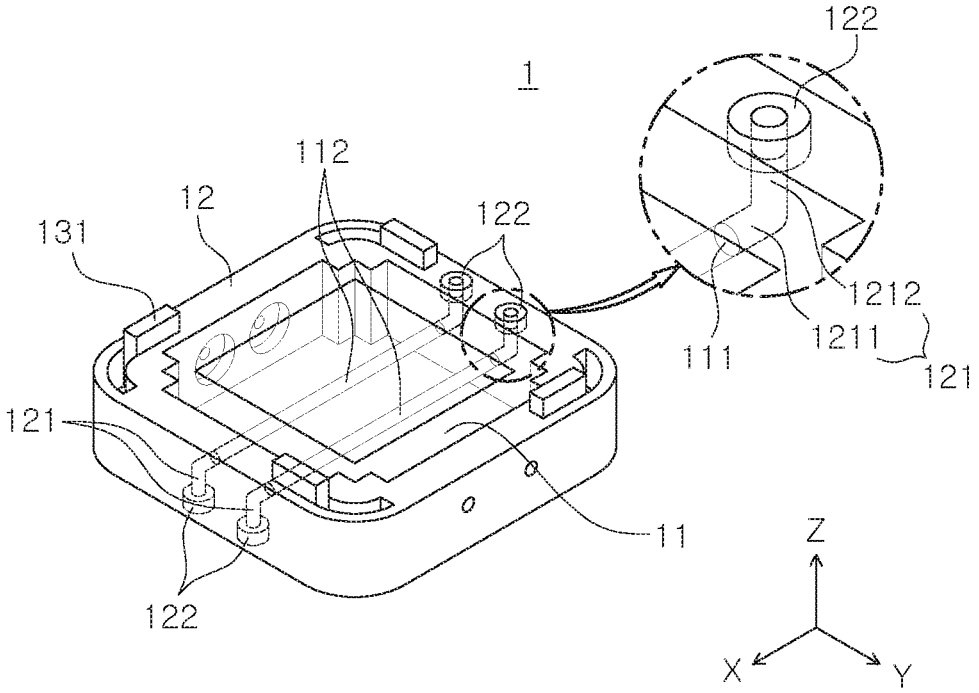
FIGS. 22A, 22B, 22C and 22D are perspective views each illustrating the modular fluidic chip according to an embodiment of the present disclosure to which a vertical connection structure is applied.
Figure 23A:
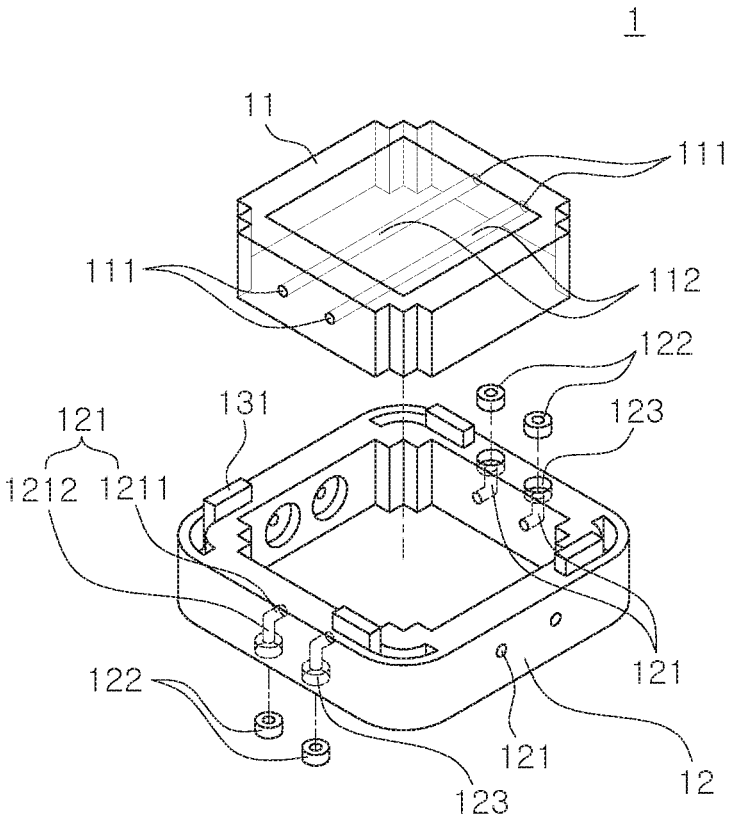
FIGS. 23A, 23B, 23C and 23D are exploded perspective views of FIGS. 22A, 22B, 22C and 22D.

Referring to FIGS. 22A and 23A, the modular fluidic chip 1 connected to the other modular fluidic chip 2 in the vertical direction (the Z-axis direction) is configured of the body 11 and the housing 12, and at least one second hole 121 formed in the housing 12 may include a horizontal portion 1211 which is in communication with the first hole 111 formed in the body 11 and disposed in parallel to the fluid channel 112, and vertical portions 1212 which is in communication with the horizontal portion 1211 and bent vertically in the housing 12 to communicate with an external space of the housing 12. Here, the housing 12 may include a plurality of coupling units 122 capable of connecting the other modular fluidic chips 2 disposed on upper and lower sides of the housing 12 to the modular fluidic chip 1. Each of the plurality of coupling units 122 may be formed of a magnetic body having an S-pole on one side thereof and an N-pole on the other side thereof, and may be installed in the seating grooves 123 provided in upper and lower surfaces of the housing 12. Further, the plurality of coupling units 122 may be provided with a through hole communicating with each vertical portion 1212 provided in the housing 12. The through hole is formed in a shape corresponding to the vertical portion 1212 and may have the same central axis as the vertical portion 1212.

Figure 25A:
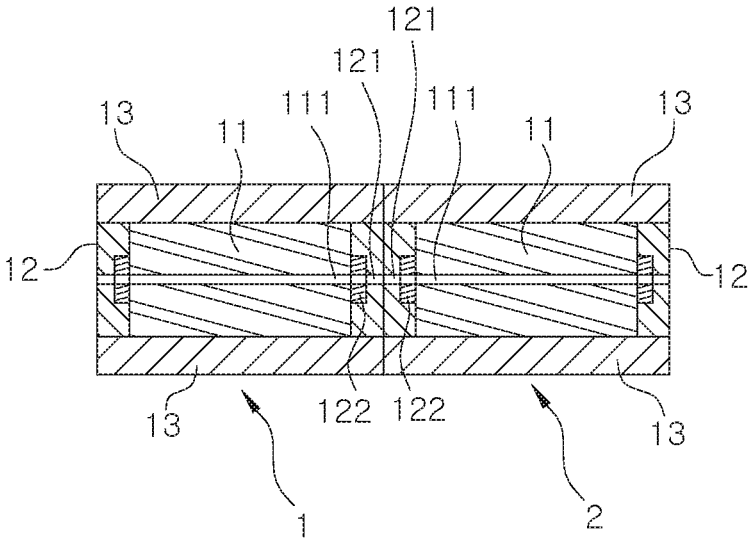
FIG. 25A is a schematic cross-sectional view illustrating a state in which the modular fluidic chips are connected in a horizontal direction according to an embodiment of the present disclosure.
Figure 25B:
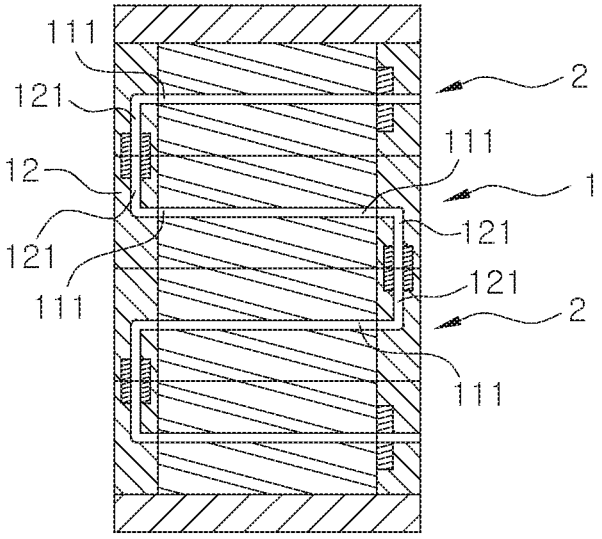
FIGS. 25B and 25C are schematic cross-sectional views illustrating a state in which the modular fluidic chips are connected in a vertical direction.
Figure 25B:
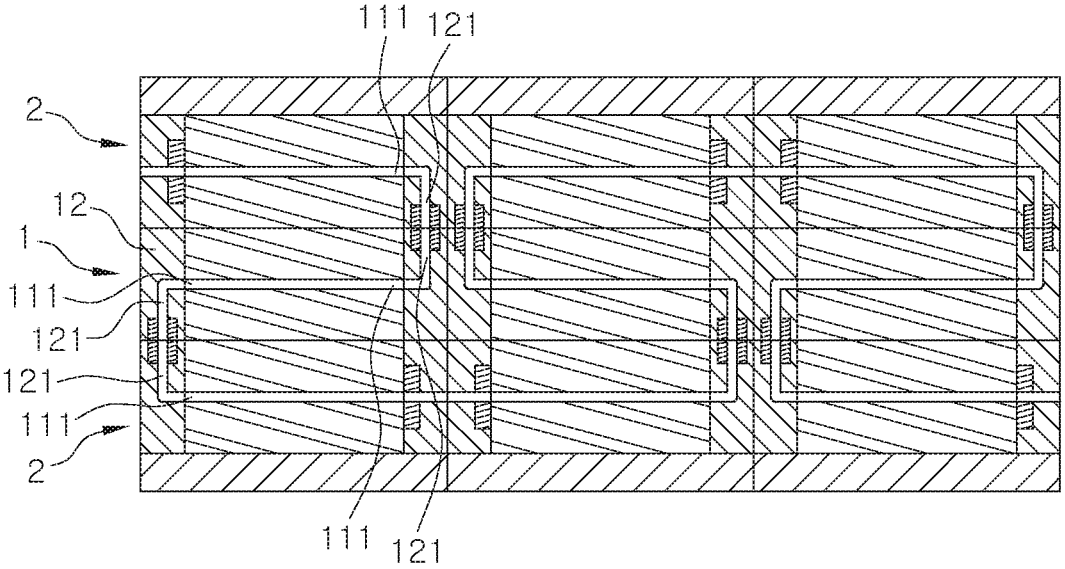

Therefore, as shown in FIGS. 25A and 25B, when the housing 12 of the modular fluidic chip 1 and the other modular fluidic chip 2 are connected in the horizontal or vertical direction, the first hole 111 and the second hole 121 provided in the modular fluidic chip 1 may be aligned with and communicate with the first hole 111 and the second hole 121 provided in the other modular fluidic chip 2.

In addition, the above-described modular fluidic chip 1 may be formed in a structure capable of being connected to the other modular fluidic chip 2 in a state in which the cover 13 is coupled to the housing 12.

Figure 22B:
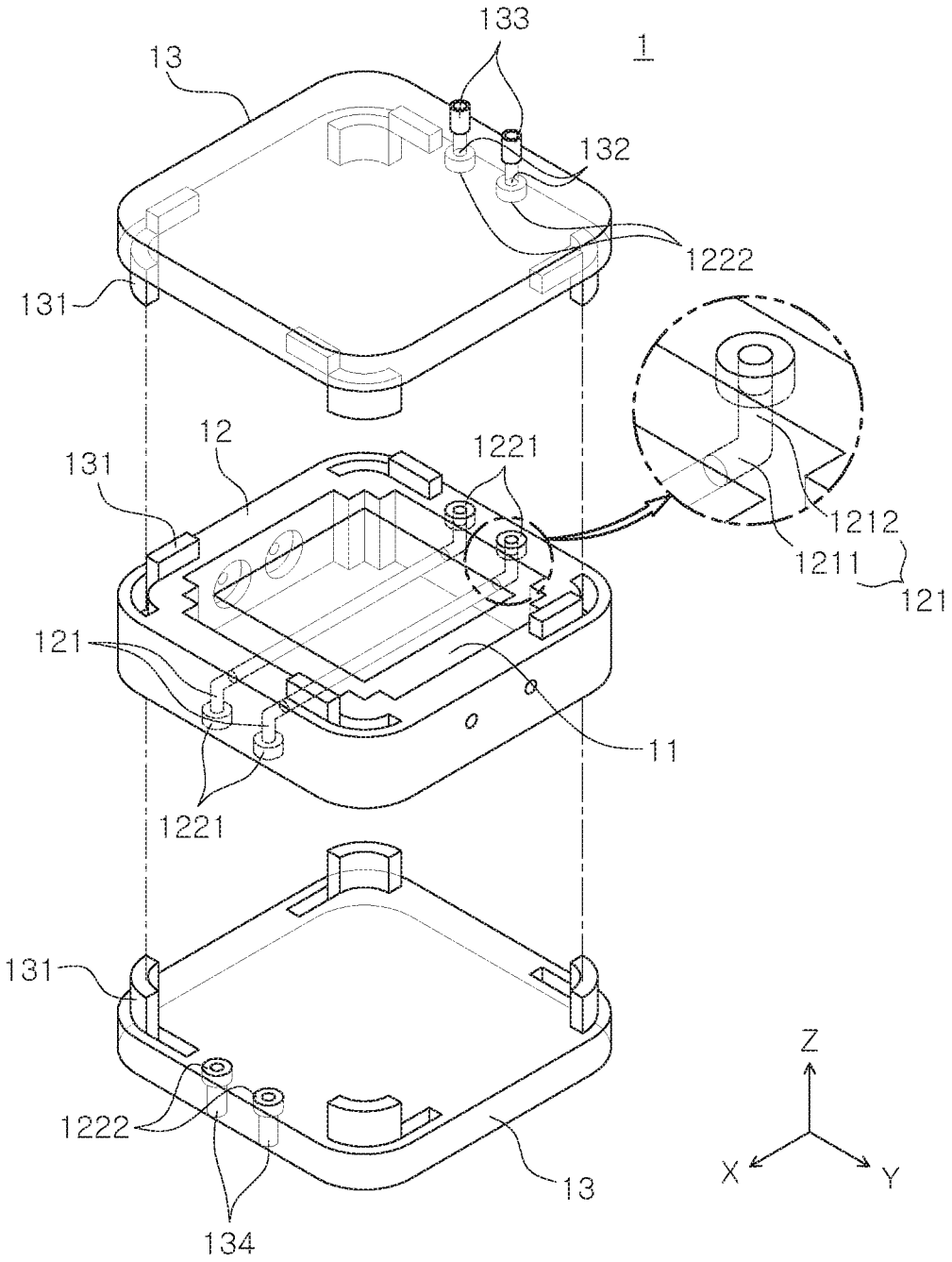
Figure 23B:
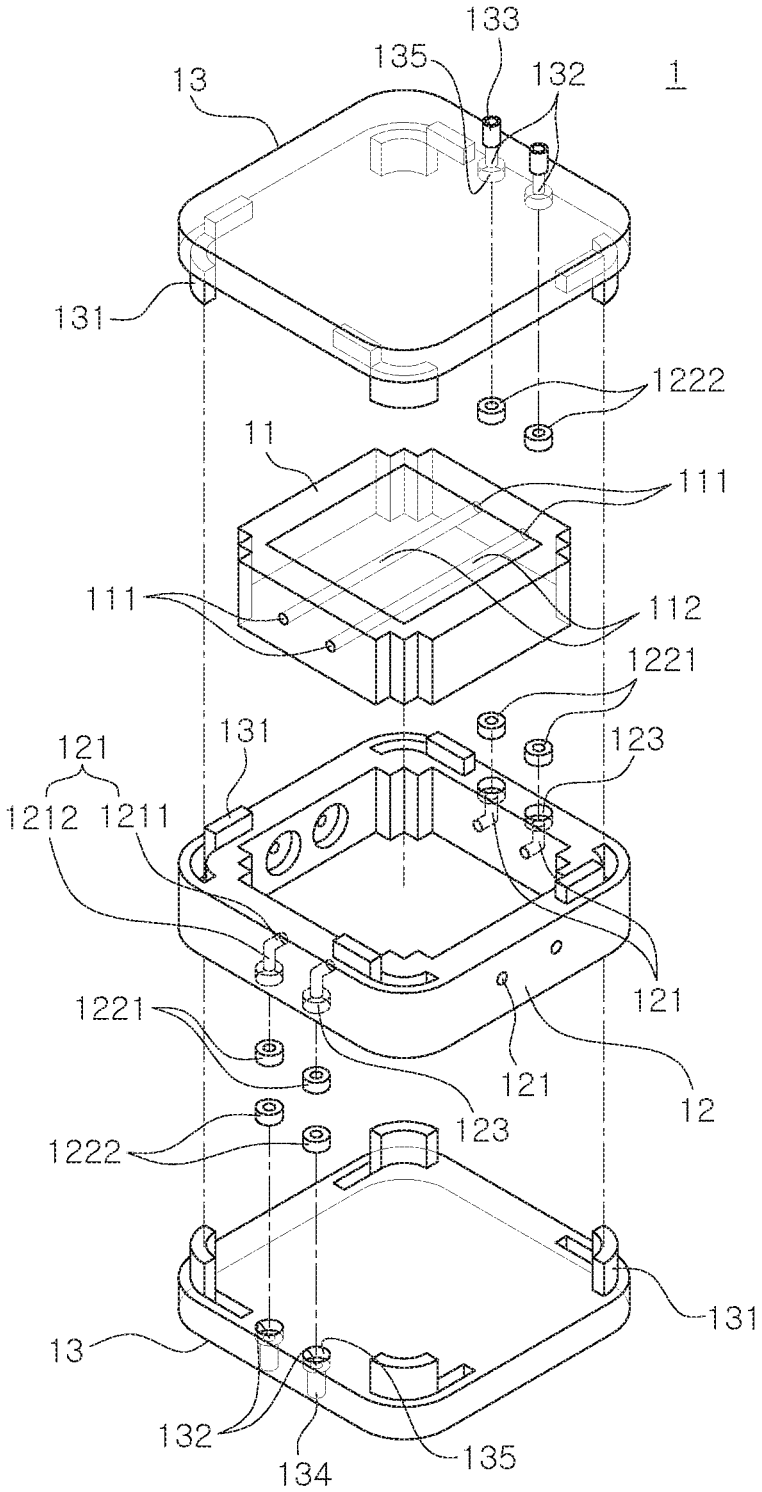

Referring to FIGS. 22B and 23B, the cover 13 may be provided with an extension hole 132 which is in communication with the vertical portion 1212 of the second hole 121 formed in the housing 12 and is in communication with the other modular fluidic chip 2.

In addition, the housing 12 and the cover 13 may include the plurality of coupling units 122 capable of connecting the other modular fluidic chips 2 disposed on upper and lower sides of the modular fluidic chip 1 to the modular fluidic chip 1.

The plurality of coupling units 122 may be formed of a magnetic body having an S-pole on one side thereof and an N-pole on the other side thereof, and may be installed in the housing 12 and the cover 13.

More specifically, the plurality of coupling units 122 may include first magnetic portions 1221 installed in the upper and lower surfaces of the housing 12 and second magnetic portions 1222 installed in inner surfaces of the respective covers 13 coupled to the upper and lower sides of the housing 12. Here, one side of the second magnetic portion 1222 installed in the cover 13 may be connected to the first magnetic portion 1221 installed in the housing 12 by magnetism, and the other side of the second magnetic portion 1222 may be connected to the second magnetic portion 1222 installed in the cover 13 of the other modular fluidic chip 2 by magnetism. Further, the housing 12 and the cover 13 may be provided with the seating groove 123 in which the first magnetic portion 1221 and the second magnetic portion 1222 are received.

In addition, a through hole communicating with the vertical portion 1212 provided in the housing 12 may be formed in the first magnetic portion 1221. The through hole formed in the first magnetic portion 1221 is formed in a shape corresponding to the vertical portion 1212 and may have the same central axis as the vertical portion 1212. In addition, a through hole communicating with the extension hole 132 provided in the cover 13 may be formed in the second magnetic portion 1222. The through hole formed in the second magnetic portion 1222 is formed in a shape corresponding to the extension hole 132 and may have the same central axis as the extension hole 132.

In addition, the cover 13 coupled to the upper side of the housing 12 and the cover 13 coupled to the lower side of the housing 12 may further include coupling structures capable of being coupled with the other modular fluidic chips 2 connected to upper and lower sides of the modular fluidic chip 1.

More specifically, the cover 13 disposed on the upper side of the housing 12 may be provided with a protrusion 133 capable of being coupled with a groove 134 provided in the other modular fluidic chip 2, and the cover 13 disposed on the lower side of the housing 120 may be provided with the groove 134 capable of being coupled with the protrusion 133 provided in the other modular fluidic chip 2. For example, the protrusion 133 and the groove 134 may be formed in a shape in which they correspond to each other.

Figure 24A:
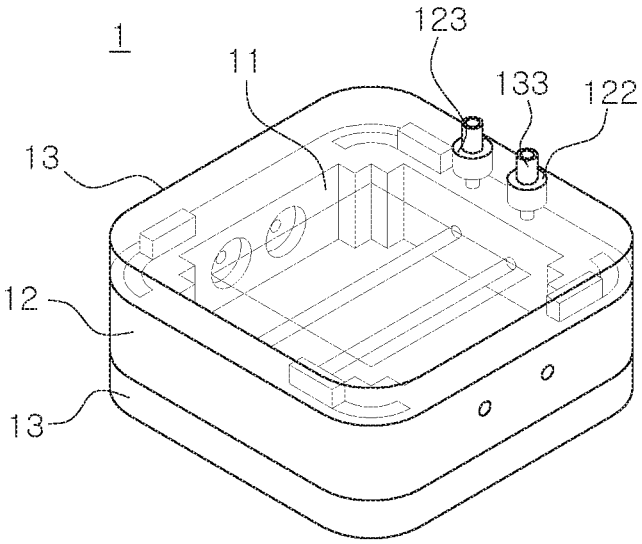
FIG. 24A is a perspective view illustrating a state in which the coupling unit having magnetism is installed on an outside of the cover in FIG. 22B.
Figure 24A:
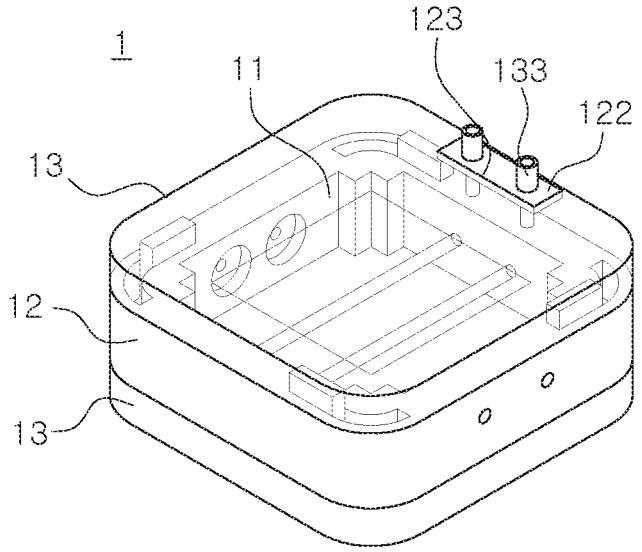

Referring to FIG. 24A, the coupling unit 122 in the form of a magnetic body may be installed on an outside of the cover 13 in order to further maximize the bonding force between the modular fluidic chip 1 and the other modular fluidic chip 2.

Here, the coupling unit 122 in the form of a magnetic body may be formed in a tablet shape as shown in (a) of FIG. 24A or formed in a panel shape as shown in (b) of FIG. 24A, and may be installed on an outer surface of the cover 13. In this case, the seating groove 123 in which the coupling unit 122 can be seated may be formed in the outer surface of the cover 13.

Figure 21B:
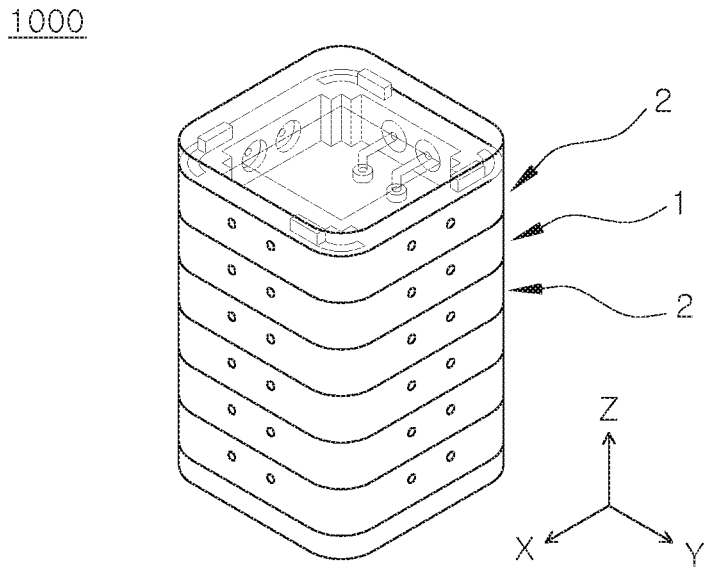
Figure 21B:
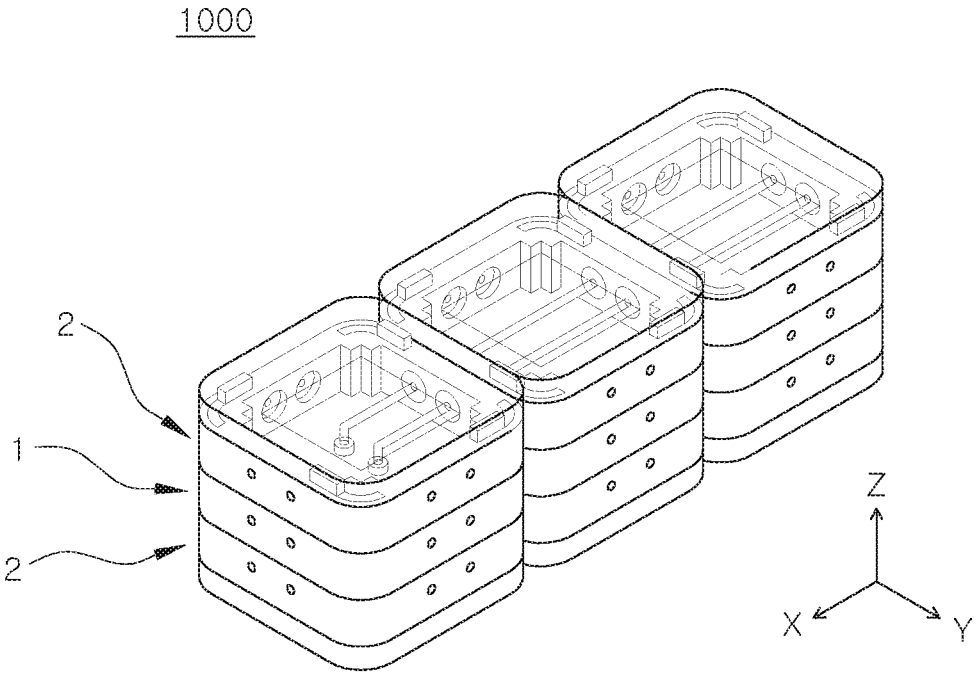

Meanwhile, referring to FIG. 21B, the modular fluidic chip 1 connected to the other modular fluidic chips 2 in the vertical direction (the Z-axis direction) may be formed in a structure in which the fluid channel 112 formed in the body 11 can guide a flow of fluid to the fluid channels 112 of the other modular fluidic chips 2 disposed on upper and lower sides of the modular fluidic chip 1.

Figure 22C:
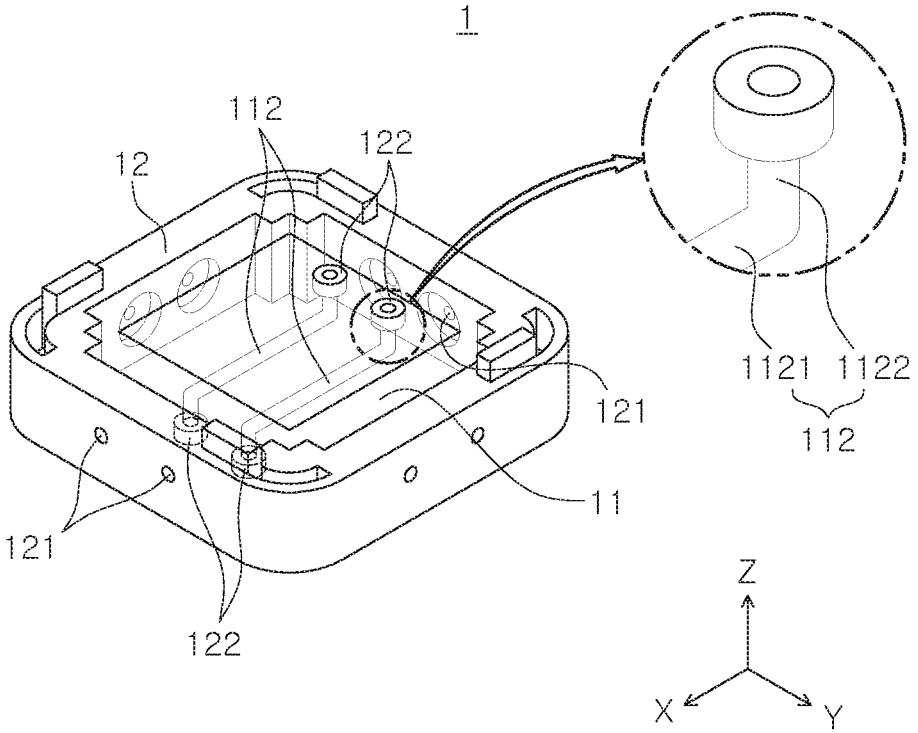
Figure 23C:
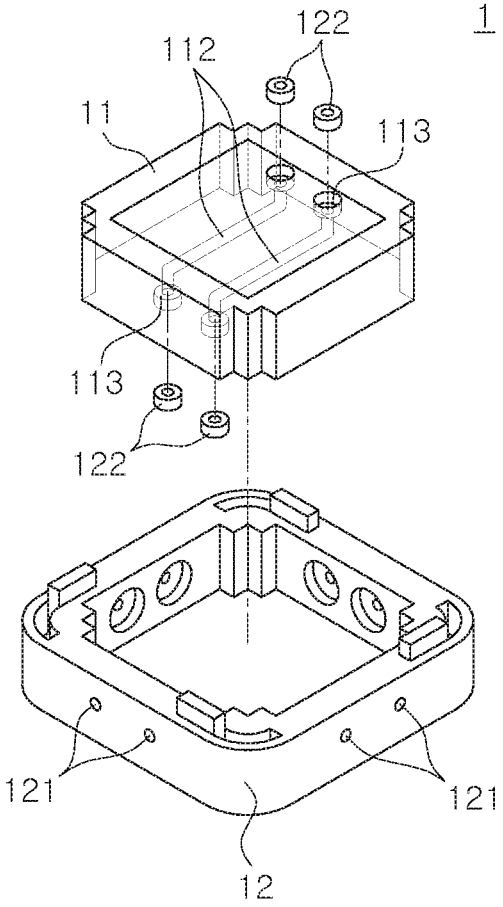

Referring to FIGS. 22C and 23C, the modular fluidic chip 1 connected to the other modular fluidic chips 2 in the vertical direction (the Z-axis direction) is configured of the body 11 and the housing 12, and the fluid channel 112 formed in the body 11 may include a horizontal portion 1121 which is disposed in parallel to the second hole 121 formed in the housing 12, and vertical portions 1122 which are in communication with one end and the other end of the horizontal portion 1121 and bent from horizontal portion 1121 upwardly and downwardly in the vertical direction to communicate with an external space. Here, the body 11 may include the plurality of coupling units 122 capable of connecting the other modular fluidic chips 2 disposed on the upper and lower sides of the housing 12 to the modular fluidic chip 1. Each of the plurality of coupling units 122 may be formed of a magnetic body having an S-pole on one side thereof and an N-pole on the other side thereof, and may be installed in seating grooves 113 provided in upper and lower surfaces of the body 11. Further, the plurality of coupling units 122 may be provided with a through hole communicating with each vertical portion 1122 provided in the body 11. The through hole is formed in a shape corresponding to the vertical portion 1122 and may have the same central axis as the vertical portion 1122.

Figure 25C:
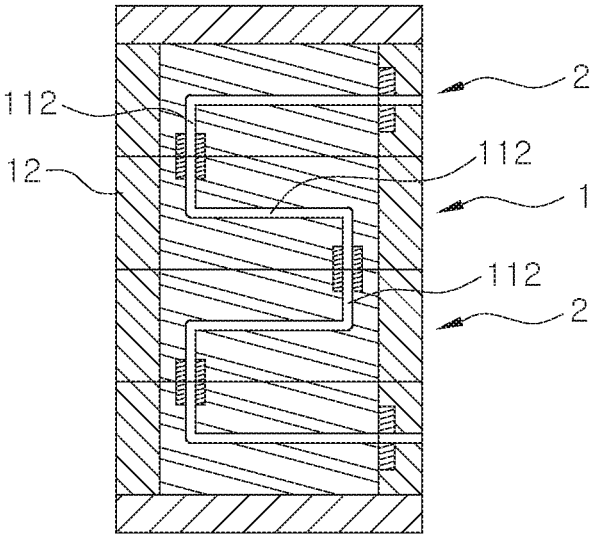
Figure 25C:
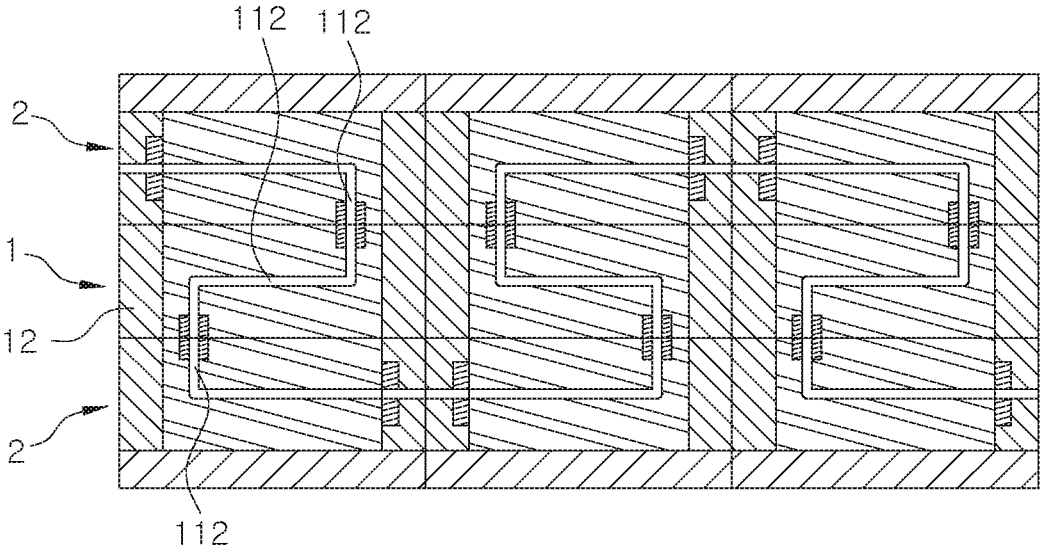

Therefore, as shown in FIG. 25C, when the housing 12 of the modular fluidic chip 1 and the other modular fluidic chip 2 are connected in the horizontal or vertical direction, the fluid channel 112 provided in the modular fluidic chip 1 may be aligned with and communicate with the fluid channel 112 provided in the other modular fluidic chip 2.

In addition, the above-described modular fluidic chip 1 may be formed in a structure capable of being connected to the other modular fluidic chip 2 in a state in which the cover 13 is coupled to the housing 12.

Figure 22D:
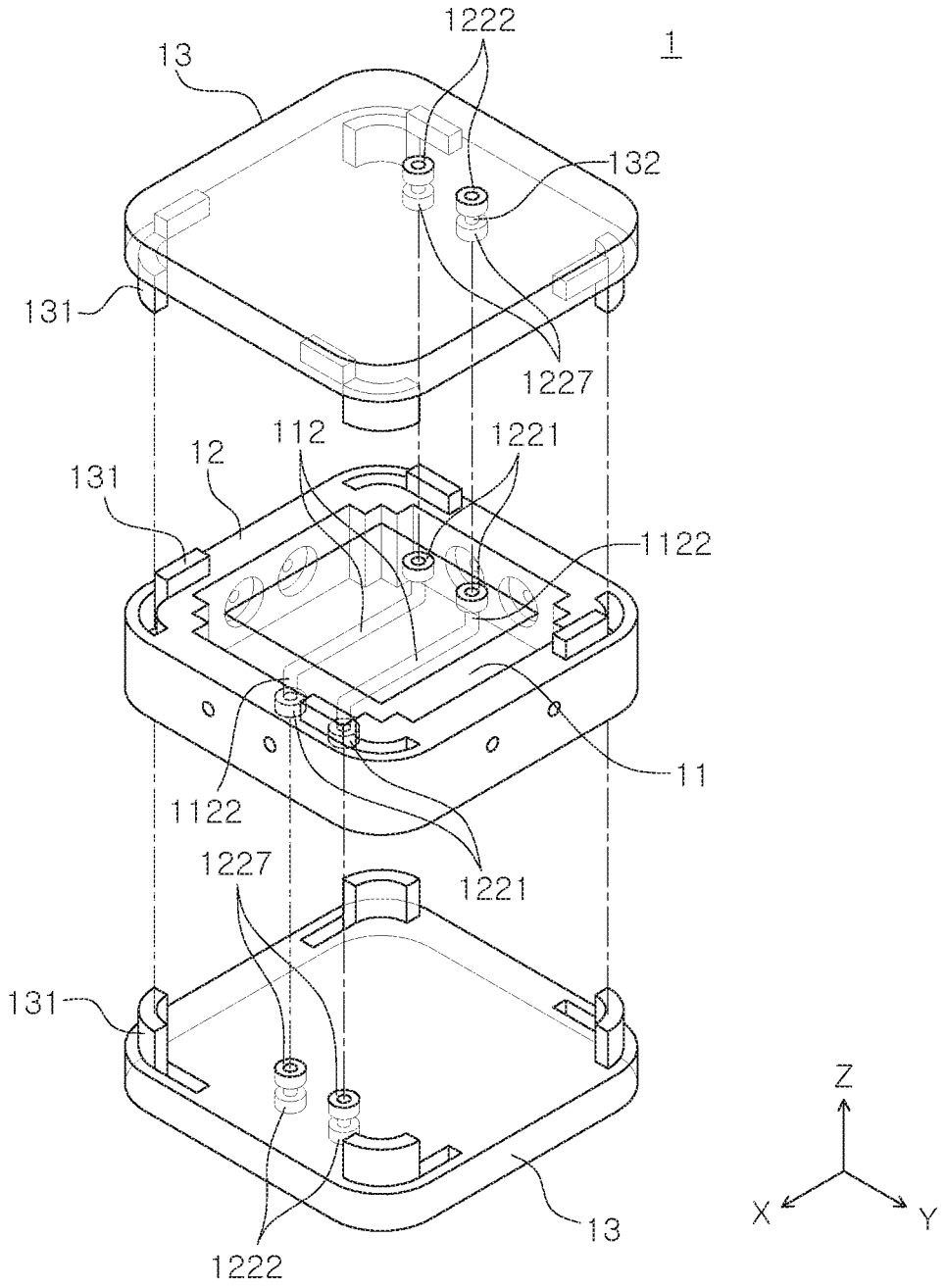
Figure 23D:
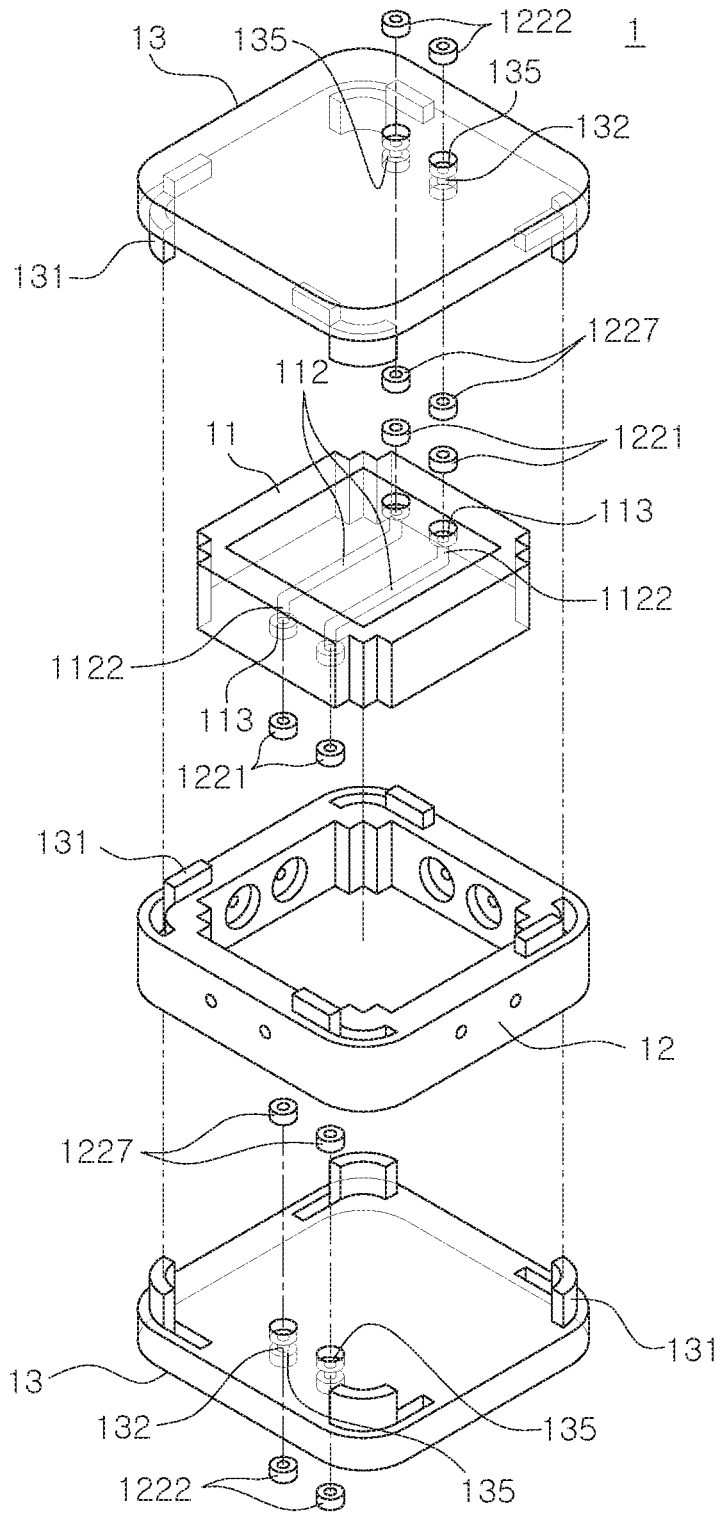

Referring to FIGS. 22D and 23D, the cover 13 may be provided with the extension hole 132 which is in communication with the vertical portion 1122 of the fluid channel 112 provided in the body 11 and is in communication with the other modular fluidic chip 2.

In addition, the body 11 and the cover 13 may include the plurality of coupling units 122 capable of connecting the other modular fluidic chips 2 disposed on the upper and lower sides of the modular fluidic chip 1 to the modular fluidic chip 1.

The plurality of coupling units 122 may be formed of a magnetic body having an S-pole on one side thereof and an N-pole on the other side thereof, and may be installed in the body 11 and the cover 13.

More specifically, the plurality of coupling units 122 may include the first magnetic portions 1221 installed in upper and lower surfaces of the body 11, the second magnetic portions 1222 installed in outer surfaces of the respective covers 13, and third magnetic portions 1227 installed in the inner surfaces of the respective covers 13. Here, the third magnetic portion 1227 installed in the inner surface of the cover 13 may be connected to the first magnetic portion 1221 installed in the body 11 by magnetism, and the second magnetic portion 1222 installed in the outer surface of the cover 13 may be connected to the second magnetic portion 1222 installed in the cover 13 of the other modular fluidic chip 2 by magnetism. Further, the body 11 may be provided with the seating groove 113 in which the first magnetic portion 1221 can be seated, and the cover 13 may be provided with a seating groove 135 in which the second magnetic portion 1222 and the third magnetic portion 1227 can be seated.

In addition, a through hole communicating with the vertical portion 1122 of the fluid channel 112 provided in the body 11 may be formed in the first magnetic portion 1221. The through hole formed in the first magnetic portion 1221 is formed in a shape corresponding to the vertical portion 1122 and may have the same central axis as the vertical portion 1122. In addition, a through hole communicating with the extension hole 132 provided in the cover 13 may be formed in the second magnetic portion 1222 and the third magnetic portion 1227. The through hole formed in the second magnetic portion 1222 and the third magnetic portion 1227 may be formed in a shape corresponding to the extension hole 132 and may have the same central axis as the extension hole 132.

Figure 24B:
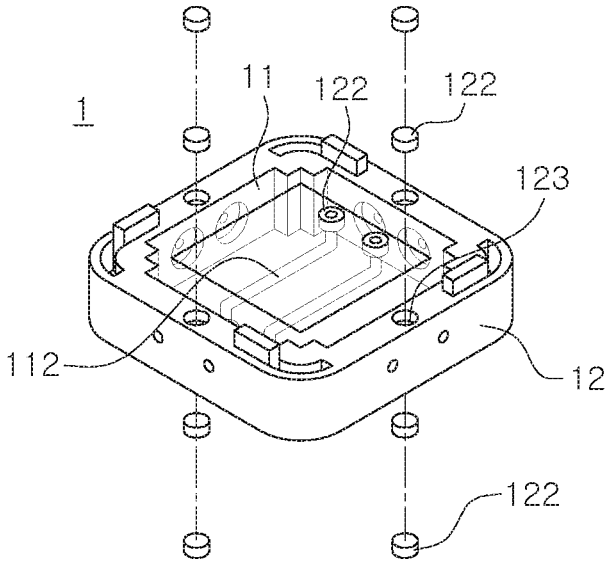
FIG. 24B is a perspective view illustrating a state in which the coupling unit having magnetism is further installed in the housing in FIG. 22C.
Figure 24B:
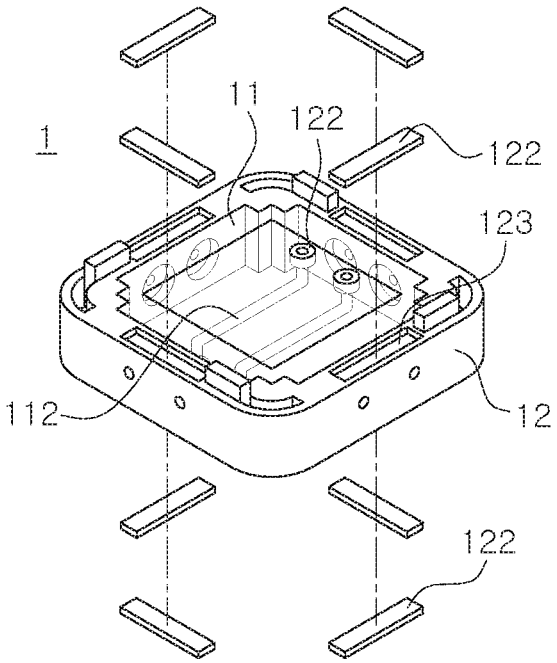

Referring to FIG. 24B, to further maximize the bonding force between the modular fluidic chip 1 and other modular fluidic chips 2, the coupling units 122 in the form of a magnetic body may be further installed in the upper and lower surfaces of the housing 12.

Here, the coupling unit 122 in the form of a magnetic body may be formed in a tablet shape as shown in (a) of FIG. 24B or formed in a panel shape as shown in (b) of FIG. 24B, and may be installed in the upper and lower surfaces of the housing 12. In this case, the seating groove 123 in which the coupling unit 122 can be seated may be formed in the upper and lower surfaces of the housing 12.

Moreover, the modular fluidic chip 1 according to the fourth embodiment of the present disclosure may further include an imaging part 14, a light source 15, and a temperature controller 16.

Figure 31:
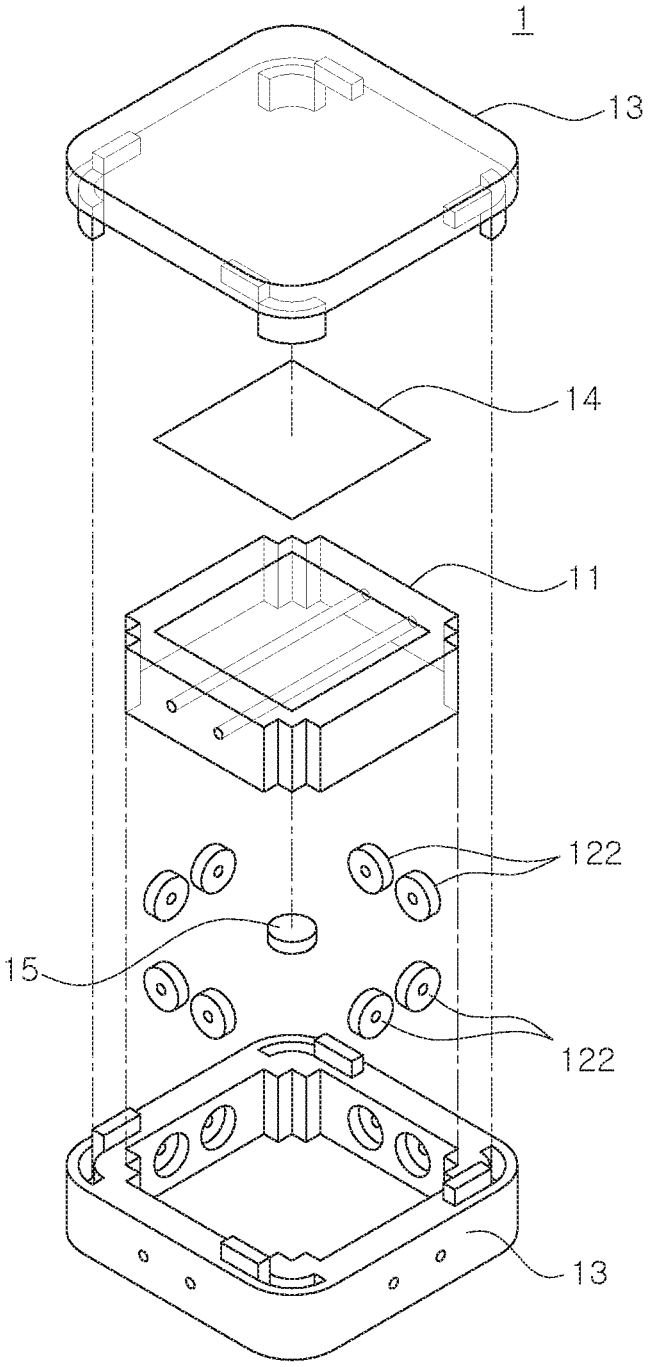
FIG. 31 is an exploded perspective view illustrating a state in which an imaging part and a light source are applied to the modular fluidic chip according to an embodiment of the present disclosure.

Referring to FIG. 31, the modular fluidic chip 1 may further include the imaging part 14 disposed on the cover 13 to image an entirety or a portion of the channel through which fluid flows, and the light source 15 disposed in the housing 12 or the cover 13 to irradiate predetermined light toward the channel.

Figure 32:
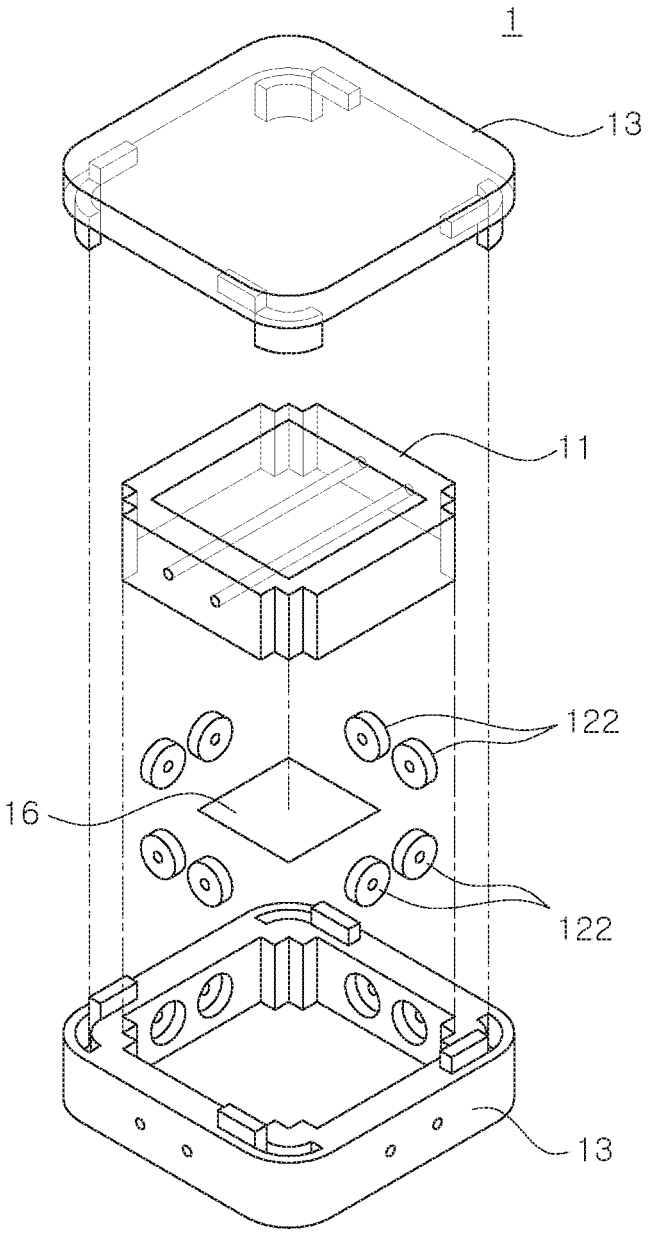
FIG. 32 is an exploded perspective view illustrating a state in which a temperature controller is applied to the modular fluidic chip according to an embodiment of the present disclosure.

In addition, referring to FIG. 32, the modular fluidic chip 1 may further include the temperature controller 16 which is installed in the housing 12 or the cover 13 to heat or cool the body 11 to a preset temperature. For example, a Peltier element or a resistance element may be applied for the temperature controller 16. Unlike this, the temperature controller 16 may be formed in a channel structure that directly supplies gas or air of a predetermined temperature to the channel. However, the temperature controller 16 is not necessarily limited thereto, and may be changed into various structures and shapes to thereby be applied.

Further, although not shown in the drawings, the modular fluidic chip 1 according to the fourth embodiment of the present disclosure may further include a gas supply part (not shown) and a circulator (not shown).

The gas supply part may supply gas of a set temperature to a clearance between the body 11 and the housing 12 or between the body 11 and the cover 13, or supply gas of a set temperature to the inside of the body to thereby heat or cool the body 11 to a preset temperature.

The circulator may be connected to the first hole 111 of the body 11 and may transfer pressure to the first hole 111 and the fluid channel 112 using a difference in pressure through a pumping action, thereby stably moving fluid in one direction.

Hereinafter, the modular fluidic chip 1 according to a fifth embodiment of the present disclosure will be described.

For reference, for respective components for describing the modular fluidic chip 1 according to the fifth embodiment of the present disclosure, the same reference numerals as those used in describing the modular fluidic chip 1 according to the fourth embodiment of the present disclosure will be used for convenience of description. The same or redundant descriptions will be omitted.

Referring to FIGS. 38 and 40, the modular fluidic chip 1 according to the fifth embodiment of the present disclosure includes the body 11.

The at least one first hole 111 is formed in the body 11 to guide a flow of fluid.

The first hole 111 communicates with the fluid channel 112 formed in the inside of the body 11 and the third hole 171 formed in the fluid connector 17 to be described later to thereby guide the flow of fluid in at least one direction of the X-axis direction and the Y-axis direction. And, the first hole 111 may be formed in a shape corresponding to the third hole 171 formed in the fluid connector 17 and the fluid channel 112 provided in the body 11.

In addition, the fluid channel 112 may be formed in the body 11.

The fluid channel 112 may communicate with the at least one first hole 111 to thereby allow a flow of fluid. In addition, the fluid channel 112 may be configured to perform one preset function on the flowing fluid, as well as guiding the flow of fluid in various directions.

In addition, the modular fluidic chip 1 according to the fifth embodiment of the present disclosure includes the housing 12.

Referring to FIGS. 38 and 40, the housing 12 is configured to receive the body 11 and the fluid connector 17 therein.

Further, the housing 12 includes a coupling unit 122.

The coupling unit 122 may be configured to couple the modular fluidic chip 1 to the other modular fluidic chips 2 in horizontal directions (the X-axis direction and Y-axis direction).

More specifically, the coupling unit 122 is received in the housing 12 or provided integrally with the housing 12 and may connect the modular fluidic chip 1 to the other modular fluidic chips 2 in the horizontal directions (the X-axis direction and Y-axis direction) and at the same time, may automatically align and fix the modular fluidic chip 1 to the other modular fluidic chips 2.

The coupling unit 122 may include a material having magnetism.

More specifically, the coupling unit 122 is formed of a magnetic body having an S-pole on one side thereof and an N-pole on the other side thereof, and may be installed on the inside or outside of the housing 12.

In addition, the coupling unit 122 may be formed in a structure capable of being directly connected to the coupling unit 122 provided in the other modular fluidic chip 2.

Referring to FIG. 26, the coupling unit 122 provided in the modular fluidic chip 1 and the coupling unit 122 of the other modular fluidic chip 2 corresponding thereto may include the convex portion 1223 or the concave portion 1224 corresponding to each other.

Referring to FIG. 27, the coupling unit 122 provided in the modular fluidic chip 1 may include the fastening portion 1225 having a hook shape at an end thereof to thereby be coupled with the other modular fluidic chip 2. In this case, the fastening groove 1226 corresponding to the fastening portion 1225 provided in the modular fluidic chip 1 may be formed in the other modular fluidic chip 2.

Referring to FIG. 28, the coupling unit 122 provided in the modular fluidic chip 1 may include the fastening portion 1225 having a bolt shape with a thread on an outer circumferential surface thereof to thereby be coupled with the other modular fluidic chip 2. In this case, the fastening groove 1226 corresponding to the fastening portion 1225 provided in the modular fluidic chip 1 may be formed in the other modular fluidic chip 2.

Referring to FIG. 29, the coupling unit 122 provided in the modular fluidic chip 1 may include the fastening portion 1225 having a '∩' shape in the form of a pin to thereby be coupled with the other modular fluidic chip 2. In this case, the fastening groove 1226 in which the fastening portion 1225 in the form of a pin can be inserted may be formed in the modular fluidic chip 2 that is different from the modular fluidic chip 1.

Referring to FIG. 30, the coupling unit 122 provided in the modular fluidic chip 1 may be coupled to the other modular fluidic chip 2 through the fastening portion 1225 having a bolt shape. In this case, the fastening groove 1226 in which the bolt-shaped fastening portion 1225 can be fastened may be formed in the modular fluidic chip 2 that is different from the modular fluidic chip 1.

In addition, the modular fluidic chip 1 according to the fifth embodiment of the present disclosure includes the fluid connector 17.

Referring to FIGS. 38 and 40, the fluid connector 17 may be formed in the form of a sheet or a pad, and may be detachably installed on the housing 12. Here, the seating groove 123 capable of receiving the fluid connector 17 may be formed in the housing 12. And, the third hole 171 aligned to correspond to the first hole 111 may be formed in the fluid connector 17.

In addition, the fluid connector 17 may be configured to form an interface when contacting another fluid connector 17.

More specifically, the fluid connector 17 may be formed of an elastically deformable elastomer material and form an interface at a contact portion when contacting another fluid connector 17 provided in the other modular fluidic chip 2. Here, an adhesive layer may be provided on one surface of the fluid connector 17, and the adhesive layer can be adhered to one surface of another fluid connector 17 when the fluid connector 17 contacts the other fluid connector 17.

However, the fluid connector 17 is not limited thereto, and may be changed into various shapes or various materials to thereby be applied within conditions capable of performing the same function. For example, when the housing 12 is manufactured, the fluid connector 17 may be integrally provided on the outer surface of the housing 12 through double injection molding, and may be formed in a circular or polygonal ring shape with a hole formed in a center thereof, or may be formed in a plate-like stopper shape. In addition, the fluid connector 17 may be formed of at least one of a polymer resin, an amorphous material, and a metal, and may include at least one of chlorinated polyethylene, ethylene propylene dimethyl, silicone rubber, acrylic resin, amide resin, epoxy resin, phenol resin, polyester-based resin, polyethylene-based resin, ethylene-propylene rubber, polyvinyl butyral resin, polyurethane resin, and nitrile-butadiene-based rubber.

Therefore, when the modular fluidic chip 1 and the other modular fluidic chip 2 are connected, the fluid connector 17 provided in the modular fluidic chip 1 is in close contact with the fluid connector 17 provided in the other modular fluidic chip 2 to form an interface. Through this, a connection portion between the modular fluidic chip 1 and the other modular fluidic chip 2 may be completely airtight to thereby block leakage of fluid.

In addition, the fluid connector 17 may be disposed on at least one of the outside and the inside of the housing 12.

Referring to FIG. 42, the fluid connector 17 disposed on the outside of the housing 12 may be in close contact with the other fluid connector 17 and form an interface, and the fluid connector 17 disposed on the inside of the housing 12 may be in close contact with the body 11 and form an interface.

In addition, the fluid connector 17 may be formed in a structure capable of being coupled to the housing 12.

Referring to FIGS. 38 and 40, the convex portion 173 having a protrusion shape may be formed on the fluid connector 17, and the convex portion 173 protrudes from an outer surface of the fluid connector 17 by a predetermined length and is inserted into the seating groove 123 formed in the housing 12. Accordingly, the fluid connector 17 is more stably coupled to the housing 12 to limit the movement thereof and further, even when the modular fluidic chip 1 is coupled to the other modular fluidic chip 2, it is feasible to prevent the fluid connector 17 from being separated from the housing 12.

Meanwhile, although not shown in the drawings, a concave portion having a groove shape may be formed in the fluid connector 17, and the concave portion may be recessed from the outer surface of the fluid connector 17 to a predetermined depth and may be coupled to the protrusion formed in the housing 12.

However, a coupling structure provided in the fluid connector 17 is not necessarily limited thereto, and may be changed into various shapes to thereby be applied.

In addition, the fluid connector 17 may be formed in a structure capable of directly communicating with the body 11 to thereby be connected to the other modular fluidic chip 2.

Referring to FIG. 40, the fluid connector 17 is received in the housing 12, but may pass through the housing 12 to thereby be in close contact with the outer surface of the body 11. Accordingly, the third hole 171 provided in the fluid connector 17 directly communicates with the first hole 111 provided in the body 11 and allows the flow of fluid.

That is, the fluid connector 17 installed by passing through the housing 12 is in close contact with the fluid connector 17 of the other modular fluidic chip 2 at one side thereof to form an interface, and is in close contact with the outer surface of the body 11 at the other side thereof to form an interface, so that points at which fluid may leak may be minimized. Through this, a stable fluid flow may be allowed For example, the fluid connector 17 may include the seating portion 172 which is seated in the seating groove 123 formed in the outer surface of the housing 12 and which is connected to the other modular fluidic chip 2, and the convex portion 173 which protrudes from one surface of the seating portion 172 by a predetermined length to pass through the housing 12 and which is in close contact with the outer surface of the body 11 to form an interface. Here, the concave portion 1231 may be provided in the inner surface of the housing 12, and the concave portion 1231 is formed in a shape corresponding to the outer surface of the convex portion 173 and supports the convex portion 173.

In addition, the fluid connector 17 may be formed in a structure in which it is divided into plural numbers, while directly communicating with the body 11.

Referring to FIGS. 41 and 42, the fluid connector 17 may include the seating portion 172, the convex portion 173, and the O-ring 174.

The seating portion 172 may be seated in the seating groove 123 formed in the outer surface of the housing 12 and may be in close contact with the other modular fluidic chip 2 to form an interface.

The convex portion 173 may be separated from the seating portion 172 and received in the concave portion 1231 provided inside the housing 12, and may be in close contact with the outer surface of the body 11 and form an interface.

The O-ring 174 is disposed between the seating portion 172 and the convex portion 173 to connect the seating portion 172 and the convex portion 173 to each other and uniformly distributes a load which acts on the fluid connector 17 in the axial direction when connecting the modular fluidic chip 1 and other modular fluidic chip 2, thereby preventing deformation of the seating portion 172 or the convex portion 173. For example, the O-ring 174 is formed of an elastic body, plastic or metallic material, and another hole communicating with the third hole 171 formed in the seating portion 172 and the convex portion 173 may be formed inside the O-ring 174.

However, the fluid connector 17 is not necessarily limited thereto, and may be changed into various forms to thereby be applied.

Hereinafter, the modular fluidic chip 1 according to a sixth embodiment of the present disclosure will be described.

For reference, for respective components for describing the modular fluidic chip 1 according to the sixth embodiment of the present disclosure, the same reference numerals as those used in describing the modular fluidic chip 1 according to the fourth embodiment of the present disclosure will be used for convenience of description. The same or redundant descriptions will be omitted.

Referring to FIGS. 13 and 17, the modular fluidic chip 1 according to the sixth embodiment of the present disclosure includes the body 11.

The at least one first hole 111 is formed in the body 11 to guide the flow of fluid.

The first hole 111 communicates with the second hole 121 of the housing 12 to be described later and the fluid channel 112 to be described later that is formed in the inside of the body 11 to thereby guide the flow of fluid in at least one direction of the X-axis direction and the Y-axis direction. In addition, the first hole 111 may be formed in a shape corresponding to the second hole 121 provided in the housing 12 and the fluid channel 112 provided in the body 11.

In addition, the fluid channel 112 may be formed in the body 11.

The fluid channel 112 may communicate with the at least one first hole 111 to thereby allow a flow of fluid. In addition, the fluid channel 112 may be configured to perform one preset function on the flowing fluid, as well as guiding the flow of fluid in various directions.

In addition, the modular fluidic chip 1 according to the sixth embodiment of the present disclosure includes the housing 12.

The housing 12 is formed in a frame structure having a receiving space formed therein, and is configured to receive the body 11 therein. In addition, the second hole 121 is formed in the housing 12, and the second hole 121 corresponds to the at least one first hole 111 provided in the body 11 and allows the flow of fluid, when the body 11 is received in the receiving space.

In addition, the housing 12 includes the fluid connector 17.

The fluid connector 17 is configured to connect the modular fluidic chip 1 with the other modular fluidic chip 2.

Referring to FIGS. 33 and 34, the fluid connector 17 may be formed in the form of a sheet or a pad, and may be detachably installed on the outer surface of the housing 12. Here, the seating groove 123 which corresponds to the fluid connector 17 so that the fluid connector 17 can be seated therein may be formed in the outer surface of the housing 12. And, the third hole 171 which is aligned to correspond to the first hole 111 and the second hole 121 may be formed in the fluid connector 17.

In addition, referring to FIGS. 35 and 36, the fluid connector 17 may be configured to form an interface when contacting another fluid connector 17.

More specifically, the fluid connector 17 may be formed of an elastically deformable elastomer material and form an interface at a contact portion when contacting another fluid connector 17. Here, an adhesive layer may be provided on one surface of the fluid connector 17, and the adhesive layer can be adhered to one surface of another fluid connector 17 when the fluid connector 17 contacts the other fluid connector 17.

However, the fluid connector 17 is not limited thereto, and may be changed into various shapes or various materials to thereby be applied within conditions capable of performing the same function. For example, when the housing 12 is manufactured, the fluid connector 17 may be integrally provided on the outer surface of the housing 12 through double injection molding, and may be formed in a circular or polygonal ring shape with a hole formed in a center thereof, or may be formed in a plate-like stopper shape. In addition, the fluid connector 17 may be formed of at least one of a polymer resin, an amorphous material, and a metal, and may include at least one of chlorinated polyethylene, ethylene propylene dimethyl, silicone rubber, acrylic resin, amide resin, epoxy resin, phenol resin, polyester-based resin, polyethylene-based resin, ethylene-propylene rubber, polyvinyl butyral resin, polyurethane resin, and nitrile-butadiene-based rubber.

Therefore, when the modular fluidic chip 1 and the other modular fluidic chip 2 are connected in the horizontal or vertical direction, the fluid connector 17 provided in the modular fluidic chip 1 is in close contact with the fluid connector 17 provided in the other modular fluidic chip 2 and forms an interface. Through this, the connection portion between the modular fluidic chip 1 and the other modular fluidic chip 2 may be completely airtight to thereby block leakage of fluid. Here, the coupling units 122 to be described later that have magnetism so as to maximize adhesion of the fluid connectors 17 may be further disposed on the inner surfaces of the respective housings 12 provided in the modular fluidic chip 1 and the other modular fluidic chip 2.

In addition, the fluid connector 17 may be disposed on at least one of the outside and the inside of the housing 12.

Referring to FIG. 37, the fluid connector 17 disposed on the outside of the housing 12 may be in close contact with the other fluid connection part 17 and form an interface, and the fluid connector 17 disposed on the inside of the housing 12 may be in close contact with the body 11 and form an interface.

In addition, the fluid connector 17 may be formed in a structure capable of being coupled to the housing 12.

Referring to FIGS. 38 and 39, the convex portion 173 having a protrusion shape may be formed on the fluid connector 17, and the convex portion 173 protrudes from an outer surface of fluid connector 17 by a predetermined length and is inserted into the seating groove 123 formed in the housing 12.

Meanwhile, although not shown in the drawings, a concave portion having a groove shape may be formed in the fluid connector 17, and the concave portion may be recessed from the outer surface of the fluid connector 17 to a predetermined depth and may be coupled to the protrusion formed in the housing 12.

However, a coupling structure provided in the fluid connector 17 is not necessarily limited thereto, and may be changed into various shapes to thereby be applied.

In addition, the fluid connector 17 may be formed in a structure capable of directly communicating with the body 11 to thereby be connected to the other modular fluidic chip 2.

Referring to FIG. 40, the fluid connector 17 is received in the housing 12, but may pass through the housing 12 to thereby be in close contact with the outer surface of the body 11. Accordingly, the third hole 171 provided in the fluid connector 17 directly communicates with the first hole 111 provided in the body 11 and allows the flow of fluid.

That is, the fluid connector 17 installed by passing through the housing 12 is in close contact with the fluid connector 17 of the other modular fluidic chip 2 at one side thereof to form an interface, and is in close contact with the outer surface of the body 11 at the other side thereof to form an interface, so that points at which fluid may leak may be minimized. Through this, a stable fluid flow may be allowed.

In addition, the fluid connector 17 may be formed in a structure in which it is divided into plural numbers, while directly communicating with the body 11.

Referring to FIGS. 41 and 42, the fluid connector 17 may include the seating portion 172, the convex portion 173, and the O-ring 174.

The seating portion 172 may be seated in the seating groove 123 formed in the outer surface of the housing 12 and may be in close contact with the other modular fluidic chip 2 to form an interface.

The convex portion 173 may be separated from the seating portion 172 and received in the concave portion 1231 provided inside the housing 12, and may be in close contact with the outer surface of the body 11 and form an interface.

The O-ring 174 is disposed between the seating portion 172 and the convex portion 173 to connect the seating portion 172 and the convex portion 173 to each other and uniformly distributes a load which acts on the fluid connector 17 in the axial direction when connecting the modular fluidic chip 1 and other modular fluidic chip 2, thereby preventing deformation of the seating portion 172 or the convex portion 173.

In addition, the modular fluidic chip 1 according to the sixth embodiment of the present disclosure may further include at least one sensor 18.

Figure 43:
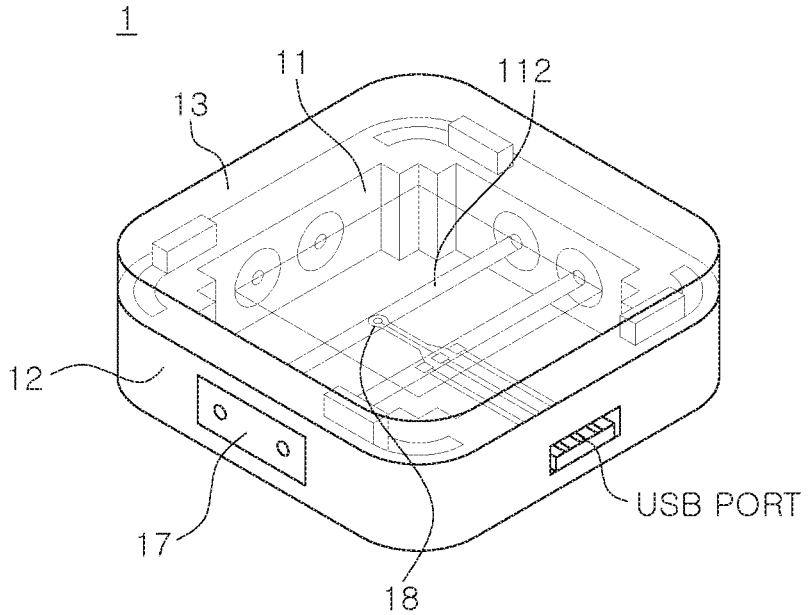
FIG. 43 is a perspective view schematically illustrating a state in which a sensor is installed in the modular fluidic chip according to an embodiment of the present disclosure.
Figure 43:
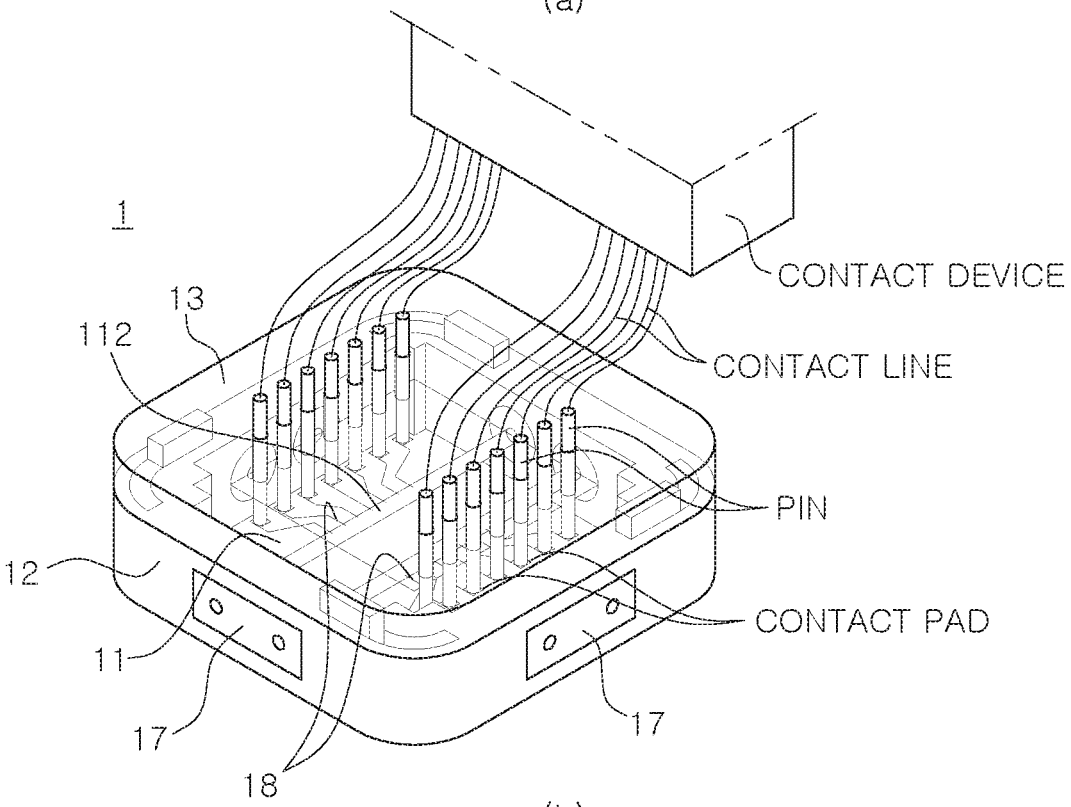

Referring to FIG. 43, the at least one sensor 18 is installed in the inside of the body 11 in which the fluid channel 112 is formed, and is connected to the fluid channel 112 through a microchannel. When fluid flows in the fluid channel 112, the at least one sensor 18 may detect a signal generated from the fluid.

Here, the at least one sensor 18 may be configured to detect at least one of an electric signal, a fluorescent signal, an optical signal, an electrochemical signal, a chemical signal, and a spectroscopic signal.

In addition, the at least one sensor 18 may be formed of any one of a metal, an organic-inorganic composite, and an organic conductor.

More specifically, the at least one sensor 18 may be formed of a metal electrode including at least one material of Au, Mg, Ti, Cr, Mn, Fe, Co, Ni, Cu, Zn, Ga, Al, Zr, Nb, Mo, Ru, Ag, and Sn, may be formed of an organic electrode including at least one material of a conductive polymer and carbon, or may be formed of an organic-inorganic composite electrode in which at least one material among the materials constituting the metal electrode and at least one material among the materials constituting the organic electrode are mixed.

In addition, the at least one sensor 18 may be formed of a material having transparency so as to detect at least one of a fluorescent signal, an optical signal, and a spectroscopic signal.

For example, as shown in FIG. 43(*a*), the at least one sensor 18 may include an electrode that is installed in the inside of the body 11 and connected to the fluid channel 112, and a USB port that is electrically connected to the electrode and connectable from the outside through a USB connector. In addition, as shown in FIG. 43(*b*), the at least one sensor 18 may include a plurality of electrodes that are installed in the inside of the body 11 and connected to the fluid channel 112 at a plurality of positions, contact pads that are connected to the plurality of electrodes, a plurality of communication holes that are formed in the cover 13 to communicate an external space with a plurality of the contact pads, pins (fixation pins) that are inserted into the plurality of communication holes and contact the plurality of contact pads, and contact lines that connect the fixation pins and an external connection device (a contact device) to each other and transmit a signal sensed through the fixation pin to the external connection device.

However, the at least one sensor 18 is not limited thereto, and may be tinged in various forms to thereby be applied.

Hereinafter, the fluidic flow system 1000 (hereinafter, referred to as 'fluidic flow system 1000') including the modular fluidic chips according to embodiments of the present disclosure will be described.

For reference, for respective components for describing the fluidic flow system 1000, the same reference numerals as those used in describing the modular fluidic chip 1 according to the first embodiment of the present disclosure will be used for convenience of description. The same or redundant descriptions will be omitted.

Referring to FIGS. 1 and 2, the fluidic flow system 1000 is a fluidic flow system 1000 for molecular diagnosis, capable of performing processes of sample collection, extraction of a gene from the collected sample, amplification using a polymerase chain reaction, and analysis, from fluid such as body fluid or blood. The fluidic flow system 1000 includes a first modular fluidic chip 1 capable of implementing a first function, and at least one second modular fluidic chip 2 capable of implementing a second function different from the first function and being connected to the first modular fluidic chip 1 in at least one direction of a horizontal direction and a vertical direction. Here, the second modular fluidic chip 2 does not necessarily implement a function different from that of the first modular fluidic chip 1, and may be applied to implement the same function as the first modular fluidic chip 1 as needed.

As described above, according to the embodiments of the present disclosure, a fluidic chip capable of performing one function is formed in the form of a module, whereby the fluidic flow system 1000 of various structures can be implemented without restriction in shape or size by connecting a plurality of fluidic chips capable of performing different functions as necessary. Through this, various and accurate experimental data can be obtained, and when a specific portion is deformed or damaged, only the fluidic chip corresponding thereto can be replaced, thereby reducing manufacture and maintenance costs.

In addition, the housing 12 which is connectable to another modular fluidic chip 2, and the body 11 which has the fluid channel 112 formed therein and is selectively replaced in the housing 12 are each formed in a module shape. Accordingly, it is feasible to easily change a position of a selected section and a shape of the fluid channel in one fluidic flow system 1000, as needed. Through this, it is feasible to promptly change experimental conditions, thereby allowing for a variety of experiments during a preset period of time, as compared to the fluidic flow system 1000 according to the prior art, and when a part is defective or damaged, only the housing 12 or the body 11 corresponding to the part can be promptly replaced.

In addition, when the modular fluidic chip 1 and the other modular fluidic chip 2 are connected, holes of the respective fluidic chips are in an aligned state and communicate with each other, and at connection portions of the modular fluidic chip 1 and other modular fluidic chip 2, the fluid connectors 17 that are in close contact with each other and form an interface are provided. Thus, leakage of fluid at the connection portions during the flow of fluid is prevented, and a change in fluid pressure is minimized, and furthermore, a composition of the fluid or a shape of microdroplets can be maintained.

In the above, preferred embodiments of the present disclosure have been illustrated and described, but the present disclosure is not limited to the specific embodiments described above, and those skilled in the art will appreciate that various modifications are possible, without departing from the scope and spirit of the invention as disclosed in the accompanying claims. Such modifications should not be individually understood from the technical spirit or prospect of the present disclosure.

The invention claimed is:

1. A modular fluidic chip comprising:

a body configured to have at least one flow channel formed in an inside thereof, and be connected to another modular fluidic chip to allow the at least one flow channel to communicate with a flow channel provided in the other modular fluidic chip;

wherein the body includes a core member in which the at least one flow channel is formed, and a connection member provided in the core member so as to be coupled with the other modular fluidic chip; and wherein the connection member is formed of an elastic material, and is configured to open the flow channel by being compressed in an axial direction and at the same time, expanded in a direction perpendicular to the axial direction when the connection member is subjected to pressure in the axial direction through the other modular fluidic chip coupled to one side thereof, and configured to close the flow channel by being restored by an elastic force when the pressure is released.

2. The modular fluidic chip of claim 1, wherein the connection member is configured to be provided integrally with the core member or coupled to and separable from the core member.

3. The modular fluidic chip of claim 1, wherein the connection member is configured to open the flow channel provided at an inside thereof when coupled to the other modular fluidic chip and close the flow channel when separated from the other modular fluidic chip.

4. The modular fluidic chip of claim 1, wherein, on an inner surface of the connection member, opening and closing portions that contact or are separated from each other according to deformation of the connection member to thereby close and open the flow channel are provided.

5. The modular fluidic chip of claim 1, wherein the at least one flow channel includes a first flow channel and a second flow channel that have different heights.

6. The modular fluidic chip of claim 5, wherein the first flow channel is formed at a position relatively lower than that of the second flow channel, and the first flow channel and the second flow channel are configured to guide fluid flowing therein in a horizontal direction.

7. The modular fluidic chip of claim 5, wherein the at least one flow channel further includes:

a third flow channel configured to guide a flow of fluid in a vertical direction;

a chamber configured to store and stabilize the fluid introduced from one side thereof, therein, and discharge the fluid to the other side thereof; and a fourth flow channel formed at a position relatively lower than that of the first flow channel or the chamber, and configured to guide the fluid flowing therein in the horizontal direction.

8. The modular fluidic chip of claim 7, wherein the at least one flow channel is configured to allow the fluid discharged from the chamber to pass through at least one of the first flow channel, the second flow channel, the third flow channel, and the fourth flow channel.

9. The modular fluidic chip of claim 5, wherein the body is provided with an air flow hole allowing the at least one flow channel and an external space to communicate with each other.

10. The modular fluidic chip of claim 9, further comprising:

an opening and closing member configured to be attached to the body and open and close the air flow hole.

11. The modular fluidic chip of claim 10, wherein the opening and closing member is formed of a hydrophobic material capable of removing bubbles from a hydrophilic fluid flowing through the at least one flow channel, or is formed of a fibrous structure coated with a hydrophobic material on a surface thereof.

12. The modular fluidic chip of claim 11, wherein the opening and closing member formed of the hydrophobic material is formed of one or more hydrophobic materials selected from a group consisting of polytetrafluro ethylene (PTFE), polyethylene terephtalate (PET), and polyvinyl chloride.

13. The modular fluidic chip of claim 10, wherein the opening and closing member is formed of a hydrophilic material capable of removing bubbles from a hydrophobic fluid flowing through the at least one flow channel, or is formed of a fibrous structure coated with a hydrophilic material on a surface thereof.

14. The modular fluidic chip of claim 10, wherein the opening and closing member includes a hydrophobic material and a hydrophilic material.

15. The modular fluidic chip of claim 5, wherein the body is formed integrally through 3D printing processing or is formed in a form of a plurality of modules that are combined with and separated from each other through injection molding processing.

16. The modular fluidic chip of claim 1, wherein the core member includes a plurality of first guide flow channels for guiding a flow of fluid in a vertical direction; and wherein the body includes a film member configured to be attached to an outer surface of the core member and allow the plurality of first guide flow channels to communicate with each other.

17. The modular fluidic chip of claim 16, wherein the film member includes:

a first film layer attached to the outer surface of the core member and having at least one second guide flow channel formed in an inside thereof, the at least one second guide flow channel being connected to the plurality of first guide flow channels to guide the flow of the fluid in a horizontal direction; and a second film layer attached to an outer surface of the first film layer.

18. The modular fluidic chip of claim 16, wherein the core member is formed integrally through 3D printing processing or is formed in a form of a plurality of modules that are combined with and separated from each other through injection molding processing.

19. A fluidic flow system comprising:

a first modular fluidic chip configured to implement a first function; and at least one second modular fluidic chip configured to implement a second function different from the first function and connectable to the first modular fluidic chip in at least one of a horizontal direction and a vertical direction; and wherein at least one of the first modular fluidic chip and the second modular fluidic chip comprises a body configured to have at least one flow channel formed in an inside thereof;

wherein the body includes a core member in which the at least one flow channel is formed, and a connection member provided in the core member so as to be coupled with the other modular fluidic chip; and wherein the connection member is formed of an elastic material, and is configured to open the flow channel by being compressed in an axial direction and at the same time, expanded in a direction perpendicular to the axial direction when the connection member is subjected to pressure in the axial direction through the other modular fluidic chip coupled to one side thereof, and configured to close the flow channel by being restored by an elastic force when the pressure is released.

* * * * *